US009342027B2

(12) United States Patent
Tokushima et al.

(10) Patent No.: US 9,342,027 B2
(45) **Date of Patent: *May 17, 2016**

(54) PRINTING CONTROL APPARATUS, IMAGE FORMING SYSTEM, AND PRINTING CONTROL METHOD WHICH REPLACE A TYPE OF SURFACE EFFECT IMPARTED ON A RECORDING MEDIUM

(75) Inventors: Yuji Tokushima, Kanagawa (JP); Hiroaki Suzuki, Chiba (JP); Shinya Kobayashi, Kanagawa (JP); Hiroo Kitagawa, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 370 days.

This patent is subject to a terminal disclaimer.

(21) Appl. No.: 13/422,764

(22) Filed: Mar. 16, 2012

(65) Prior Publication Data

US 2012/0237247 A1 Sep. 20, 2012

(30) Foreign Application Priority Data

Mar. 18, 2011 (JP) ..... 2011-061658
Mar. 7, 2012 (JP) ..... 2012-050943

(51) Int. Cl.
*G03G 15/00* (2006.01)
*G03G 15/20* (2006.01)

(52) U.S. Cl.
CPC ..... *G03G 15/6585* (2013.01); *G03G 15/2021* (2013.01); *G03G 2215/0081* (2013.01); *G03G 2215/00805* (2013.01); *G03G 2215/2006* (2013.01)

(58) Field of Classification Search
CPC ..... G03G 15/6585; G03G 2215/2006; G03G 2215/0081
USPC ..... 399/13, 82, 85
See application file for complete search history.

(56) References Cited

U.S. PATENT DOCUMENTS

| | | | | |
|---|---|---|---|---|
| 5,678,133 | A * | 10/1997 | Siegel | 399/67 |
| 8,768,232 | B2 * | 7/2014 | Yamamoto et al. | 399/341 |
| 2005/0111015 | A1 * | 5/2005 | Tsujimoto | 358/1.9 |
| 2006/0028671 | A1 * | 2/2006 | Katayanagi | 358/1.14 |
| 2009/0207429 | A1 * | 8/2009 | Iguchi | 358/1.9 |
| 2011/0206429 | A1 * | 8/2011 | Terao et al. | 399/341 |
| 2012/0062956 | A1 * | 3/2012 | Kitagawa et al. | 358/2.1 |

FOREIGN PATENT DOCUMENTS

| | | | |
|---|---|---|---|
| JP | 01156070 | A * | 6/1989 |
| JP | 2002-202645 | | 7/2002 |

(Continued)

*Primary Examiner* — David Gray
*Assistant Examiner* — Tyler Hardman
(74) *Attorney, Agent, or Firm* — Oblon, McClelland, Maier & Neustadt, L.L.P.

(57) ABSTRACT

A printing control apparatus includes an acquiring unit, a storing unit, a replacing unit, and a generating unit. The acquiring unit is configured to acquire apparatus configuration information of a printing apparatus that forms an image based on image data. The storing unit is configured to store therein gloss control plane data in which a type of a surface effect imparted to a recording medium and a control value for specifying an area in the recording medium, to which the surface effect is imparted, are designated. The replacing unit is configured to replace, based on the apparatus configuration information, the type of the surface effect imparted to the recording medium in the gloss control plane data with a predetermined type of a surface effect. The generating unit is configured to generate the image data based on the gloss control plane data subjected to the replacement by the replacing unit.

10 Claims, 31 Drawing Sheets

(56) References Cited

FOREIGN PATENT DOCUMENTS

| | | |
|---|---|---|
| JP | 3473588 | 9/2003 |
| JP | 2006-251722 | 9/2006 |
| JP | 2007-34040 | 2/2007 |
| JP | 2008-122709 | 5/2008 |
| JP | 2009-8709 | 1/2009 |
| JP | 2010-91813 | 4/2010 |

* cited by examiner

FIG.3
| GLOSS CONTROL NAME | GLOSS | DEVIATION |
|---|---|---|
| MIRROR SURFACE GLOSS | Gs≥80 | ΔGs≤10 |
| SOLID GLOSS | Gs=Gs (SOLID GLOSS) | ΔGs≤10 |
| HALFTONE DOT MATT | Gs=Gs (1C30% HALFTONE DOT) | ΔGs≤10 |
| MATT | Gs≤10 | ΔGs≤10 |
FIG.4A
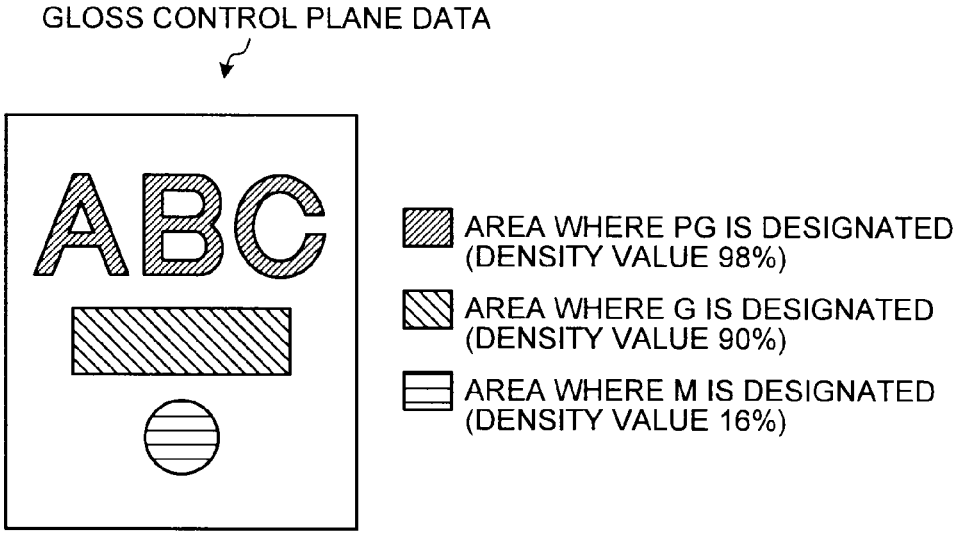
FIG.4B
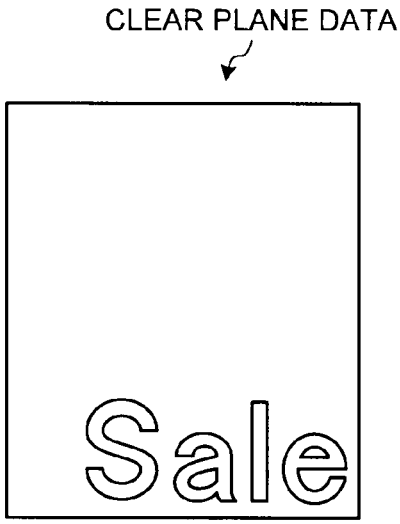

FIG.10

| DEN-SITY (%) | DENSITY | | | EFFECT | GLOSSER ON/OFF | | | |
|---|---|---|---|---|---|---|---|---|
| | REPRE-SENTATIVE VALUE | NUMERICAL VALUE RANGE | | | | CLEAR TONER PLANE 1 (PRINTER MACHINE) | CLEAR TONER PLANE 2 | CLEAR TONER PLANE 3 |
| 98% | 250 | 248 | 255 | MIRROR SURFACE GLOSS TYPE A | ON | INVERSE MASK A | NO DATA | NO DATA |
| 96% | 245 | 243 | 247 | MIRROR SURFACE GLOSS TYPE B | ON | INVERSE MASK B | NO DATA | NO DATA |
| 94% | 240 | 238 | 242 | MIRROR SURFACE GLOSS TYPE C | ON | INVERSE MASK C | NO DATA | NO DATA |
| 92% | 235 | 233 | 237 | RESERVED | | | | |
| 90% | 230 | 228 | 232 | SOLID GLOSS TYPE 1 | OFF | INVERSE MASK 1 | NO DATA | NO DATA |
| 88% | 224 | 222 | 227 | SOLID GLOSS TYPE 2 | OFF | INVERSE MASK 2 | NO DATA | NO DATA |
| 86% | 219 | 217 | 221 | SOLID GLOSS TYPE 3 | OFF | INVERSE MASK 3 | NO DATA | NO DATA |
| 84% | 214 | 212 | 216 | SOLID GLOSS TYPE 4 | OFF | INVERSE MASK 4 | NO DATA | NO DATA |
| 82% | 209 | 207 | 211 | RESERVED | | | | |
| 46% | 117 | 115 | 119 | RESERVED | | | | |
| 44% | 112 | 110 | 114 | WATERMARK CHARACTER 3 (XXX) | OFF | NO DATA | TILE CHARACTER STRING 3 | NO DATA |
| 42% | 107 | 105 | 109 | WATERMARK CHARACTER 2 (COPY STRICTLY PROHIBITED) | | NO DATA | TILE CHARACTER STRING 2 | NO DATA |
| 40% | 102 | 100 | 104 | WATERMARK CHARACTER 1 (SAMPLE) | | NO DATA | TILE CHARACTER STRING 1 | NO DATA |
| 38% | 97 | 95 | 99 | RESERVED | | | | |
| 36% | 92 | 90 | 94 | RESERVED | | | | |
| 34% | 87 | 85 | 89 | WOVEN PATTERN 3 (XXX) | | NO DATA | TILE WOVEN PATTERN 3 | NO DATA |
| 32% | 82 | 80 | 84 | WOVEN PATTERN 3 (LATTICE) | | NO DATA | TILE WOVEN PATTERN 2 | NO DATA |
| 30% | 76 | 74 | 79 | WOVEN PATTERN 3 (WAVE) | | NO DATA | TILE WOVEN PATTERN 1 | NO DATA |
| 28% | 71 | 69 | 73 | RESERVED | | | | |
| 26% | 66 | 64 | 68 | RESERVED | | | | |
| 24% | 61 | 59 | 63 | TACTUAL PATTERN 3 (ROUGH) | | NO DATA | TILE NET PATTERN 3 | NO DATA |
| 22% | 56 | 54 | 58 | TACTUAL PATTERN 2 (MEDIUM) | | NO DATA | TILE NET PATTERN 2 | NO DATA |
| 20% | 51 | 49 | 53 | TACTUAL PATTERN 1 (FINE) | | NO DATA | TILE NET PATTERN 1 | NO DATA |
| 18% | 46 | 44 | 48 | RESERVED | | | | |
| 16% | 41 | 39 | 43 | HALFTONE DOT MATT TYPE 4 | OFF | NO DATA | HALFTONE 4 | NO DATA |
| 14% | 36 | 34 | 38 | HALFTONE DOT MATT TYPE 3 | OFF | NO DATA | HALFTONE 3 | NO DATA |
| 12% | 31 | 29 | 33 | HALFTONE DOT MATT TYPE 2 | OFF | NO DATA | HALFTONE 2 | NO DATA |
| 10% | 25 | 23 | 28 | HALFTONE DOT MATT TYPE 1 | OFF | NO DATA | HALFTONE 1 | NO DATA |
| 8% | 20 | 18 | 22 | RESERVED | | | | |
| 6% | 15 | 13 | 17 | MATT TYPE C | ON & OFF | NO DATA | NO DATA | SOLID C |
| 4% | 10 | 8 | 12 | MATT TYPE B | ON & OFF | NO DATA | NO DATA | SOLID B |
| 2% | 5 | 1 | 7 | MATT TYPE A | ON & OFF | NO DATA | NO DATA | SOLID A |
| 0% | 0 | 0 | 0 | NONE | OFF | NO DATA | NO DATA | NO DATA |

PRINTING CONTROL APPARATUS, IMAGE FORMING SYSTEM, AND PRINTING CONTROL METHOD WHICH REPLACE A TYPE OF SURFACE EFFECT IMPARTED ON A RECORDING MEDIUM

CROSS-REFERENCE TO RELATED APPLICATIONS

The present application claims priority to and incorporates by reference the entire contents of Japanese Patent Application No. 2011-061658 filed in Japan on Mar. 18, 2011 and Japanese Patent Application No. 2012-050943 filed in Japan on Mar. 7, 2012.

BACKGROUND OF THE INVENTION

1. Field of the Invention

The present invention relates to a printing control apparatus, an image forming system, and a printing control method.

2. Description of the Related Art

In the past, there is an image forming apparatus that stores a clear toner, which is a colorless toner not including a color material, other than toners of four colors CMYK. A toner image formed by such a clear toner is fixed on a recording medium on which an image is formed with the toners of CMYK. As a result, a visual effect and a tactual effect on the surface of the recording medium (referred to as surface effects) are realized. Surface effects to be realized are different depending on what type of toner image is formed with the clear toner and how the toner image is fixed. Some surface effect simply imparts a gloss and other surface effect suppresses a gloss. It is desired to impart a surface effect to only a part of the surface rather than to the entire surface. There is also a demand for a surface effect for forming a texture or a watermark with the clear toner. In some case, surface protection is demanded. There is also a surface effect that can be realized by performing post-processing with a dedicated post-processing machine such as a glosser or a low-temperature fixing machine besides fixing control. In recent years, for example, as disclosed in Japanese Patent No. 3473588, a method of depositing the clear toner only on a desired portion in a part of the surface to impart a gloss is developed.

As disclosed in Japanese Patent Application Laid-open No. 2007-034040, the gloss is affected by surface roughness of the image formed on the recording medium. In other words, the gloss is affected by unevenness of the surface of the recording medium caused by the toners of CMYK. Therefore, a degree of the gloss does not simply increase according to the density of the clear toner.

In order to impart a gloss, it is necessary to control the smoothness of the surface of an image. Therefore, it is necessary to create, according to density values of CMYK concerning pixels to which the clear toner is deposited, image data for forming a toner image by the clear toner.

From the viewpoint of imparting a larger number of types of surface effects, it is desirable that a printing apparatus is mounted with post-processing machines of types determined in advance. However, in some case, a plurality of types of post-processing machines necessary for realizing all the surface effects are not mounted because of various reasons. Therefore, when a part of the post-processing machines are not mounted, a user needs to perform selection or the like of surface effects of realizable types taking into account the configurations of the post-processing machines. However, it is difficult for the user to perform such setting.

Therefore, there is a need for a printing control apparatus, an image forming system, and a printing control method that can impart surface effects by a clear toner to a recording medium, on which an image is formed, without causing a user trouble even when a part of post-processing machines are not mounted.

SUMMARY OF THE INVENTION

According to an embodiment, there is provided a printing control apparatus that includes an acquiring unit, a storing unit, a replacing unit, and a generating unit. The acquiring unit is configured to acquire apparatus configuration information of a printing apparatus that forms an image based on image data. The storing unit is configured to store therein gloss control plane data in which a type of a surface effect imparted to a recording medium and a control value for specifying an area in the recording medium, to which the surface effect is imparted, are designated. The replacing unit is configured to replace, based on the apparatus configuration information, the type of the surface effect imparted to the recording medium in the gloss control plane data with a predetermined type of a surface effect. The generating unit is configured to generate the image data based on the gloss control plane data subjected to the replacement by the replacing unit.

According to another embodiment, there is provided an image forming system that generates image data. The system includes a printing apparatus that includes a printer machine and a post-processing machine; and a printing control apparatus that generates image data and transmits the image data to the printing apparatus. The printing control apparatus includes an acquiring unit, a storing unit, a replacing unit, and a generating unit. The acquiring unit is configured to acquire apparatus configuration information of a printing apparatus that forms an image based on image data. The storing unit is configured to store therein gloss control plane data in which a type of a surface effect imparted to a recording medium and a control value for specifying an area in the recording medium, to which the surface effect is imparted, are designated. The replacing unit is configured to replace, based on the apparatus configuration information, the type of the surface effect imparted to the recording medium in the gloss control plane data with a predetermined type of a surface effect. The generating unit is configured to generate the image data based on the gloss control plane data subjected to the replacement by the replacing unit.

According to still another embodiment, there is provided a printing control method performed by a printing control apparatus. The apparatus generates image data and includes a storing unit configured to store therein gloss control plane data in which a type of a surface effect imparted to a recording medium and a control value for specifying an area in the recording medium, to which the surface effect is imparted, are designated. The printing control method includes acquiring apparatus configuration information of a printing apparatus that forms an image based on the image data; replacing, based on the apparatus configuration information, the type of the surface effect imparted to the recording medium in the gloss control plane data with a predetermined type of a surface effect; and generating the image data based on the gloss control plane data subjected to the replacement by the replacing unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 3 is diagram of an example of types of surface effects concerning presence or absence of a gloss;

FIG. 4A is a diagram of gloss control plane data shown as an image;

FIG. 4B is a diagram of an example of clear plane data;

FIG. 10 is a diagram of an example of a data structure of a surface effect selection table;

DETAILED DESCRIPTION OF THE PREFERRED EMBODIMENTS

Figure 1:
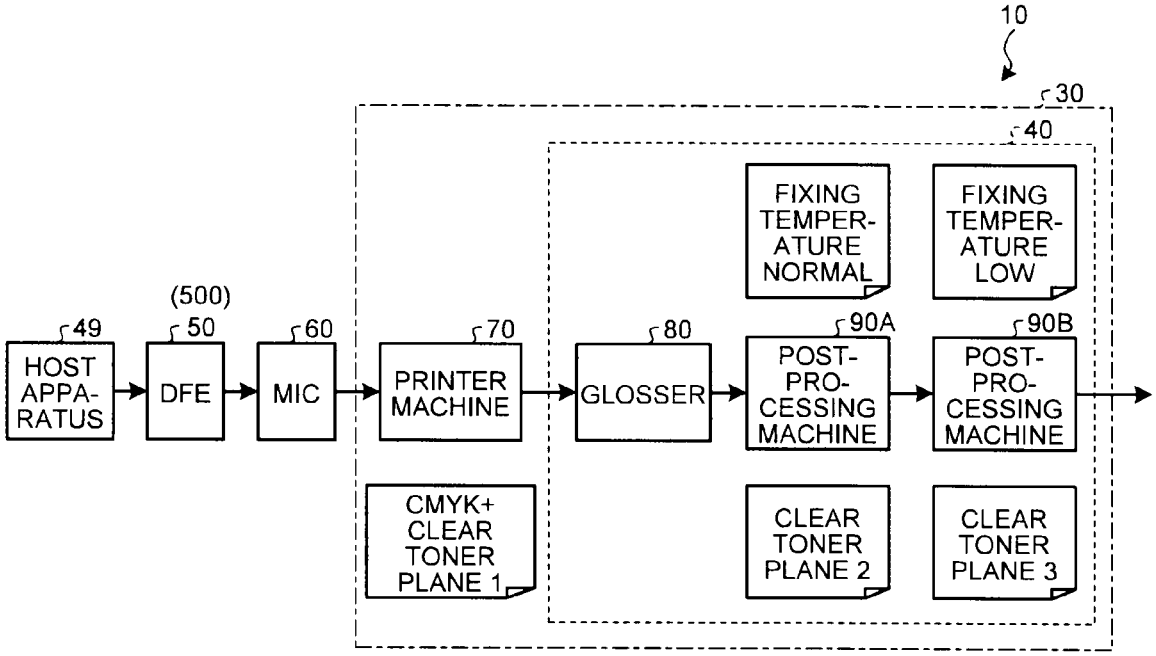
FIG. 1 is a diagram of an example of the configuration of an image forming system according to a first embodiment.

Various embodiments according to the present invention will be explained in detail below with reference to the accompanying drawings.

First Embodiment

First, the configuration of an image forming system 10 according to a first embodiment is explained with reference to FIG. 1. In the first embodiment, the image forming system 10 includes a printer controller (digital front end: DFE) (hereinafter sometimes referred to as DFE) 50, an interface controller (mechanism I/F controller: MIC) (hereinafter sometimes referred to as MIC) 60, and a printing apparatus 30.

The printing apparatus 30 is configured by connecting a printer machine 70 and post-processing machines 40.

Examples of the post-processing machines 40 include a glosser 80, a post-processing machine 90A mounted with a normal fixing machine as a fixing machine and a post-processing machine 90B mounted with a low-temperature fixing machine as a fixing machine. The glosser 80 is an apparatus that re-fixes a toner image, which is once fixed on a recording medium by the printer machine 70, on the recording medium and improves the smoothness of the surface of the toner image on the recording medium to increase the glossiness of the surface of the toner image. Means for realizing the apparatus is not specifically limited. The post-processing machines 90A and 90B are respectively mounted with, besides fixing devices, image forming units including photosensitive members for a clear toner, charging devices, developing devices, and photosensitive member cleaners and exposing devices. In the first embodiment, as the post-processing machines 40, at least one or more of the glosser 80, the post-processing machine 90A mounted with the normal fixing machine as the fixing machine, the post-processing machine 90B mounted with the low-temperature fixing machine as the fixing machine are not mounted, and at least one of the machines is mounted.

The DFE 50 performs communication with the printer machine 70 via the MIC 60 and controls formation of an image in the printer machine 70. The DFE 50 includes, for example, a personal computer (PC). A host apparatus 49 of another PC or the like is connected to the DFE 50. The DFE 50 receives image data from the host apparatus 49, generates, using the image data, image data for the printer machine 70 to form toner images corresponding to toners of CMYK and a clear toner, and transmits the generated image data to the printer machine 70 and the post-processing machines 40 via the MIC 60.

In the explanation of the first embodiment, the DFE 50 and the host apparatus 49 are configured as separate PCs, i.e., separate bodies. However, the DFE 50 and the host apparatus 49 can be integrally configured using one PC or the like having functions of the DFE 50 and the host apparatus 49.

The toners of CMYK and the clear toner are stored in the printer machine 70. The printer machine 70 is mounted with image forming units including photosensitive members, charging devices, developing devices, and photosensitive member cleaners, exposing devices, and the like are mounted for the respective toners.

The clear toner is a transparent (colorless) toner not including a color material. "Transparent (colorless)" indicates that, for example, transmittance is equal to or higher than 70%.

The printer machine 70 emits light beams from the exposing devices according to image data transmitted from the DFE 50 via the MIC 60 to form toner images of the toners on the photosensitive members and transfers the toner images onto a recording medium. The printer machine 70 fixes, with a not-shown fixing machine, the toner images through heating and pressing at temperature in a predetermined range (normal temperature). Consequently, an image is formed on the recording medium. Detailed explanation of the configuration of such a printer machine 70 is omitted because the configuration is well known.

The glosser 80 is controlled to be turned on and off by the DFE 50. When the glosser 80 is turned on, the glosser 80 presses the toner images, which are formed on the recording medium by the printer machine 70, at high temperature and high pressure. Consequently, a total deposit amount of the toners of pixels to which amounts of the toners equal to or larger than a predetermined amount adhere is uniformly compressed over the entire toner images formed on the recording medium. Therefore, the glosser 80 can improve the glossiness of the toner images on the recording medium, which is formed by the printer machine 70, by re-fixing the toner images on the recording medium and improving the smoothness of the surface of the toner images on the recording medium.

The post-processing machine 90A stores a clear toner and is mounted with a fixing machine for fixing the clear toner. Clear toner plane (plate) data explained later generated by the DFE 50 is input to the post-processing machine 90A. The post-processing machine 90A forms a toner image by the clear toner using the clear toner plane data and causes the fixing machine to fix the toner image on the recording medium through heating and pressing at normal temperature.

The post-processing machine 90B stores a clear toner and is mounted with a fixing machine for fixing the clear toner. Clear toner plane data explained later generated by the DFE 50 is input to the post-processing machine 90B. The post-processing machine 90B forms a toner image by the clear toner using the input clear toner plane data, places the toner image on the recording medium pressed by the glosser 80, and causes the fixing machine to fix the toner image on the recording medium through heating and pressing at temperature lower than the normal temperature.

Image data (document data) input from the host apparatus 49 to the DFE 50 is schematically explained. In the host apparatus 49, image data is generated by an image processing application installed in advance and is transmitted to the DFE 50. In such an image processing application, it is possible to handle image data of a special color plane with respect to image data in which values of densities of colors (referred to as density values) in respective color planes such as an RGB plane and a CMYK plane are specified for each pixel. The special color plane is image data for depositing special toners and inks of white, gold, silver, and the like other than basic colors such as CMYK and RGB and is data for a printer that stores such special toners or inks. As a special color plane, to improve color reproducibility, R is sometimes added to the basic colors of CMYK or Y is sometimes added to the basic colors of RGB. Usually, the clear toner is handled as one of special colors.

In the first embodiment, the clear toner as the special color is used to form a surface effect, which is a visual or tactual effect imparted to transfer paper and form a transparent image such as a watermark or a texture other than the surface effect on the transfer paper.

Therefore, the image processing application of the host apparatus 49 generates, with respect to input image data, any one or both of gloss control plane data and clear plane data according to designation by a user as image data of the special color plane, in addition to color plane data.

Figure 2:
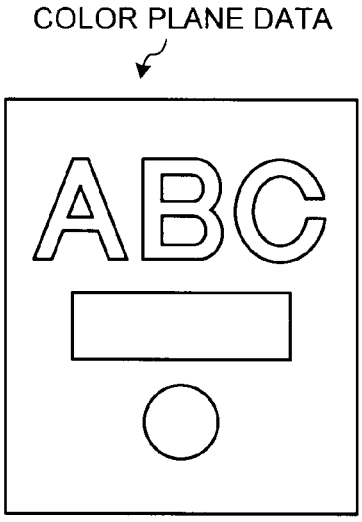
FIG. 2 is a diagram of an example of color plane (colored plate) data.

The color plane data is image data in which density values of the colors such as RGB or CMYK are specified for each pixel. In the color plane data, one pixel is represented by 8 bits according to designation of colors by the user. FIG. 2 is a diagram for explaining an example of the color plane data. In FIG. 2, density values corresponding to colors designated by the user with the image processing application are given to respective rendering objects such as "A", "B", and "C".

The gloss control plane data is image data in which, to perform control for depositing the clear toner corresponding to a surface effect, which is a visual or tactual effect imparted to transfer paper, an area to which the surface effect is imparted and a type of the surface effect are specified.

Like the RGB plane and the CMYK plane, the gloss control plane data is represented by a density value in a range of "0" to "255" with 8 bits for each pixel. A type of a surface effect is associated with the density value (the density value can be represented by 16 bits or 32 bits or 0% to 100%). Irrespective of the density of the clear toner that actually adheres, the same value is set for a range in which the same surface effect is desired to be imparted. Therefore, even if there is no data indicating an area, the area can be easily specified from image data according to necessity. In other words, the type of the surface effect and the area to which the surface effect is imparted are represented by the gloss control plane data (data representing the area can be separately imparted).

The host apparatus 49 sets the type of the surface effect for the rendering object, which is designated by the user with the image processing application, as a density value as a gloss control value for each rendering object and generates gloss control plane data in a vector format.

All of the image data of the color plane data, the gloss control plane data, and the clear plane data are formed in a page unit.

Types of surface effects roughly include a surface effect concerning presence or absence of a gloss, surface protection, a watermark embedded with information, a texture, and the like. As the surface effect concerning presence or absence of a gloss, there are roughly four types as shown in FIG. 3. The four types are, in the order of a degree of a gloss (glossiness), a mirror surface gloss (premium gloss: PG), a solid gloss (gloss: G), a halftone dot matt (matt: m), and matt (premium matt: PM). In the following explanation, in some case, the mirror surface gloss is referred to as "PG", the solid gloss is referred to as "G", the halftone dot matt is referred to as "M", and the matt is referred to as "PM".

The mirror surface gloss and the solid gloss have a high degree of imparting a gloss. Conversely, the halftone dot matt and the matt are surface effects for suppressing a gloss. In particular, the matt realizes glossiness lower than the glossiness of a normal recording medium. In FIG. 3, the mirror surface gloss represents glossiness Gs equal to or higher than 80, the solid gloss represents solid glossiness formed by a primary color or a secondary color, the halftone dot matt represents the glossiness of the primary color and a halftone dot of 30%, and the matt represents glossiness equal to or lower than 10. A deviation of glossiness is represented by ΔGs and set to be equal to or lower than 10. With respect to such types of the surface effects, a high density value is associated with a surface effect having a high degree of imparting a gloss, and a low density value is associated with a surface effect for suppressing a gloss. Surface effects such as a watermark and a texture are associated with an intermediate density value. As the watermark, for example, a character or a woven pattern is used. The texture represents a character or a pattern and can impart a tactual effect besides a visual effect. For example, a pattern of a stained glass can be realized by the clear toner. The surface protection is substituted by the mirror surface gloss or the solid gloss. The user designates, via the image processing application, to which area of an image represented by image data to be processed a surface effect is imparted and which type of a surface effect is imparted to the area. In the host apparatus 49 that executes the image processing application, a density value corresponding to a surface effect of user designation is set for pixels that form an area designated by the user, whereby the gloss control plane data is generated. A correspondence relation between density values and types of surface effects is explained later.

FIG. 4A is a diagram for explaining an example of the gloss control plane data. In the example of the gloss control plane data shown in FIG. 4A, the surface effect "PG (mirror surface gloss)" is imparted to a rendering object "ABC", the surface effect "G (solid gloss)" is imparted to a rendering object "(rectangular figure)", and the surface effect "M (halftone dot matt)" is imparted to a rendering object "(circular figure)" by the user. Density values set for the respective surface effects are density values set to correspond to types of surface effects in a density value selection table explained later (see FIG. 10).

The clear plane data is image data in which transparent images such as a watermark and a texture other than the surface effects explained above are specified. FIG. 4B is a diagram for explaining an example of the clear plane data. In the example shown in FIG. 4B, a watermark "Sale" is designated by the user.

In this way, the gloss control plane data and the clear plane data, which are the image data of the specific color plane, are generated by the image processing application of the host apparatus 49 separate from the color plane data. As a format of the image data of the color plane data, the gloss control plane data, and the clear plane data, a portable document format (PDF) is used. The image data of the PDF of the planes are integrated to generate document data. A data format of the image data of the planes is not limited to the PDF. An arbitrary format can be used.

Figure 5:
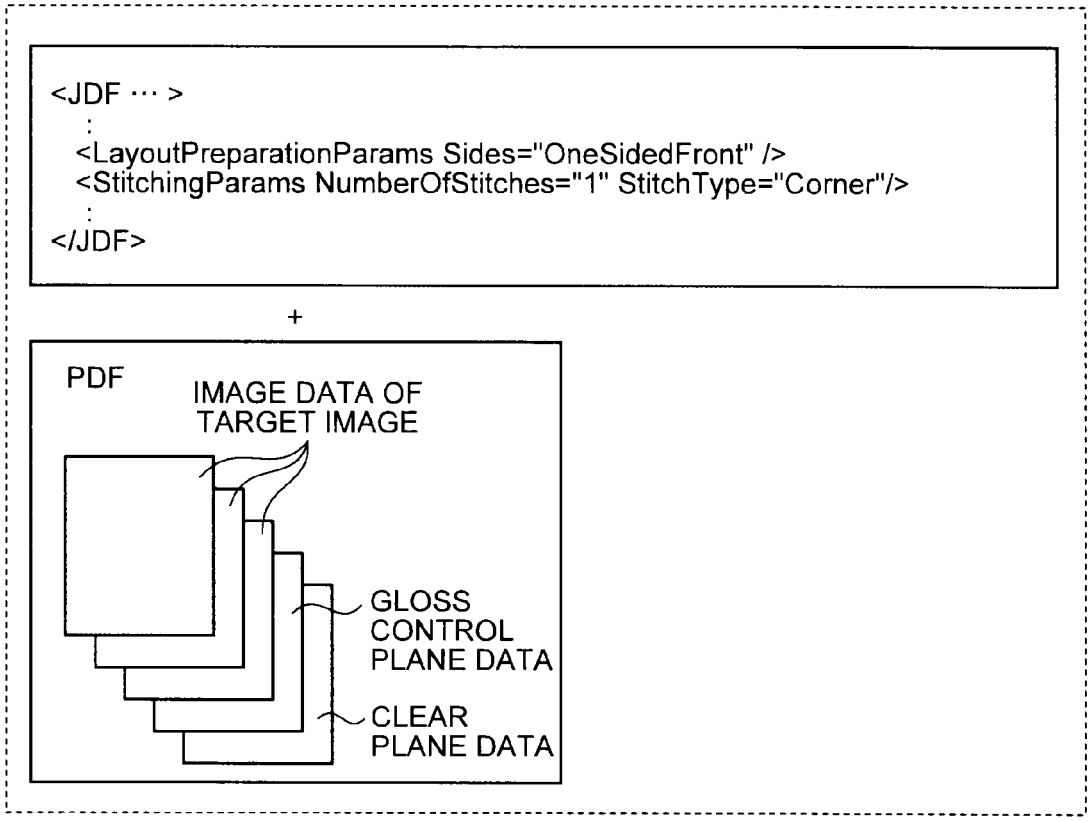
FIG. 5 is a conceptual schematic diagram of an example of the structure of printing data.

The host apparatus 49 outputs, to the DFE 50, print data which includes the document data obtained by integrating the color plane data and any one or both of the gloss control plane data and the clear plane data and further includes a job command. The job command is a command for designating, in a printer, setting of the printer, setting of binding, setting of duplex or simplex printing, and the like. FIG. 5 is a conceptual schematic diagram of a structure example of the print data. In the example shown in FIG. 5, a job definition format (JDF) is used as the job command. However, the job command is not limited thereto. For example, the JDF is a command for designating "simplex printing with stapling" as the setting of binding. The print data may be converted into a page description language (PDL) such as PostScript or may be maintained in the PDF format if the DFE 50 is adapted to the PDF format.

Referring back to FIG. 1, the DFE 50 receives the print data serving as the image data from the host apparatus 49 and, after performing various kinds of processes explained later, outputs the print data to the printing apparatus 30. Details of the DFE 50 are explained later.

Figure 6:
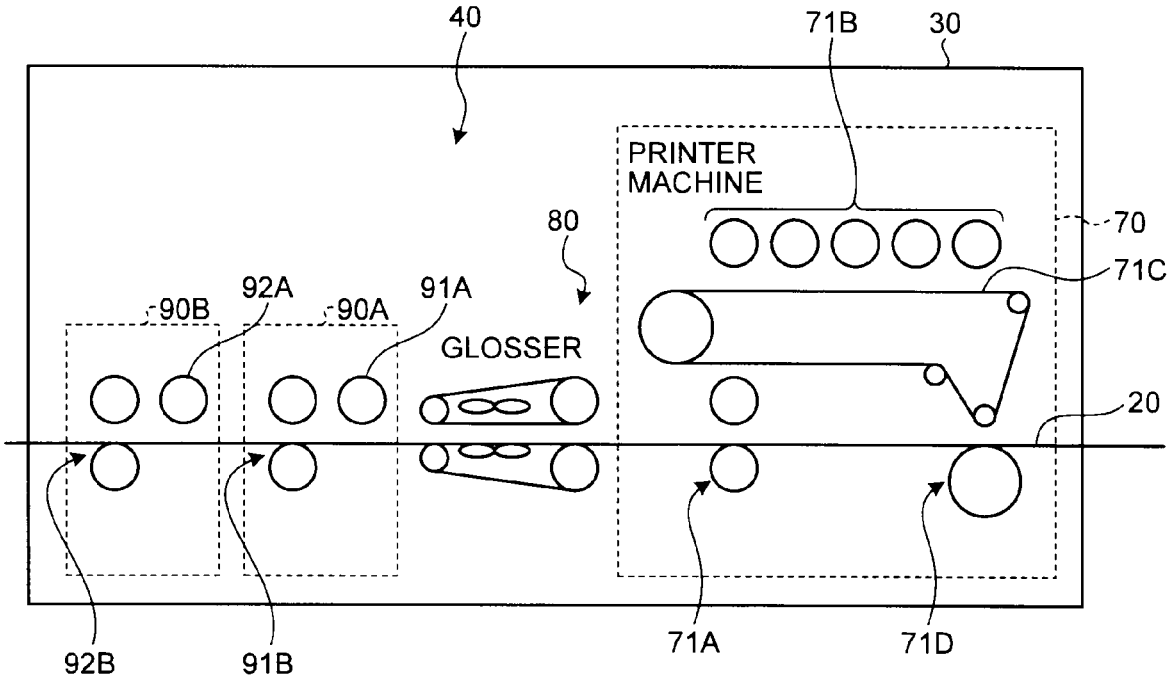
FIG. 6 is a schematic diagram of the configuration of a printing apparatus.

The configuration of the printing apparatus 30 is schematically shown in FIG. 6. The printing apparatus 30 further includes a conveying path 20 for conveying a recording medium in addition to the components (the printer machine 70 and the post-processing machines 40). The printer machine 70 specifically includes a plurality of photosensitive members 71B of an electrophotographic system, a transfer belt 71C onto which toner images formed on the photosensitive members 71B are transferred, a transfer device 71D that transfers the toner images on the transfer belt 71C onto a recording medium, and a fixing device 71A that fixes the toner images, which are transferred onto the recording medium, on the recording medium. The post-processing machine 90A includes photosensitive members 91A of the electrophotographic system and a fixing machine 91B that fixes toner images transferred from the photosensitive members 91A on the recording medium. The post-processing machine 90B includes photosensitive members 92A of the electrophotographic system and a fixing device 92B that fixes toner images transferred from the photosensitive members 92A on the recording medium. The recording medium is conveyed on the conveying path 20 by not-shown conveying members to be conveyed through, in the written order, positions where the printer machine 70, the glosser 80, the post-processing machine 90A, and the post-processing machine 90B are provided. After the recording medium is subjected to the processes by these machines, an image is formed on the recording medium, and surface effects are imparted to the recording medium, the recording medium is conveyed on the conveying path 20 by a not-shown conveying mechanism and discharged to the outside of the printing apparatus 30.

Figure 7:
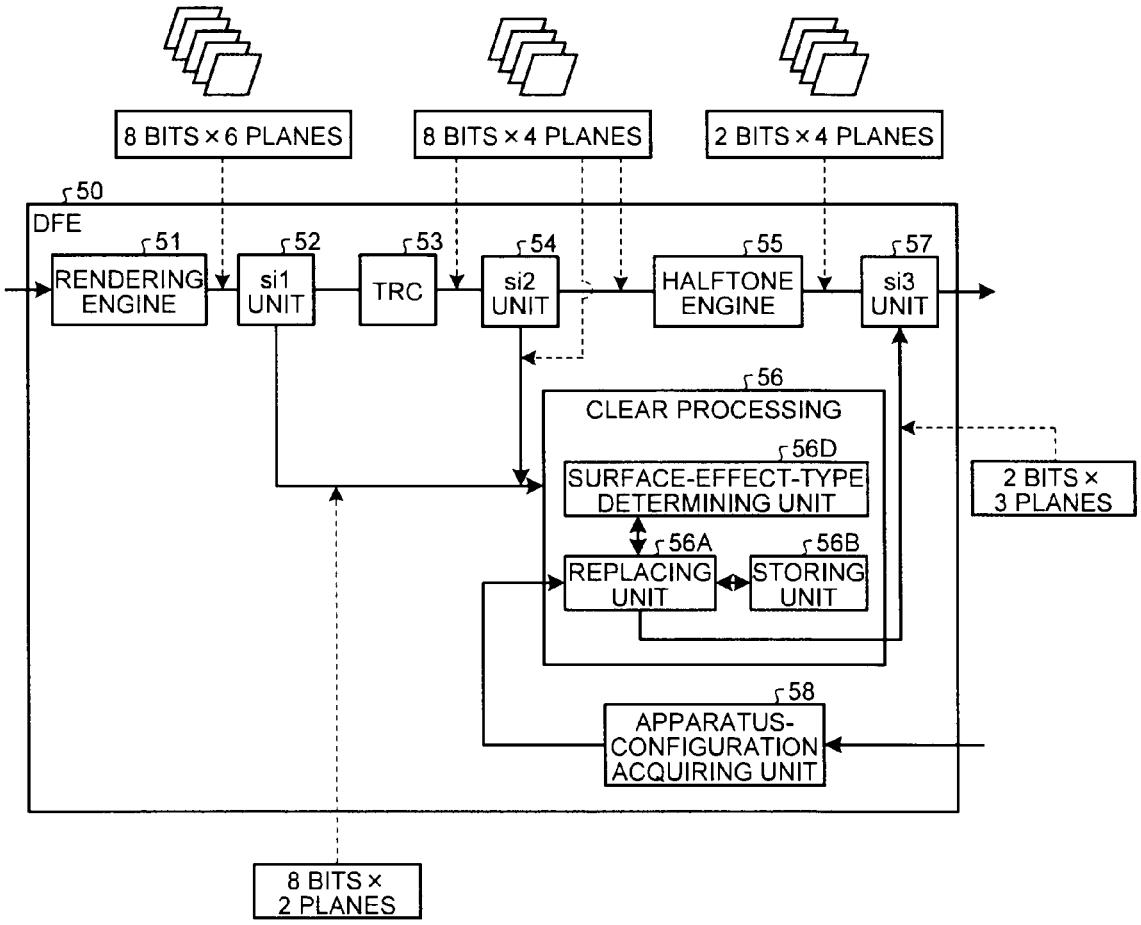
FIG. 7 is a diagram of an example of a functional configuration of a DFE.

Next, a functional configuration of the DFE 50 is explained. The DFE 50 includes, as shown in FIG. 7, a rendering engine 51, a si1 unit 52, a tone reproduction curve (TRC) 53, a si2 unit 54, a halftone engine 55, clear processing 56 including a storing unit 56B that stores surface effect selection tables (explained later), setting tables (explained later), and the like, a si3 unit 57, and an apparatus-configuration acquiring unit 58. The rendering engine 51, the si1 unit 52, the tone reproduction curve (TRC) 53, the si2 unit 54, the halftone engine 55, the clear processing 56, the si3 unit 57, and the apparatus-configuration acquiring unit 58 are realized by a control unit of the DFE 50 executing various computer programs stored in a main storing unit or an auxiliary storing unit. All of the si1 unit 52, the si2 unit 54, and the si3 unit 57 have a function of separating image data and a function of integrating image data.

Image data transmitted from the host apparatus 49 is input to the rendering engine 51. The rendering engine 51 subjects the input image data to language interpretation and converts the image data represented in a vector format into a raster format. In the case of a color space represented in an RGB format, the rendering engine 51 converts the color space into a color space of a CMYK format and outputs color plane data of 8 bits each of CMYK and gloss control plane data of 8 bits. The si1 unit 52 outputs the color plane data of 8 bits each of CMYK to the TRC 53 and outputs the gloss control plane data of 8 bits and the clear plane data to the clear processing 56.

The color plane data of 8 bits each of CMYK is input to the TRC 53 via the si1 unit 52. The TRC 53 applies gamma correction to the input color plane data using a gamma curve of a 1D_LUT generated by calibration. As other image processing in the TRC 53, there are total volume control and the like. The total volume control is processing for limiting the color plane data of 8 bits each of CMYK after the gamma correction because there is a limit in a toner amount that can be put on a recording medium in the printer machine 70 in one pixel on the recording medium. If printing is performed exceeding the total volume control, image quality is deteriorated by a transfer failure and a fixing failure. In the first embodiment, only related gamma correction is explained as an example.

The si2 unit 54 outputs the color plane data of 8 bits each of CMYK subjected to the gamma correction by the TRC 53 to the clear processing 56 as data for generating an inverse mask explained later. The color plane data of 8 bits each of CMYK after the gamma correction is input to the halftone engine 55 via the si2 unit 54. The halftone engine 55 performs halftone processing for converting the input color plane data into a data format of color plane data of, for example, 2 bits each of CMYK for output to the printer machine 70 and outputs the color plane data of, for example, 2 bits each of CMYK after the halftone processing. 2 bits is only an example and the number of bits is not limited to 2 bits.

The apparatus-configuration acquiring unit 58 acquires apparatus configuration information indicating an apparatus configuration of the post-processing machines 40. As explained above, in the first embodiment, in the printing apparatus 30, any one or more of the glosser 80, the post-processing machine 90A, and the post-processing machine 90B provided as the post-processing machines 40 are not mounted and any one or more of the machines are mounted.

Information indicating what is provided as the post-processing machines 40 is acquired by the MIC 60 explained in detail later and then input to the apparatus-configuration acquiring unit 58 via the printer machine 70. The apparatus-configuration acquiring unit 58 outputs the acquired apparatus configuration information to the clear processing 56.

The gloss control plane data of 8 bits converted by the rendering engine 51 and the clear plane data are input to the clear processing 56 via the si1 unit 52. Further, the color plane data of 8 bits each of CMYK subjected to the gamma correction by the TRC 53 is input to the clear processing 56 via the si2 unit 54. The clear processing 56 determines, using the input gloss control plane data and referring to the surface effect selection table explained later, a surface effect corresponding to density values (pixel values) represented by pixels included in the gloss control plane data. The clear processing 56 determines ON or OFF of the glosser 80 based on the determination and the setting table explained later. Further, the clear processing 56 generates an inverse mask, a solid mask, a halftone, or the like as appropriate using the input color plane data of 8 bits each of CMYK to thereby generate, as appropriate, clear toner plane data of 2 bits for depositing the clear toner. The clear processing 56 outputs the clear toner plane data used in the printer machine 70 and the clear toner plane data used in the post-processing machines 90A and 90B, which are generated as appropriate, to the printing apparatus 30. Further, the clear processing 56 outputs ON/OFF information indicating ON or OFF of the glosser 80 to the printing apparatus 30.

The inverse mask is a mask for uniformzing a total deposit amount of the toners of CMYK and the clear toner on pixels that form a target area to which surface effects are imparted. Specifically, image data obtained by adding up all density values representing the pixels that form the target area in the color plane data of CMYK and subtracting the added-up value from a predetermined value is the inverse mask. More specifically, the inverse mask is represented by, for example, Formula (1) below.

$$Clr=100-(C+M+Y+K),\ \text{where, if } Clr<0,\ Clr=0 \tag{1}$$

In Formula (1), Clr, C, M, Y, and K represent density ratios converted from the density values in the pixels of the clear toner, C toner, M toner, Y toner, and K toner, respectively. Specifically, according to Formula (1), a total deposit amount obtained by adding a deposit amount of the clear toner to a total deposit amount of the toners of C, M, Y, and K is set as 100% concerning all the pixels that form the target area to which the surface effects are imparted. When the total deposit amount of the toners of C, M, Y, and K is equal to or higher than 100%, the clear toner is not deposited and a density ratio of the clear toner is set to 0%. This is because a portion where the total deposit amount of the toners of C, M, Y, and K exceeds 100% is smoothed by fixing process. In this way, the total deposit amount on all the pixels that form the target area to which the surface effects are imparted is set to be equal to or higher than 100%. Consequently, unevenness of the surface due to a difference in the total deposit amount of the toners in the target area is eliminated. As a result, a gloss due to regular reflection of light is generated. However, some inverse mask is calculated from a formula other than Formula (1). A plurality of types of inverse masks could be present. INV-1 and INV-m explained later are equivalent to the inverse masks.

The solid mask is a mask for uniformly depositing the clear toner on the pixels that form the target area to which the surface effects are imparted. Specifically, the solid mask is represented by, for example, Formula (2) below.

$$\mathrm{Clr}=100 \tag{2}$$

Some pixels among the target pixels to which the surface effects are imparted can be associated with a density ratio other than 100%. A plurality of patterns of solid masks could be present.

The inverse mask may be calculated by multiplication of background exposure ratios of the colors. The inverse mask in this case is represented by, for example, Formula (3) below.

$$Clr=100\times\{(100-C)/100\}\times\{(100-M)/100\}\times\{(100-Y)/100\}\times\{(100-K)/100\} \tag{3}$$

In Formula (3), (100−C)/100 indicates a background exposure ratio of C, (100−M)/100 indicates a background exposure ratio of M, (100−Y)/100 indicates a background exposure ratio of Y, and (100−K)/100 indicates a background exposure ratio of K.

Alternatively, for example, the inverse mask may be calculated by using a method in which it is assumed that a halftone dot having a maximum area ratio decides smoothness. The inverse mask in this case is represented by, for example, Formula (4) below.

$$Clr=100-\max(C,M,Y,K) \tag{4}$$

In Formula (4), max(C, M, Y, K) indicates that a density value of a color indicating a maximum density value among CMYK is a representative value.

In short, the inverse mask only has to be represented by any one of Formulas (1) to (4).

The surface effect selection table is a table that indicates a correspondence relation between density values and types of surface effects and indicates a correspondence relation among the density values, the types of the surface effects, control information concerning a post-processing machine corresponding to the configuration of the image forming system, clear toner plane data used in the printer machine 70 and clear toner plane data used in the post-processing machine.

The control information concerning the post-processing machines 40 is information indicating ON or OFF of the glosser 80.

Specifically, the surface effect selection table can be configured to indicate, according to an apparatus configuration, for each component of the image forming system, a correspondence relation between any one of control information concerning the post-processing machines 40 (ON/OFF of the glosser 80), a clear toner plane used in the printer machine 70 (a clear toner plane 1), a clear toner plane used in the post-processing machine 90A (a clear toner plane 2), and a clear toner plane used in the post-processing machine 90B (a clear toner plane 3) and density values and types of surface effects.

As explained above, in the first embodiment, it is assumed that the printing apparatus 30 is not mounted with any one or more of the glosser 80 provided as the post-processing machines 40, the post-processing machine 90A, and the post-processing machine 90B and is mounted with any one or more of the machines.

Therefore, in the first embodiment, the surface effect selection table is associated for each of a plurality of types of components including at least one or more of the glosser 80, the post-processing machine 90A, and the post-processing machine 90B and not including at least one or more of the machines as components other than the printer machine 70 in the printing apparatus 30.

Figure 8:
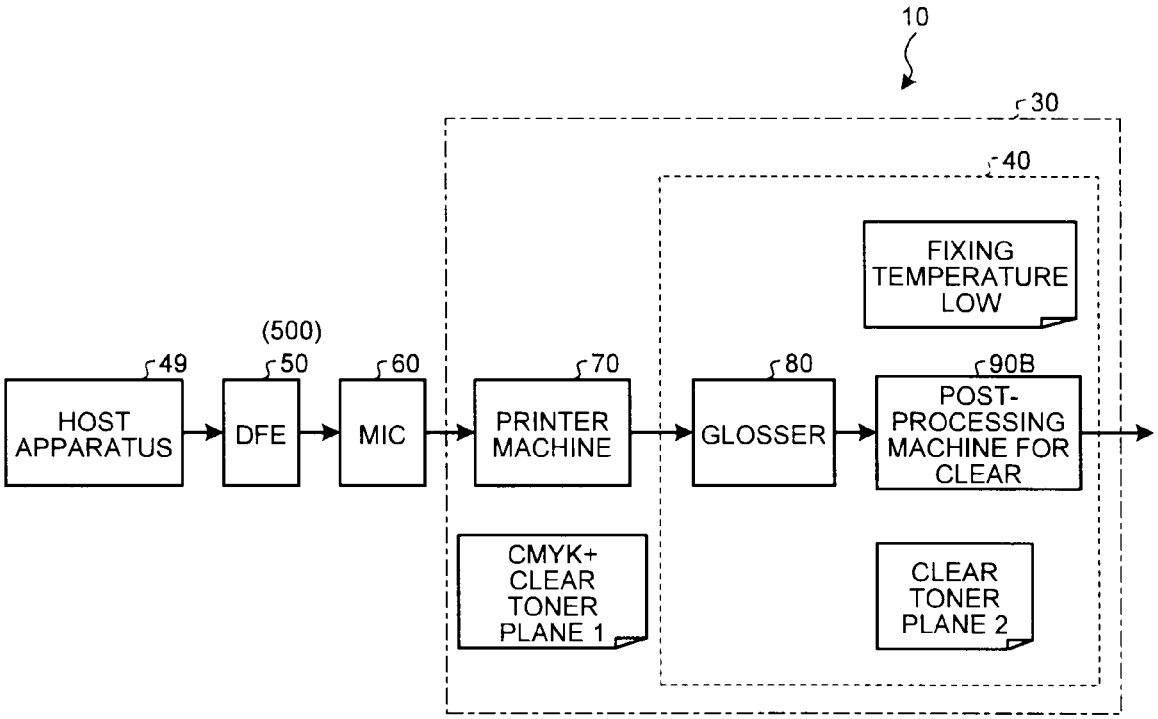
FIG. 8 is a diagram of an example of the configuration of the image forming system according to the first embodiment.

Specifically, for example, it is assumed that the apparatus configuration information indicating the apparatus configuration of the post-processing machines 40 indicates the glosser 80 and the post-processing machine 90B. In this case, as shown in FIG. 8, the printing apparatus 30 is mounted with only the glosser 80 and the post-processing machine 90B as the post-processing machines 40. A surface effect selection table corresponding to the apparatus configuration information indicating such a configuration is configured to indicate a correspondence relation among the control information concerning the post-processing machines 40 (ON/OFF of the glosser 80), the clear toner plane data used in the printer machine 70, the clear toner plane data used in the post-processing machine 90B, density values, and types of surface effects.

Figure 9:
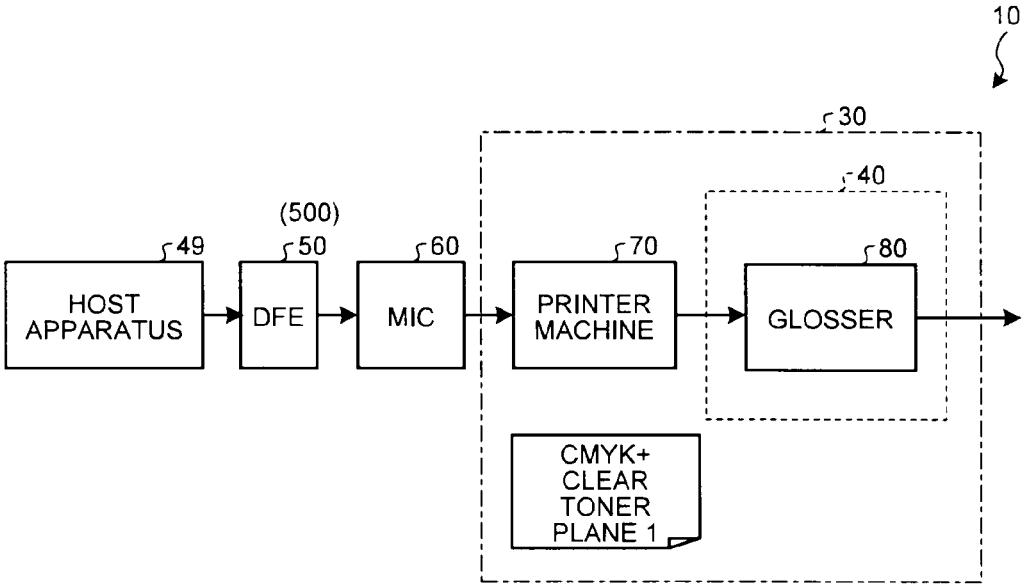
FIG. 9 is a diagram of an example of the configuration of the image forming system according to the first embodiment.

For example, it is assumed that the apparatus configuration information indicating the apparatus configuration of the post-processing machines 40 indicates only the glosser 80. In this case, as shown in FIG. 9, the printing apparatus 30 is mounted with only the glosser 80 as the post-processing machine 40. A surface effect selection table corresponding to the apparatus configuration information indicating such a configuration is configured to indicate a correspondence relation among the control information concerning the post-processing machines 40 (ON/OFF of the glosser 80), the clear toner plane data used in the printer machine 70, density values, and types of surface effects.

These surface effect selection tables are stored in the storing unit 56B in advance in association with the apparatus configuration information.

In FIG. 10, an example of the surface effect selection table is shown that corresponds to the apparatus configuration information indicating that the printing apparatus 30 is mounted with all of the printer machine 70, the glosser 80, the post-processing machine 90A, and the post-processing machine 90B as the post-processing machines 40.

The display effect selection table shown in FIG. 10 indicates a correspondence relation among control information concerning the post-processing machine (ON/OF of the glosser 80), clear toner plane data used in the printer machine 70 (in FIG. 10, see the clear toner plane 1), clear toner plane data used in the post-processing machine 90A (in FIG. 10, see the clear toner plane 2), clear toner plane data used in the post-processing machine 90B mounted with the low-temperature machine as the fixing machine (in FIG. 10, see the clear toner plane 3), density values, and types of surface effects.

In the correspondence relation between types of surface effects and density values shown in FIG. 10, the types of the surface effects are associated so as to correspond to a range of the density values. The types of the surface effects are associated in a unit of 2% with a ratio of density (a density ratio) converted from a value representing the range of the density values (a representative value). Specifically, the surface effects (the mirror surface effect and the solid effect) for imparting a gloss are associated with a range of density values ("212" to "255") in which the density ratio is equal to or higher than 84%. The surface effects (the halftone dot matt and the matt) for suppressing a gloss are associated with a range of density values ("1" to "43") in which the density ratio is equal to or lower than 16%. The surface effects such as a texture and a woven pattern watermark are associated with a range of density values in which the density ratio is 20% to 80%.

More specifically, for example, the mirror surface gloss (PM) is associated with pixels values "238" to "255" as a surface effect. Mirror surface glosses of different types are respectively associated with three ranges of pixels values "238" to "242", pixel values "243" to "247", and pixel values "248" to "255". The solid gloss (G) is associated with pixels values "212" to "232". Solid glosses of different types are respectively associated with four ranges of pixel values "212" to "216", pixel values "217" to "221", pixel values "222" to "227", and pixel values "228" to "232". The halftone dot matt (M) is associated with pixel values "23" to "43". Halftone dot matts of different types are respectively associated with four ranges of pixel values "23" to "28", pixel values "29" to "33", pixel values "34" to "38", and pixel values "39" to "43". The matt (PM) is associated with pixel values "1" to "17". Matts of different types are respectively associated with three ranges of pixel values "1" to "7", pixel values "8" to "12", and pixel values "13" to "17". The different types of the same surface effects are calculated by different formulas for calculating clear toner plane data used in the printer machine 70, the post-processing machine 90A, and the post-processing machine 90B. The operations of a printer main body and the post-processing machine are the same. A density value "0" is associated with "no surface effect is imparted".

In FIG. 10, ON/OFF information indicating ON or OFF of the glosser 80, clear toner plane data used in the printer machine 70, clear toner plane data used in the post-processing machine 90A, and clear toner plane data used in the post-processing machine 90B are respectively shown to correspond to the pixel values and the surface effects. For example, when the surface effect is the mirror surface gloss, it is indicated that the glosser 80 is turned on. It is indicated that the clear toner plane data used in the printer machine 70 (the clear toner plane 1) represents the inverse mask and the clear toner plane data used in the post-processing machines 90A and 90B (the clear toner plane 2 and the clear toner plane 3) are absent.

The inverse mask is calculated by, for example, Formula (1) described above. The example shown in FIG. 10 is an example in which an area where the mirror surface effect is designated as the surface effect is equivalent to the entire area specified by the image data. An example in which the area where the mirror surface effect is designated as the surface effect is equivalent to a part of the area specified by the image data is explained later.

When the pixel values are "228" to "232" and the surface effect is the solid gloss, it is indicated that the glosser 80 is turned off and the image data of the clear toner plane data used in the printer machine 70 (see the clear toner plane 1) is an inverse mask 1, and the clear toner plane data used in the post-processing machines 90A and 90B (the clear toner plane 2 and the clear toner plane 3) are absent.

The inverse mask 1 only has to be represented by any one of Formulas (1) to (4). A total deposit amount of toners to be smoothed is different because the glosser 80 is off. Therefore, unevenness of the surface increases because of the mirror surface glass. As a result, a solid gloss with low glossiness is obtained because of the mirror surface gloss. When the surface effect is the halftone dot matt, it is indicated that the glosser 80 is turned off and it is indicated that the clear toner plane data used in the printer machine 70 (see the clear toner plane 1) is absent. It is indicated that the clear toner plane data used in the post-processing machine 90A (see the clear toner plane 2) represents a halftone (a halftone dot) and the clear toner plane data used in the post-processing machine 90B (see the clear toner plane 3) is absent.

When the surface effect is the matt, it is indicated that the glosser 80 can be turned on or off. It is indicated that the clear toner plane data used in the printer machine 70 (see the clear toner plane 1) and the clear toner plane data used in the post-processing machine 90A (see the clear toner plane 2) are absent and the clear toner plane data used in the post-processing machine 90B (see the clear toner plane 3) represents a solid mask. The solid mask is calculated by, for example, Formula (2).

As explained above, the display effect selection table is set to correspond to the apparatus configuration information indicating the apparatus configuration of the post-processing machines 40.

Referring back to FIG. 7 (see also FIG. 1), the clear processing 56 determines, referring to the surface effect selection table corresponding to the apparatus configuration information received from the MIC 60, the surface effect associated with the pixel values indicated by the gloss control plane data. The clear processing 56 sets ON or OFF of the glosser 80 and generates clear toner plane data used in the printer machine 70, the post-processing machine 90B, and the post-processing machine 90A. The clear processing 56 performs, for each page, setting of ON or OFF of the glosser 80. As explained above, the clear processing 56 generates clear toner plane data as appropriate and outputs the clear image data and outputs ON/OFF information for the glosser 80.

The si3 unit 57 integrates the image data of 2 bits each of CMYK after the halftone processing and the clear toner plane data of 2 bits generated by the clear processing 56 and outputs the integrated image data to the MIC 60. In some case, the clear processing 56 does not generate at least one plane of the clear toner plane data used in the printer machine 70 and the clear toner plane data used in the post-processing machines 90A and 90B. Therefore, the clear toner plane data generated by the clear processing 56 is integrated by the si3 unit 57. When the clear processing 56 does not generate both the clear toner plane data, image data obtained by integrating the color plane data of 2 bits each of CMYK is output from the si3 unit 57. As a result, image data of maximum seven planes of 2 bit each is sent from the DFE 50 to the MIC 60. The si3 unit 57 also outputs, to the MIC 60, the ON/OFF information for the glosser 80 output by the clear processing 56.

Figure 11:
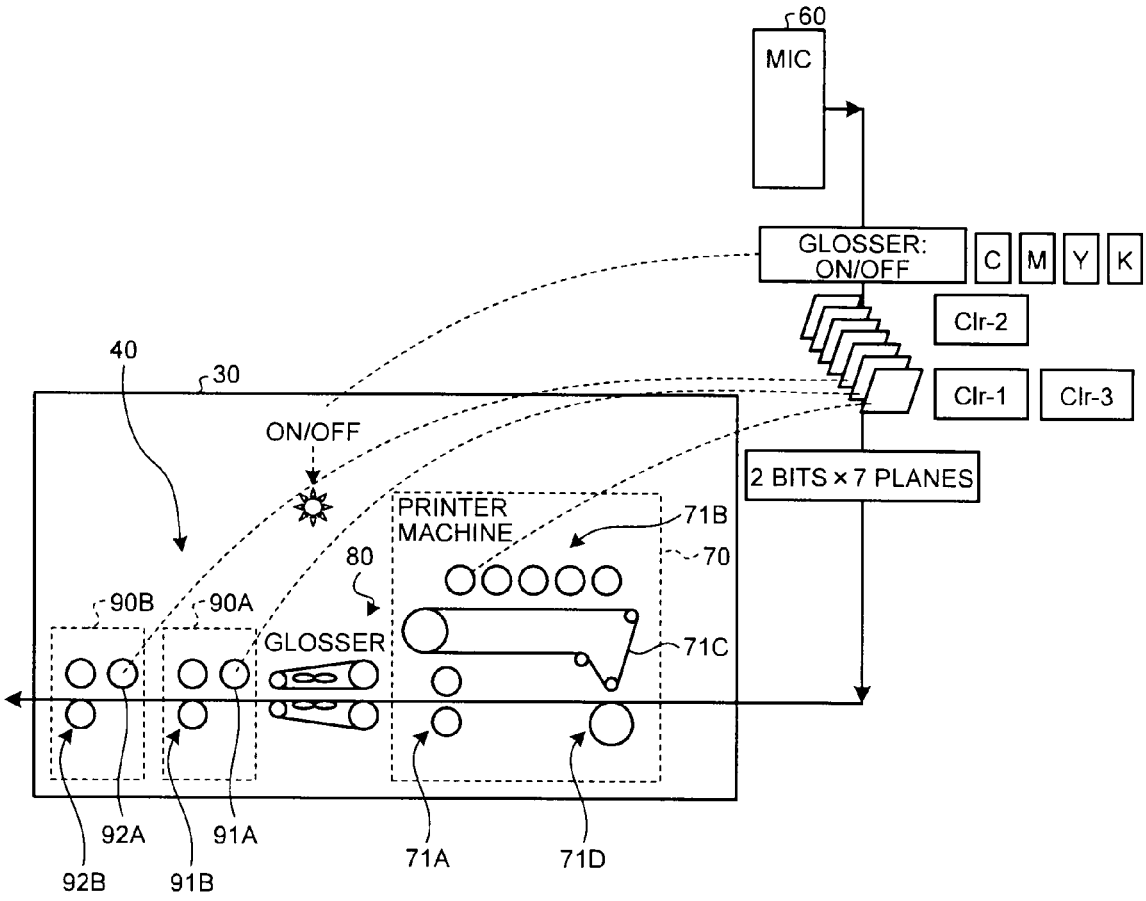
FIG. 11 is a conceptual diagram of the configuration of an MIC.

As shown in FIG. 11, the MIC 60 outputs, to the printer machine 70, the color plane data of CMYK among the image data output from the DFE 50. When there is clear toner plane data used in the printer machine 70 (Clr-1, the clear toner plane 1 shown in FIG. 10), the MIC 60 also outputs the clear toner plane data to the printer machine 70. When ON/OFF information of the glosser 80 is output from the DFE 50, the MIC 60 turns on or off the glosser 80 using the ON/OFF information. When there is clear toner plane data used in the post-processing machine 90A (Clr-2, the clear toner plane 2 shown in FIG. 10), the MIC 60 outputs the clear toner plane data to the post-processing machine 90A. When there is clear toner plane data used in the post-processing machine 90B (Clr-3, the clear toner plane 3 shown in FIG. 10), the MIC 60 outputs the clear toner plane data to the post-processing machine 90B. The glosser 80 can switch a path for performing fixing and a path for not performing fixing according to the ON/OFF information. The post-processing machine 90A and the post-processing machine 90B can perform switching of contact and separation operations and switching of the paths same as the switching by the glosser 80 according to presence or absence of clear toner plane data. An example of the contact and separation operations in the case of the post-processing machine 90A is briefly explained. When there is the clear toner plane data (Clr-2, the clear toner plane 2 shown in FIG. 10), the photosensitive member 91A and the fixing machine 91B come into contact with a sheet and form an image. When there is not the clear toner plane data, the photosensitive member 91A and the fixing machine 91B separate from the sheet and do not perform formation of an image. Consequently, it is possible to reduce wear of the photosensitive member 91A and the fixing machine 91B.

The MIC 60 outputs the apparatus configuration information indicating the configuration of the apparatus mounted as the post-processing machine 40 to the DFE 50.

A procedure of gloss control process performed by the image forming system according to the first embodiment when the area where the mirror surface effect is designated as the surface effect is equivalent to the entire area specified by the image data is explained. When the DFE 50 receives image data from the host apparatus 49, the DFE 50 subjects the image data to language interpretation and converts the image data represented in the vector format into the raster format. For example, the DFE 50 converts a color space represented in the RGB format into a color space in the CMYK format to obtain color plane data of 8 bits each of CMYK and gloss control plane data of 8 bits. The DFE 50 applies gamma correction to the color plane data of 8 bits each of CMYK using the gamma curve of the 1D_LUT generated by the calibration. The DFE 50 applies, to the color plane data after the gamma correction, halftone processing for converting the color plane data into a data format of color plane data of 2 bits each of CMYK for output to the printer machine 70 to obtain color plane data of 2 bits each of CMYK after the halftone processing. The DFE 50 determines, using the gloss control plane data of 8 bits and referring to the surface effect selection table, a surface effect designated for pixel values indicated by the gloss control plane data. The DFE 50 performs such determination concerning all pixels that form the gloss control plane data. In the gloss control plane data, basically, density values in the same range are represented for all pixels constituting an area to which surface effects are imparted. Therefore, the DFE 50 determines that near pixels determined as having the same surface effect are included in an area to which the same surface effect is imparted. In this way, the DFE 50 determines the area to which the surface effect is imparted and a type of the surface effect imparted to the area. The DFE 50 determines ON or OFF of the glosser 80 according to the determination and generates, using the color plane data of 8 bits each of CMYK after the gamma correction as appropriate, clear toner plane data of 2 bits for depositing the clear toner. The DFE 50 integrates the color plane data of 2 bits each of CMYK after the halftone processing and the clear toner plane data of 2 bits generated as appropriate. The DFE 50 outputs the integrated image data and the determined ON/OFF information indicating ON or OFF of the glosser 80 to the MIC 60.

Specific examples are explained according to types of surface effects. The types of the mirror surface gloss and the solid gloss for imparting a gloss and the halftone dot matt and the matt for suppressing a gloss are specifically explained. Surface effects of the same type designated in one page are explained. The clear processing 56 of the DFE 50 determines, using the density values of the pixels of the gloss control plane data of 8 bits and referring to the surface effect selection table (see, for example, FIG. 10) corresponding to the apparatus configuration information, that the surface effect designated for pixels having density values "238" to "255" is the mirror surface gloss. In this case, the clear processing 56 of the DFE 50 further determines whether an area where the mirror surface glass is designated as the surface effect is equivalent to an entire area specified by image data. When a result of the determination is affirmative, the clear processing 56 of the DFE 50 generates an inverse mask according to, for example, Formula (1) using image data corresponding to the area in the color plane data of 8 bits each of CMYK after the gamma correction. Image data representing the inverse mask is clear toner plane data used in the printer machine 70. The post-processing machines 90A and 90B do not use clear toner plane data for the area. Therefore, the clear processing 56 of the DFE 50 does not generate clear toner plane data used in the post-processing machines 90A and 90B.

The si3 unit 57 of the DFE 50 integrates the clear toner plane data used in the printer machine 70 and the color plane data of 2 bits each of CMYK after the halftone processing and outputs the integrated image data and ON/OFF information indicating ON of the glosser 80 to the MIC 60. The MIC 60 outputs the color plane data of CMYK and the clear toner plane data used in the printer machine 70, which are the image data output from the DFE 50, to the printer machine 70 and turns on the glosser 80 using the ON/OFF information output from the DFE 50. The printer machine 70 emits, using the color plane data of CMYK and the clear toner plane data output from the MIC 60, a light beam from the exposing device, forms toner images corresponding to the toners on the photosensitive members, transfers the toner images onto a recording medium, and fixes the toner images by heating and pressing at the normal temperature. Consequently, the clear toner is deposited on the recording medium in addition to the toners of CMYK and an image is formed. Thereafter, the glosser 80 re-fixes the toner images on the recording medium. The clear toner plane data is not output to the post-processing machines 90A and 90B. Therefore, in the post-processing machines 90A and 90B, the recording medium is discharged without the clear toner being deposited and fixed thereon. As a result, a total deposit amount of the toners of CMYK and the clear toner is uniformly compressed over an entire area specified by the image data. Therefore, an intense gloss is obtained from the surface of the area.

On the other hand, when the area where the mirror surface gloss is designated as the surface effect is equivalent to a part of the area specified by the image data, a situation explained below could occur. The clear toner plane data representing the inverse mask explained above is used in the area where the mirror surface gloss is designated. However, when a predetermined amount or more of a total deposit amount of the CMYK toners is set for all pixels other than the area, as a result, a total deposit amount of the toners of CMYK and the clear toner in the area where the mirror surface glass is designated and the area where the predetermined amount or more of the total deposit amount of the CMYK toners is set are uniformized after the toners are pressed by the glosser 80.

To solve this, when the area where the mirror surface gloss is designated as the surface effect is equivalent to a part of the area specified by the image data, the DFE 50 generates, over the entire area specified by the image data, clear toner plane data same as that in the area where the mirror surface gloss is designated. After the clear toner is deposited and fixed on the recording medium by the printer machine 70, the clear toner is re-fixed by the glosser 80. Subsequently, to impart the surface effect of the matt to the recording medium, on which the clear toner is re-fixed by the glosser 80, in an area other than the area where the mirror surface effect is designated as the surface effect, the DFE 50 generates clear toner plane data used in the post-processing machine 90B.

Specifically, the DFE 50 generates, as the clear toner plane data used in the printer machine 70, an inverse mask according to Formula (1) in the same manner as explained above. Further, the DFE 50 generates, as the clear toner plane data used in the post-processing machine 90B, a solid mask according to Formula (2) for the area other than the area where the mirror surface effect is designated as the surface effect. The si3 unit 57 of the DFE 50 integrates the clear toner plane data used in the printer machine 70 and the clear toner plane data used in the post-processing machine 90B and the color plane data of 2 bits each of CMYK after the halftone processing and outputs the integrated image data and the ON/OFF information indicating ON of the glosser 80 to the MIC 60.

The MIC 60 outputs, to the printer machine 70, the color plane data of CMYK and the clear toner plane data used in the printer machine 70 among the image data output from the DFE 50. The MIC 60 turn on the glosser 80 using the ON/OFF information output from the DFE 50. The MIC 60 outputs, to the post-processing machine 90B, the clear toner plane data used in the post-processing machine 90B among the image data output from the DFE 50. The printer machine 70 forms, using the color plane data of CMYK and the clear toner plane data output from the MIC 60, an image obtained by depositing the toners of CMYK and the clear toner on the recording medium. Thereafter, the glosser 80 re-fixes the image on the recording medium. The post-processing machine 90B forms a toner image of the clear toner using the clear toner plane data output from the MIC 60, superimposes the toner image on the recording medium that has passed the glosser 80, and fixes the toner image on the recording medium through heating and pressing at low temperature. As a result, in the area where the mirror surface gloss is designated, because a total deposit amount of the toners of CMYK and the clear toner is uniformly compressed, an intense gloss is obtained from the surface of the area. On the other hand, in an area other than the area where the mirror surface gloss is designated, unevenness of the surface is caused by the deposit of the clear toner due to a solid mask after the re-fixing in the glosser 80 and a gloss of the surface of the area is suppressed.

The clear processing 56 of the DFE 50 determines, using the density values of the pixels of the gloss control plane data of 8 bits and referring to the surface effect selection table, a surface effect designated for pixels having density values "212" to "232" is the solid gloss. In particular, for pixels having density values "228" to "232", the clear processing 56 determines that a surface effect is the solid gloss type 1. In this case, the clear processing 56 of the DFE 50 generates the inverse mask 1 using image data corresponding to the area in the color plane data of 8 bits each of CMYK after the gamma correction. Image data representing the inverse mask 1 is the clear toner plane data used in the printer machine 70. In the post-processing machine 90B, clear toner plane data is not used for the area. Therefore, the DFE 50 does not generate clear toner plane data used in the post-processing machine 90B. The si3 unit 57 of the DFE 50 integrates the clear toner plane data used in the printer machine 70 and the color plane data of 2 bits each of CMYK after the halftone processing and outputs the integrated image data and ON/OFF information indicating OFF of the glosser 80 to the MIC 60. The MIC 60 outputs the color plane data of CMYK and the clear toner plane data used in the printer machine 70, which are the image data output from the DFE 50, to the printer machine 70 and turns off the glosser 80 using the ON/OFF information output from the DFE 50. The printer machine 70 forms, using the color plane data of CMYK and the clear toner plane data used in the printer machine 70, an image obtained by depositing the toners of CMYK and the clear toner on the recording medium. Because the glosser 80 is turned off, thereafter, the image is not re-fixed on the recording medium. Because the clear toner plane data is not output to the post-processing machine 90B, in the post-processing machine 90B, the recording medium is discharged without the clear toner being deposited and fixed thereon. As a result, in the area where the solid gloss is designated as the surface effect, a total deposit amount of the toners of CMYK and the clear toner is relatively uniformized and a slightly intense gloss is obtained from the surface of the area.

The clear processing 56 of the DFE 50 determines, using the density values of the pixels of the gloss control plane data of 8 bits and referring to the surface effect selection table, a surface effect designated for pixels having density values "23" to "43" is the halftone dot matt. In this case, the clear processing 56 of the DFE 50 generates image data representing a halftone as clear toner plane data used in the post-processing machine 90A. In the printer machine 70 and the post-processing machine 90B, clear toner plane data is not used for the area. Therefore, the DFE 50 does not generate clear toner plane data used in the printer machine 70 and the post-processing machine 90B. The si3 unit 57 of the DFE 50 integrates the clear toner plane data used in the post-processing machine 90A and the color plane data of 2 bits each of CMYK after the halftone processing and outputs the integrated image data and the ON/OFF information indicating ON of the glosser 80 to the MIC 60. The MIC 60 outputs the color plane data of CMYK and the clear toner plane data used in the post-processing machine 90A, which are the image data output from the DFE 50, to the post-processing machine 90A and turns off the glosser 80 using the ON/OFF information output from the DFE 50. The printer machine 70 forms, using the color plane data of CMYK and the clear toner plane data output from the MIC 60, an image obtained by depositing the toners of CMYK on the recording medium. Because the glosser 80 is turned off, thereafter, the image is not re-fixed on the recording medium. Because the clear toner plane data is not output to the post-processing machine 90B, in the post-processing machine 90B, the recording medium is discharged without the clear toner being deposited and fixed thereon. As a result, a halftone dot is added, with the clear toner, to the area where the halftone dot matt is designated as the surface effect. Therefore, unevenness of the surface of the area occurs and a gloss of the surface of the area is slightly suppressed.

The clear processing 56 of the DFE 50 determines, using the density values of the pixels of the gloss control plane data of 8 bits and referring to the surface effect selection table, a surface effect designated for pixels having density values "1" to "17" is the matt. In this case, the clear processing 56 of the DFE 50 turns on or off the glosser 80 according to setting of the other surface effects if the other surface effects are designated in one page (explained later) and, in both ON and OFF of the glosser 80, does not generate clear toner plane data used in the printer machine 70 and the post-processing machine 90A, and generates a solid mask as clear toner plane data used in the post-processing machine 90B. The si3 unit 57 of the DFE 50 integrates the clear toner plane data used in the post-processing machine 90B and the color plane data of 2 bits each of CMYK after the halftone processing and outputs the integrated image data and the ON/OFF information indicating ON or OFF of the glosser 80 to the MIC 60. The MIC 60 outputs, to the printer machine 70, the color plane data of CMYK among the image data output from the DFE 50 and outputs, to the post-processing machine 90B, the clear toner plane data used in the post-processing machine 90B among the image data output from the DFE 50. The printer machine 70 forms, using the color plane data of CMYK output from the MIC 60, an image obtained by depositing the toners of CMYK on the recording medium. When the glosser 80 is turned on, the image is re-fixed on the recording medium by the glosser 80. When the glosser 80 is turned off, the image is not re-fixed on the recording medium. The post-processing machine 90B forms a toner image of the clear toner using the clear toner plane data output from the MIC 60, superimposes the toner image on the recording medium that has passed the glosser 80, and fixes the toner image on the recording medium according to heating and pressing at low temperature. As a result, in the area where the matt is designated as the surface effect, unevenness of the surface of the area is caused by the deposit of the clear toner due to the solid mask and a gloss of the surface of the area is suppressed.

In the above explanation, the same surface effects are designated in one page. However, when different kinds of surface effects are designated in one page, the surface effects can be realized in the same manner by the processing explained above. Specifically, when a plurality of surface effects are designated in one page, in the gloss control plane data, the density values corresponding to the types of the surface effects shown in FIG. 10 are set in pixels in an area to which the types of the surface effects are imparted. In other words, in the gloss control plane, for each type of a surface effect, an area to which the surface effect is imparted is designated. Therefore, the DFE 50 only has to determine, as an area to which the same surface effects are imparted, a range of pixels in which the same density value is set in the gloss control plane data. Therefore, it is possible to easily realize the surface effects in one page.

As explained above, in the first embodiment, the printing apparatus 30 is not mounted with any one or more of the glosser 80, the post-processing machine 90A, and the post-processing machine 90B as the post-processing machines 40 and is mounted with any one or more of the machines.

In the apparatus configuration in which any one or more of the post-processing machines 40 are not mounted, when different kinds of surface effects are designated in one page, in some case, surface effects that can be realized when all the post-processing machines 40 are mounted cannot be realized.

For example, in the case of a configuration not including the post-processing machine 90A among the glosser 80, the post-processing machine 90A, and the post-processing machine 90B (see the apparatus configuration shown in FIG. 8), after the glosser 80 is turned on and the CMYK toners and the clear toner corresponding to the clear toner plane data for the printer machine 70 are transferred onto a recording medium, the mirror surface gloss (PG) can be realized by pressing the recording medium by the glosser 80 at high temperature and high pressure. The matt (PM) can be realized by the clear toner plane data used in the post-processing machine 90B provided further on a downstream side in a conveying direction of the recording medium than the glosser 80. However, when the glosser 80 is on, in the configuration shown in FIG. 8, because the post-processing machine 90A is not mounted for normal fixing after the glosser 80, the surface effects of the solid gloss (G) and the halftone dot matt (M) cannot be realized on the recording medium on which the mirror surface gloss (PG) and the matt (PM) are realized by the setting.

In the case of a configuration not including both the post-processing machine 90A and the post-processing machine 90B among the post-processing machines 40 (see the apparatus configuration shown in FIG. 9), only the glosser 80 is mounted at the post-stage of the printer machine 70. Therefore, when the glosser 80 is on, the mirror surface gloss (PG) can be realized but the surface effects of the solid gloss (G), the halftone dot matt (M), and the matt (PM) cannot be realized on the same recording medium.

In this way, in the apparatus configuration in which any one or more of the glosser 80 are not mounted, the post-processing machine 90A, and the post-processing machine 90B as the post-processing machines 40, when different kinds of surface effects are designated in one page, some surface effects cannot be realized depending on an apparatus configuration of the post-processing machines 40.

To solve this, in the first embodiment, when different kinds of surface effects are designated in one page and a part of the post-processing machines 40 are not mounted, the DFE 50 replaces, with surface effects realizable by the printing apparatus 30 having the apparatus configuration, surface effects difficult to be realized because the part of the post-processing machines 40 are not mounted.

Referring back to FIG. 7, therefore, the clear processing 56 according to the first embodiment includes a surface-effect-type determining unit 56D, a replacing unit 56A, and a storing unit 56B. The apparatus configuration information indicating the apparatus configuration of the post-processing machines 40 is input to the clear processing 56 from the apparatus-configuration acquiring unit 58.

The surface-effect-type determining unit 56D determines, using the gloss control plane data input from the si1 unit 52 and referring to the surface effect selection table, a surfaces effect corresponding to density values (pixel values) of the pixels that form the gloss control plane data. In other words, the surface-effect-type determining unit 56D determines, using the gloss control plane data and the surface effect selection table, a type of a surface effect of user designation (a surface effect for each of areas (pixels) designated by the user). The surface-effect-type determining unit 56D outputs a result of the determination to the replacing unit 56A.

The storing unit 56B stores therein surface effect selection tables, setting tables (explained in detail later), and the like. The surface effect selection table and the setting table are stored to correspond to each apparatus configuration of the post-processing machines 40 (i.e., associated with the apparatus configuration information). The apparatus configuration information is information indicating types of apparatuses mounted in the printing apparatus 30 as the post-processing machines 40. For example, when only the glosser 80 is mounted on the printing apparatus 30 as the post-processing machine 40, the apparatus configuration information is information indicating the glosser 80.

As explained in detail later, the setting table holds setting contents for replacing, when different kinds of surface effects are designated in one page, according to an apparatus configuration (specifically, types of the mounted post-processing machines 40 and a combination of the post-processing machines 40), types of surface effects difficult to be realized by the apparatus configuration among surface effects of the user designation with surface effects of realizable types. The setting contents indicate setting of ON/OFF of the glosser 80 and the clear toner plane data used in the post-processing machine 90A and the post-processing machine 90B.

The replacing unit 56A replaces, based on the setting table corresponding to the apparatus configuration information acquired from the apparatus-configuration acquiring unit 58, the type of the surface effect of the user designation received from the surface-effect-type determining unit 56D with a surface effect of a type realizable by the printing apparatus 30. Specifically, the replacing unit 56A performs gloss control process (explained later) based on the setting table corresponding to the apparatus configuration to thereby set ON/OFF of the glosser 80 such that the surface effect of the type realizable by the printing apparatus 30 is obtained. The replacing unit 56A generates clear toner plane data based on the setting table corresponding to the apparatus configuration information to thereby generate clear toner plane data used in at least one of the printer machine 70 and the mounted post-processing machine 90A and post-processing machine 90B such that the surface effect of the type realizable by the printing apparatus 30 is obtained.

In this way, the replacing unit 56A performs, based on the setting table corresponding to the apparatus configuration information, the setting of ON/OFF of the glosser 80 and the generation of the clear toner plane data to thereby replace the type of the surface effect of the user designation with the surface effect of the type realizable by the printing apparatus 30. Therefore, in the first embodiment, in some case, the process by the replacing unit 56A is referred to as replacement process or clear toner plane data generation process.

The replacing unit 56A outputs the clear toner plane data used in the printer machine 70, the clear toner plane data used in the apparatus (at least one of the post-processing machine 90A and the post-processing machine 90B) mounted as the post-processing machine 40, information indicating ON/OFF of the glosser 80, and the like to the printing apparatus 30.

The detection process by the surface-effect-type determining unit 56D and the replacement process by the replacing unit 56A are performed for each one page. Therefore, the clear processing 56 generates clear toner plane data as appropriate for each one page and outputs the clear toner plane data to the printing apparatus 30. According to necessity (when the glosser 80 is mounted), the clear processing 56 outputs ON/OFF information concerning the glosser 80 to the printing apparatus 30.

The setting table is explained.

The setting table holds setting contents for replacing, when different kinds of surface effects are designated in one page, according to an apparatus configuration (specifically, types of the mounted post-processing machines 40 and a combination of the post-processing machines 40), types of surface effects difficult to be realized by the apparatus configuration among surface effects of the user designation with surface effects of realizable types. The setting table is stored in the storing unit 56B in association with the apparatus configuration information indicating the apparatus configuration of the post-processing machines 40.

More specifically, the setting table holds types of surface effects of the user designation, types of surface effects actually obtained, and the setting contents in association with one another. Specifically, the setting contents are the clear toner plane data used in the printer machine 70, the clear toner plane data used in the post-processing machine 90A, the clear toner plane data used in the post-processing machine 90B, and the ON/OFF information indicating ON/OFF of the glosser 80.

As explained above, the setting table is stored in association with the apparatus configuration information. The setting contents corresponding to the apparatus configuration information are held in the setting table. Specifically, the setting contents held in the setting table includes at least one of the clear toner plane data used in the post-processing machine 90A, the clear toner plane data used in the post-processing machine 90B, and the ON/OFF information indicating ON/OFF of the glosser 80 and does not include at least one of the clear toner plane data and the ON/OFF information.

In the first embodiment, the storing unit 56B stores therein, as setting tables corresponding to apparatus configuration information, setting tables respectively corresponding to apparatus configuration information indicating an apparatus configuration in which all the post-processing machines 40 (the glosser 80, the post-processing machine 90A, and the post-processing machine 90B) are mounted, apparatus configuration information indicating an apparatus configuration in which the post-processing machine 90A among the post-processing machines 40 is not mounted, and apparatus configuration information indicating an apparatus configuration in which the post-processing machine 90A and the post-processing machine 90B among the post-processing machines 40 are not mounted.

Figure 12:
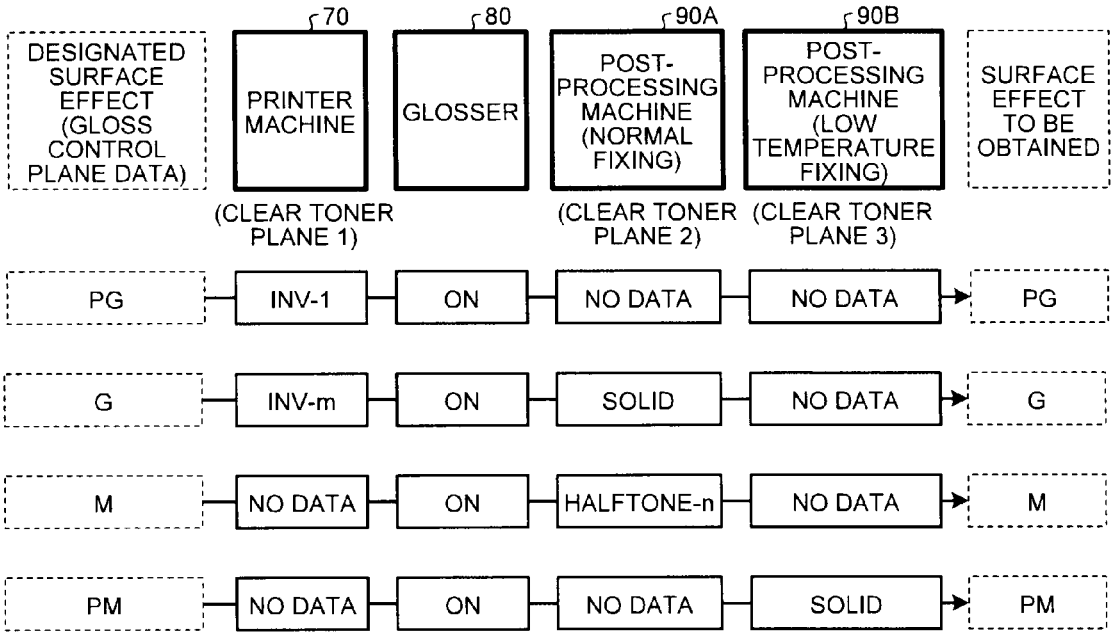
FIG. 12 is a diagram of an example of a data structure of a setting table.

In FIG. 12, the setting table corresponding to the apparatus configuration in which all the post-processing machines 40 (the glosser 80, the post-processing machine 90A, and the post-processing machine 90B) are mounted is shown as an example. FIG. 12 also shows clear toner plane data for realizing the PG (mirror surface gloss), the G (solid gloss), the M (halftone dot matt), and the PM (matt) on the same recording medium. Because, on the same paper surface, the glosser 80 can set only one of ON or OFF, FIG. 12 shows an example in which the glosser 80 is on.

Specifically, the setting table shown in FIG. 12 indicates that, concerning an area where the surface effect of the user designation detected from the gloss control plane data is determined as the PG (mirror surface gloss), the clear toner plane data used in the printer machine 70 is set to "INV-1" (corresponding to any one of inverse masks A, B, and C shown in FIG. 10) as setting contents for realizing the PG (mirror surface gloss), the glosser 80 is turned on, and the clear toner plane data used in the post-processing machine 90A and the post-processing machine 90B is set to "no data". The setting table indicates that, by adopting this setting, concerning the PG (mirror surface gloss), which is the surface effect of the user designation, the PG (mirror surface gloss) is obtained in the printing apparatus 30 having the configuration.

The setting table shown in FIG. 12 indicates setting contents for realizing the G (solid gloss) concerning an area where the surface effect of the user designation determined by the gloss control plane data is determined as the G (solid gloss). As the setting contents, as shown in FIG. 12, the setting table indicates that, concerning the area where the surface effect of the user designation is the G (solid gloss), the clear toner plane data used in the printer machine 70 is set to "INV-m" (corresponding to any one of the inverse masks 1 to 4 shown in FIG. 10), the glosser 80 is turned on, the clear toner plane data used in the post-processing machine 90A is set to "solid", and the clear toner plane data used in the post-processing machine 90A is set to "no data". The setting table indicates that, by adopting this setting, concerning the G (solid gloss), which is the surface effect of the user designation, the G (solid gloss) is obtained in the printing apparatus 30 having the configuration.

The setting table shown in FIG. 12 indicates, concerning an area where the surface effect of the user designation determined by the gloss control plane data is determined as the M (halftone dot matt), setting contents for realizing the M (halftone dot matt). As the setting contents, as shown in FIG. 12, the setting table indicates that, concerning the area where the surface effect of the user designation is the M (halftone dot matt), the clear toner plane data used in the printer machine 70 is set to "no data", the glosser 80 is turned on, the clear toner plane data used in the post-processing machine 90A is set to "halftone-n", and the clear toner plane data used in the post-processing machine 90B is set to "no data". The setting table indicates that, by adopting this setting, concerning the M (halftone dot matt), which is the surface effect of the user designation, the M (halftone dot matt) is obtained in the printing apparatus 30 having the configuration.

Further, the setting table shown in FIG. 12 indicates, concerning an area where the surface effect of the user designation determined by the gloss control plane data is determined as the PM (matt), setting contents for realizing the PM (matt). As the setting contents, as shown in FIG. 12, the setting table indicates that, concerning the area where the surface effect of the user designation is the PM (matt), the clear toner plane data used in the printer machine 70 is set to "no data", the glosser 80 is turned on, the clear toner plane data used in the post-processing machine 90A is set to "no data", and the clear toner plane data used in the post-processing machine 90B is set to "solid". The setting table indicates that, by adopting this setting, concerning the PM (matt), which is the surface effect of the user designation, the PM (matt)) is obtained in the printing apparatus 30 having the configuration.

Figure 13:
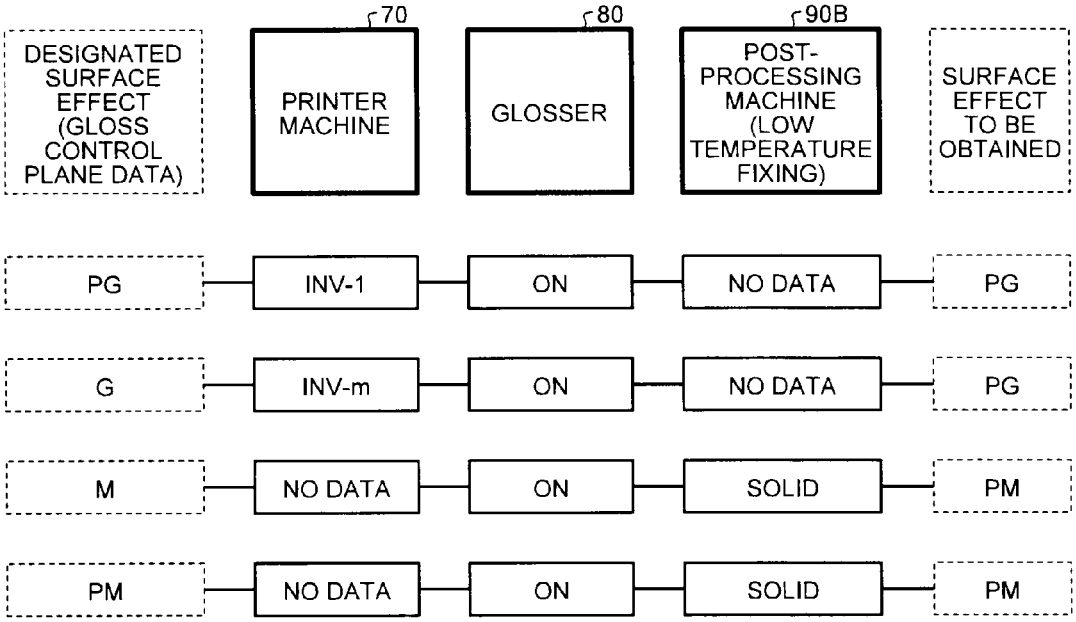
FIG. 13 is a diagram of an example of a data structure of a setting table.

In FIG. 13, a setting table corresponding to apparatus configuration information indicating an apparatus configuration in which the post-processing machine 90A among the post-processing machines 40 (the glosser 80, the post-processing machine 90A, and the post-processing machine 90B) is not mounted is shown as an example.

The setting table shown in FIG. 13 indicates that a type of a surface effect is replaced with the PG (mirror surface gloss) concerning an area where the surface effect of the user designation determined by the gloss control plane data is the G (solid gloss) and a type of a surface effect is replaced with the PM (matt) concerning an area where the surface effect of the user designation is the M (halftone dot matt). The setting table indicates that the surface effect of the user designation is maintained concerning the other surface effects (the PG and the PM).

In the setting table of the clear toner plane data shown in FIG. 13, as setting contents for realizing the surface effects, information indicating that the glosser 80 is turned on and the clear toner plane data used in the printer machine 70 and the post-processing machine 90B corresponding to surface effects of the user designation are shown.

Specifically, the setting table shown in FIG. 13 indicates, concerning an area where the surface effect of the user designation is the PG (mirror surface gloss), setting contents for realizing the PG (mirror surface gloss). Specifically, the setting table indicates, as the setting contents, as shown in FIG. 13, concerning an area where the surface effect of the user designation is the PG (mirror surface gloss), the clear toner plane data used in the printer machine 70 is set to "INV-1" (corresponding to any one of inverse masks A, B, and C shown in FIG. 10), the glosser 80 is turned on, and the clear toner plane data used in the post-processing machine 90B is set to "no data". The setting table indicates that, by adopting this setting, concerning the PG (mirror surface gloss), which is the surface effect of the user designation, the PG (mirror surface gloss) is obtained in the printing apparatus 30 having the configuration (the configuration not including the post-processing machine 90A).

The setting table shown in FIG. 13 indicates, concerning an area where the surface effect of the user designation is the G (solid gloss), setting contents for realizing, instead of the G (solid gloss) that cannot be realized by an apparatus configuration corresponding to thee setting table, the PG (mirror surface gloss) realizable by the apparatus configuration. The setting table indicates that, as the setting contents, as shown in FIG. 13, concerning the area where the surface effect of the user designation is the G (solid gloss), the clear toner plane data used in the printer machine 70 is set to "INV-m" (corresponding to any one of the inverse masks 1 to 4 shown in FIG. 10), the glosser 80 is turned on, and the clear toner plane data used in the post-processing machine 90B is set to "no data". The setting table indicates that, by adopting this setting, concerning the G (solid gloss), which is the surface effect of the user designation, the G (solid gloss) is replaced with the realizable PG (mirror surface gloss).

Similarly, the setting table shown in FIG. 13 indicates, concerning an area where the surface effect of the user designation is the M (halftone dot matt), setting contents for realizing, instead of the M (halftone dot matt) that cannot be realized by an apparatus configuration corresponding to the setting table, setting contents for realizing the PM (matt) realizable by the apparatus configuration. The setting table indicates that, as the setting contents, as shown in FIG. 13, concerning the area where the surface effect of the user designation is M (halftone dot matt), the clear toner plane data used in the printer machine 70 is set to "no data", the glosser 80 is turned on, and the clear toner plane data used in the post-processing machine 90B is set to "solid". The setting table indicates that, by adopting this setting, concerning the M (halftone dot matt), which is the surface effect of the user designation, the M (halftone dot matt) is replaced with the PM (matt) realizable by the apparatus configuration.

Further, the setting table shown in FIG. 13 indicates that, concerning an area where the surface effect of the user designation is the PM (matt), the clear toner plane data used in the printer machine 70 is set to "no data", the glosser 80 is turned on, and the clear toner plane data used in the post-processing machine 90B is set to "solid". The setting table indicates that, by adopting this setting, concerning the PM (matt), which is the surface effect of the user designation, the PM (matt) is obtained in the printing apparatus 30 having the configuration (the configuration not including the post-processing machine 90A).

Figure 14:
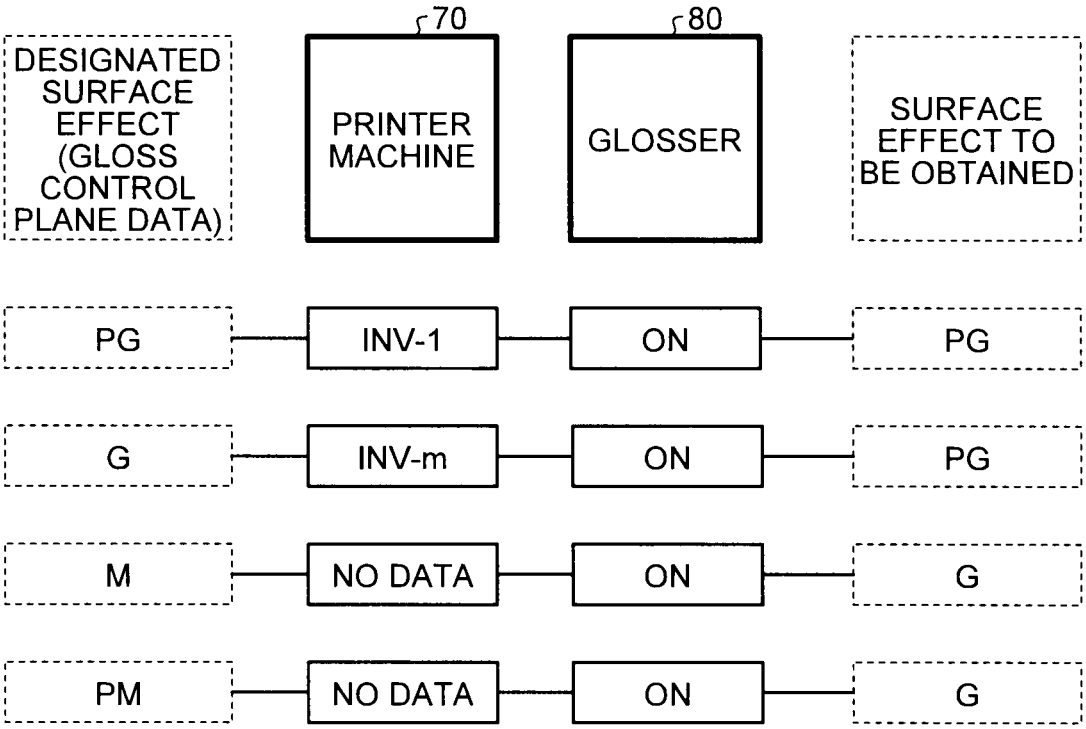
FIG. 14 is a diagram of an example of a data structure of a setting table.

In FIG. 14, the setting table corresponding to the apparatus configuration in which the post-processing machine 90A and the post-processing machine 90B among the post-processing machines 40 (the glosser 80, the post-processing machine 90A, and the post-processing machine 90B) are not mounted is shown as an example.

The setting table shown in FIG. 14 indicates that, concerning an area where the surface effect of the user designation determined by gloss control plane data is determined as the PG (mirror surface gloss), the PG is maintained. The setting table indicates that, concerning an area where the surface effect of the user designation is determined as the G (solid gloss), the G is replaced with the PG (mirror surface gloss) and, concerning areas where the surface effect of the user designation is determined as the M (halftone dot matt) and the PM (the matt), the M and the PM are replaced with the G (solid gloss).

In the setting table shown in FIG. 14, as setting contents for realizing the surface effects, information indicating that the glosser 80 is turned on and clear toner plane used in the printer machine 70 corresponding to surface effects of the user designation are shown.

Specifically, the setting table shown in FIG. 14 indicates, concerning an area where the surface effect of the user designation is the PG (mirror surface gloss), setting contents for realizing the PG (mirror surface gloss) realizable by an apparatus configuration corresponding to the setting table. The setting table indicates that, as the setting contents, as shown in FIG. 14, concerning the area where the surface effect of the user designation is the PG (mirror surface gloss), the clear toner plane data used in the printer machine 70 is set to "INV-1" (corresponding to any one of inverse masks A, B, and C shown in FIG. 10) and the glosser 80 is turned on. The setting table indicates that, by adopting this setting, concerning the PG (mirror surface gloss), which is the surface effect of the user designation, the PG (mirror surface gloss) is obtained in the printing apparatus 30 having the configuration (the configuration not including the post-processing machine 90A and the post-processing machine 90B).

The setting table shown in FIG. 14 indicates, concerning an area where the surface effect of the user designation is the G (solid gloss), setting contents for realizing, instead of the G (slid gloss) that cannot be realized by an apparatus configuration corresponding to the setting table, the PG (mirror surface gloss) realizable by the apparatus configuration. The setting table indicates, as the setting contents, as shown in FIG. 14, concerning the area where the surface effect of the user designation is the G (solid gloss), the clear toner plane data used in the printer machine 70 is set to "INV-m" (corresponding to any one of the inverse masks 1 to 4 shown in FIG. 10) and the glosser 80 is turned on. The setting table indicates that, by adopting this setting, concerning the G (solid gloss), which is the surface effect of the user designation, the surface effect G is replaced with the Pg (mirror surface gloss).

Similarly, the setting table shown in FIG. 14 indicates, concerning an area where the surface effect of the user designation is the M (halftone dot matt), setting contents for realizing, instead of the M (halftone dot matt) that cannot be realized by an apparatus configuration corresponding to the setting table, the G (solid gloss) realizable by the apparatus configuration. As the setting contents, as shown in FIG. 14, the setting table indicates that, concerning the area where the surface effect of the user designation is the M (halftone dot matt), the clear toner plane data used in the printer machine 70 is set to "no data" and the glosser 80 is turned on. The setting table indicates that, by adopting this setting, concerning the M (halftone dot matt), which is the surface effect of the user designation, the M (halftone dot matt) is replaced with the G (solid gloss) realizable by the apparatus configuration.

Further, the setting table shown in FIG. 14 indicates, concerning an area where the surface effect of the user is the PM (matt), setting contents for realizing, instead of the PM (matt) that cannot be realized by an apparatus configuration corresponding to the setting table, the G (solid gloss) realizable by the apparatus configuration. As the setting contents, as shown in FIG. 14, the setting table indicates that, concerning the area where the surface effect of the user designation is the PM (matt), the clear toner plane data used in the printer machine 70 is set to "no data" and the glosser 80 is turned on. The setting table indicates that, by adopting this setting, concerning the PM (matt), which is the surface effect of the user designation, the G (solid gloss) realizable by the printing apparatus 30 having the configuration is obtained.

As shown in FIGS. 12 to 14, in the case of the apparatus configuration in which any one of the post-processing machines 40 is not mounted, a setting table set different from a setting table prepared when all the post-processing machines 40 are mounted is prepared.

Such setting tables created for the respective kinds of apparatus configuration information are stored in the storing unit 56B.

Figure 15:
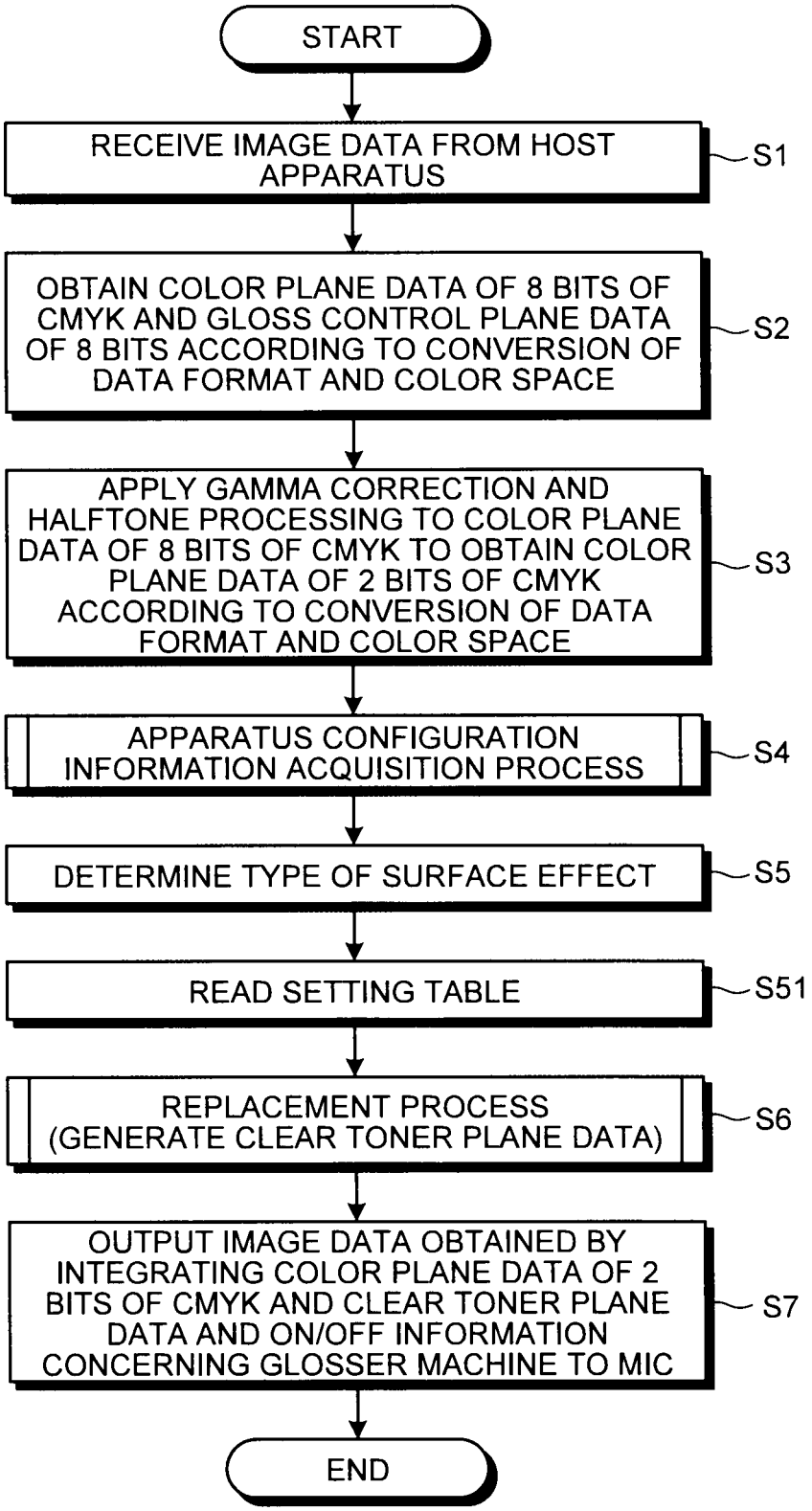
FIG. 15 is a flowchart for explaining a procedure of gloss control process performed by the image forming system.

A procedure of the gloss control process performed by the image forming system according to the first embodiment is explained with reference to FIG. 15.

The DFE 50 receives image data from the host apparatus 49 (step S1). The DFE 50 subjects the image data to language interpretation, converts the image data represented in the vector format into the raster format, and converts a color space represented in the RGB format into a color space of the CMYK format or the like to obtain color plane data of 8 bits each of color planes of CMYK and gloss control plane data of 8 bits (step S2). The DFE 50 applies gamma correction to the color plane data of 8 bits each of the color planes of CMYK using a gamma curve of a 1D_LUT generated by calibration. The DFE 50 applies, to the image data after the gamma correction, halftone processing for converting the color plane data into a data format of color plane data of 2 bits each of CMYK for output to the printer machine 70 to obtain color plane data of 2 bits each of CMYK after the halftone processing (step S3).

Subsequently, the apparatus-configuration acquiring unit 58 of the clear processing 56 executes apparatus configuration information acquisition process for acquiring apparatus configuration information from the apparatus-configuration acquiring unit 58 (step S4). The apparatus-configuration acquiring unit 58 outputs the acquired apparatus configuration information to the clear processing 56.

Figure 16:
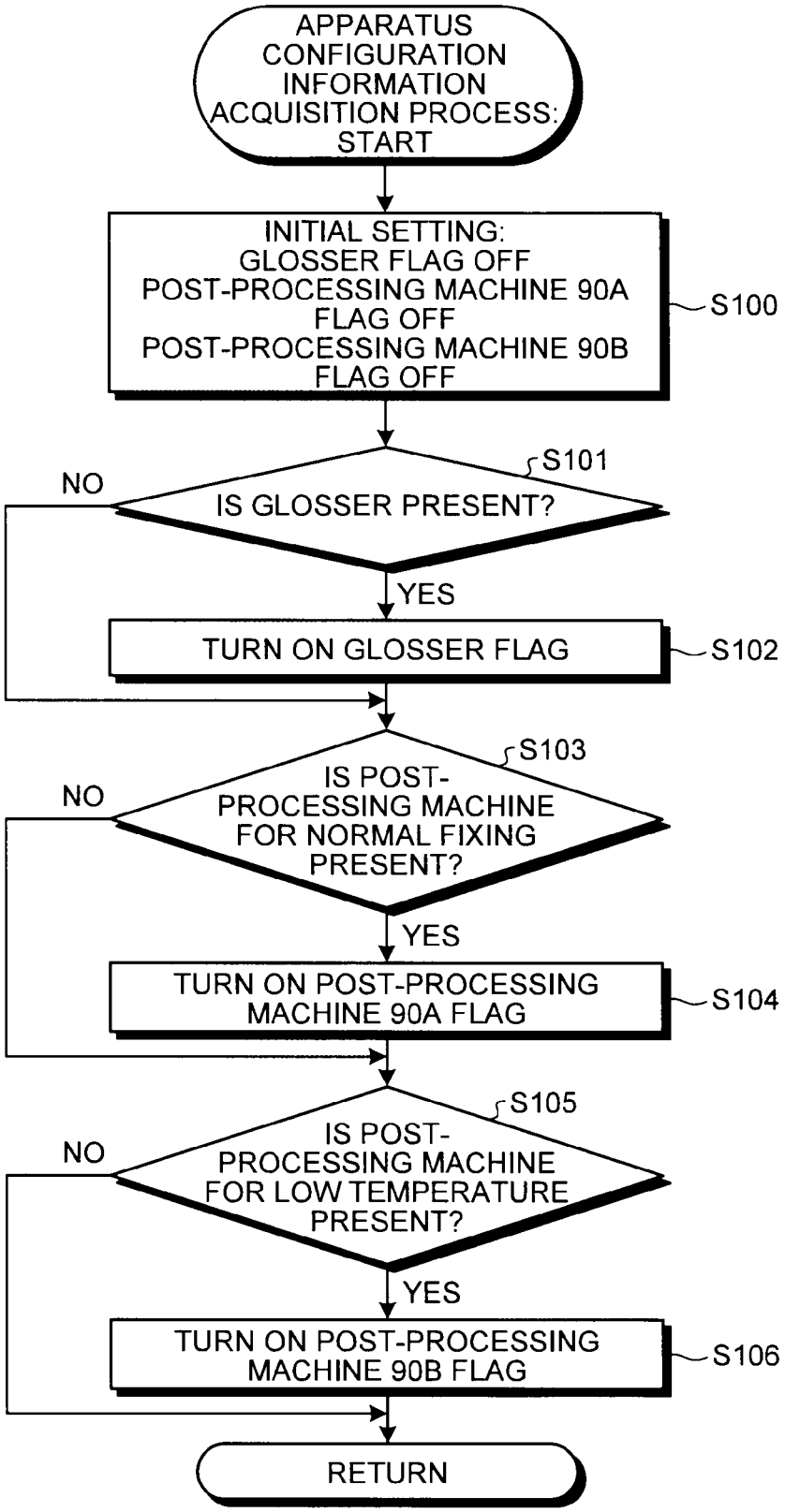
FIG. 16 is a flowchart for explaining apparatus configuration acquisition process.

In FIG. 16, the apparatus configuration information acquisition process at step S4 is shown.

First, as initial setting, the apparatus-configuration acquiring unit 58 sets all of a glosser flag, a post-processing machine 90A flag, and a post-processing machine 90B flag to off (step S100). The apparatus-configuration acquiring unit 58 outputs an inquiry signal for inquiring whether the glosser 80 is mounted on the printing apparatus 30 to the MIC 60. When the apparatus-configuration acquiring unit 58 receives a signal indicating an inquiry result from the MIC 60, the apparatus-configuration acquiring unit 58 determines whether the glosser 80 is mounted (step S101). When the apparatus-configuration acquiring unit 58 determines that the glosser 80 is mounted (Yes at step S101), the apparatus-configuration acquiring unit 58 turns on an internal flag that indicates that the glosser 80 is mounted (step S102).

When the apparatus-configuration acquiring unit 58 determines that the glosser 80 is not mounted (No at step S101), the apparatus-configuration acquiring unit 58 proceeds to step S103. The apparatus-configuration acquiring unit 58 also proceeds to step S103 after the process at step S102. Subsequently, the apparatus-configuration acquiring unit 58 outputs an inquiry signal for inquiring whether the post-processing machine 90A functioning as the normal fixing processing machine is mounted on the printing apparatus 30 to the MIC 60. When the apparatus-configuration acquiring unit 58 receives a signal indicating an inquiry result from the MIC 60, the apparatus-configuration acquiring unit 58 determines whether the post-processing machine 90A is mounted (step S103). When the apparatus-configuration acquiring unit 58 determines that the post-processing machine 90A is mounted (Yes at step S103), the apparatus-configuration acquiring unit 58 turns on an internal flag that indicates that the post-processing machine 90A is mounted (step S104).

When the apparatus-configuration acquiring unit 58 determines that the post-processing machine 90A is not mounted (No at step S103), the apparatus-configuration acquiring unit 58 proceeds to step S105. The apparatus-configuration acquiring unit 58 also proceeds to step S105 after the process at step S104. Subsequently, the apparatus-configuration acquiring unit 58 outputs an inquiry signal for inquiring whether the post-processing machine 90B functioning as the low-temperature fixing processing machine is mounted on the printing apparatus 30 to the MIC 60. When the apparatus-configuration acquiring unit 58 receives a signal indicating an inquiry result from the MIC 60, the apparatus-configuration acquiring unit 58 determines whether the post-processing machine 90B is mounted (step S105). When the apparatus-configuration acquiring unit 58 determines that the post-processing machine 90B is mounted (Yes at step S105), the apparatus-configuration acquiring unit 58 turns on an internal flag that indicates that the post-processing machine 90B is mounted (step S106).

When the apparatus-configuration acquiring unit 58 determines that the post-processing machine 90B is not mounted (No at step S105), the image forming system ends this routine. The image forming system also ends this routine after the process at step S106.

Referring back to FIG. 15, the surface-effect-type determining unit 56D determines, using the gloss control plane data of 8 bits obtained at step S2, a type of a surface effect designated for pixel values indicated by the gloss control plane data (step S5). Specifically, the surface-effect-type determining unit 56D reads, from the storing unit 56B, a surface effect selection table corresponding to the apparatus configuration information acquired from the apparatus-configuration acquiring unit 58 and determines, referring to the read surface effect selection table and using the gloss control plane data of 8 bits, a type of a surface effect designated for pixel values indicated by the gloss control plane data. The surface-effect-type determining unit 56D performs such determination concerning all pixels that form the gloss control plane.

At this point, the surface-effect-type determining unit 56D further determines whether display effects of different types are designated in one page. In a process routine shown in FIG. 15, different types of surface effects are designated in one page.

According to the process at step S5, the surface-effect-type determining unit 56D acquires a type of a surface effect of user designation for each area of an image represented by processing target image data.

Subsequently, the replacing unit 56A reads, from the storing unit 56B, a setting table corresponding to the apparatus configuration information acquired at step S4 (step S51).

The replacing unit 56A then performs, based on the type of the surface effect read at step S5 and the setting table read at step S51, replacement process, i.e., generation of clear toner plane data in which a surface effect of a type difficult to be realized by the apparatus configuration is replaced with a surface effect of a realizable type and setting of ON/OFF of the glosser 80 (step S6).

Specifically, at step S51, the replacing unit 56A reads, from the storing unit 56B, a setting table corresponding to the apparatus configuration information acquired at step S4. Specifically, when the apparatus configuration information acquired at step S4 is apparatus configuration information indicating an apparatus configuration in which all the post-processing machines 40 (the glosser 80, the post-processing machine 90A, and the post-processing machine 90B) are mounted, the replacing unit 56A reads, from the storing unit 56B, the setting table shown in FIG. 12 as a setting table corresponding to the apparatus information. When the apparatus configuration information acquired at step S4 is apparatus configuration information indicating an apparatus configuration in which the glosser 80 and the post-processing machine 90B are mounted as the post-processing machines 40, the replacing unit 56A reads, from the storing unit 56B, the setting table shown in FIG. 13 as a setting table corresponding to the apparatus configuration information. When the apparatus configuration information acquired at step S4 is apparatus configuration information indicating an apparatus configuration in which only the glosser 80 is mounted as the post-processing machine 40, the replacing unit 56A reads, from the storing unit 56B, the setting table shown in FIG. 14 as a setting table corresponding to the apparatus configuration information.

The replacing unit 56A reads, for each of the types of the surface effects of the user designation acquired at step S5, setting (ON/OFF of the glosser 80 and clear toner plane data) respectively corresponding to the apparatuses (at least one of the printer machine 70, the glosser 80, the post-processing machine 90A, and the post-processing machine 90B) mounted on the printing apparatus 30 in the read setting table. The replacing unit 56A performs creation of clear toner plane data for each of the mounted post-processing machines 40 and setting of ON/OFF of the glosser 80.

Figure 17:
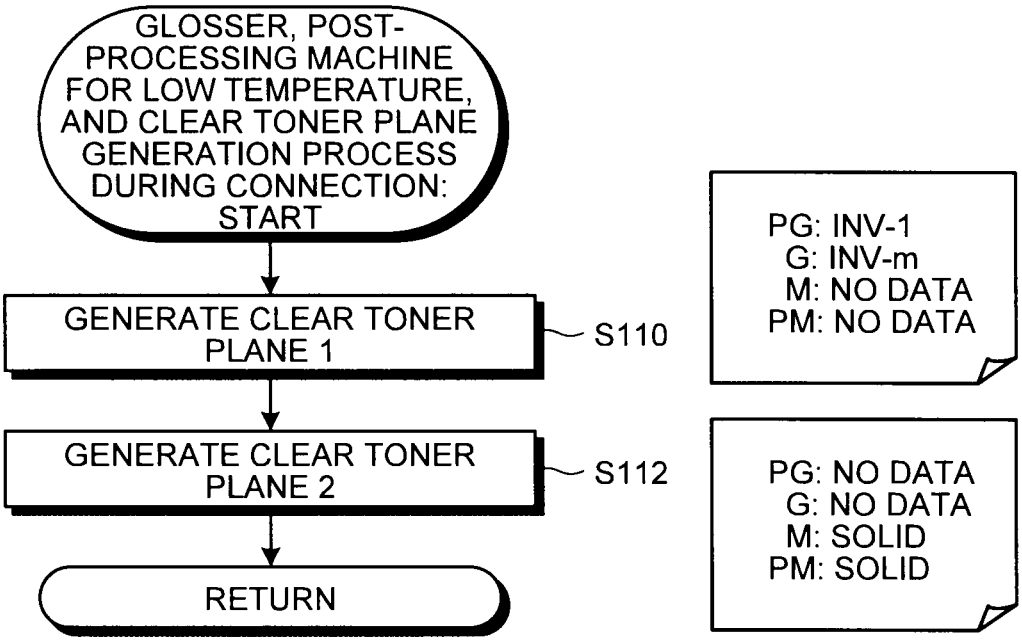
FIG. 17 is a flowchart for explaining replacement process.

In FIG. 17, replacement process performed when apparatus configuration information indicating mounting of the glosser 80 and the post-processing machine 90B (i.e., apparatus configuration information indicating the configuration shown in FIG. 8) is acquired as the apparatus configuration information at step S4 is shown.

In this case, the replacing unit 56A reads a setting table corresponding to apparatus configuration information indicating that only the glosser 80 and the post-processing machine 90B are provided as the post-processing machines 40. For example, the replacing unit 56A reads the setting table shown in FIG. 13 as the setting table corresponding to the apparatus configuration information. Thereafter, the replacing unit 56A executes processes shown in FIG. 17 as the replacement process. In FIG. 17, replacement process performed when the setting table shown in FIG. 13 is read is shown.

As shown in FIG. 13, because the information indicating ON/OFF of the glosser 80 shown in the read setting table is "ON", the replacing unit 56A sets the glosser 80 to ON (not shown). The replacing unit 56A generates, as the clear toner plane data used in the printer machine 70, clear toner plane data of INV-1 concerning an area where the surface effect of the user designation is the mirror surface gloss (PG) and clear toner plane data of INV-m concerning an area where the surface effect of the user designation is the solid gloss (G). The replacing unit 56A sets clear toner plane data to "no data" concerning areas where the surface effect of the user designation is the halftone dot matt (M) and the matt (PM). In other words, concerning the areas where the surface effect of the user designation is the halftone dot matt (M) and the matt (PM), the replacing unit 56A does not create clear toner plane data used in the printer machine 70. Referring back to FIG. 17, in this way, the replacing unit 56A creates the clear toner plane data (clear toner plane data of 2 bits) used in the printer machine 70 (step S110).

Subsequently, the replacing unit 56A sets the clear toner plane data used in the post-processing machine 90B to "no data" concerning areas where the surface effect of the user designation is the mirror surface gloss (PG) and the solid gloss (G). In other words, the replacing unit 56A does not create clear toner plane data used in the post-processing machine 90B concerning the areas where the surface effect of the user designation is the mirror surface gloss (PG) and the solid gloss (G). The replacing unit 56A creates clear toner plane data of a solid mask as the clear toner plane data used in the post-processing machine 90B concerning the areas where the surface effect of the user designation is the halftone dot matt (M) and the matt (PM). Consequently, the replacing unit 56A creates the clear toner plane data (clear toner plane data of 2 bits) used in the post-processing machine 90B (step S112). The image forming system ends this routine.

Referring back to FIG. 15, the DFE 50 outputs the color plane data of 2 bits each of CMYK after the halftone process obtained at step S3, the clear toner plane data of 2 bits generated as appropriate at step S6, and the ON/OFF information indicating ON or OFF of the glosser 80 determined at step S6 to the MIC 60 (step S7).

Consequently, the image forming system ends this routine.

The MIC 60 turns on or off the glosser 80 based on the ON/OFF information indicating ON or OFF of the glosser 80 output from the DFE 50. The MIC 60 integrates the color plane data of 2 bits each of CMYK and the clear toner plane data used in the printer machine 70 generated at step S6, which are the image data output from the DFE 50, and outputs the integrated image data to the printer machine 70. The printer machine 70 emits, using the color plane data of CMYK and the clear toner plane data output from the MIC 60, a light beam from the exposing device to form toner images corresponding to the toners on the photosensitive members, transfers the toner images onto a recording medium, and then fixes the toner images. Consequently, the clear toner is deposited on the recording medium in addition to the toners of CMYK and an image is formed.

Thereafter, the recording medium is conveyed along the conveying path 20 and reaches the position of the glosser 80. When the glosser 80 is on, the glosser 80 re-fixes the image on (an area including an image forming area by the printer machine 70 of) the recording medium.

When the clear toner plane data output from the DFE 50 is the clear toner plane data used in the post-processing machine 90A, the MIC 60 outputs the clear toner plane data to the post-processing machine 90A. When the post-processing machine 90A is mounted as the post-processing machines 40, the post-processing machine 90A receives the clear toner plane data from the MIC 60. The post-processing machine 90A forms a toner image by the clear toner using the clear toner plane data output from the MIC 60, superimposes the toner image on the recording medium that has passed the glosser 80, and fixes the toner image on the recording medium according to heating and pressing at the normal temperature.

When the clear toner plane data output from the DFE 50 is the clear toner plane data used in the post-processing machine 90B, the MIC 60 outputs the clear toner plane data to the post-processing machine 90B. When the post-processing machine 90B is mounted on the post-processing machines 40, the post-processing machine 90B receives the clear toner plane data from the MIC 60. The post-processing machine 90B forms a toner image by the clear toner using the clear toner plane data output from the MIC 60, superimposes the toner image on the recording medium that has passed the post-processing machine 90A, and fixes the toner image on the recording medium according to heating and pressing at low temperature.

For example, as explained above, it is assumed that the printing apparatus 30 has the apparatus configuration in which the post-processing machine 90A is not mounted as the post-processing machine 40 and including the glosser 80 and the post-processing machine 90B (see FIG. 8) and the setting table shown in FIG. 13 is stored in the storing unit 56B as a setting table corresponding to the apparatus configuration information indicating the apparatus configuration. It is further assumed that surface effects of different types are designated in one page.

In this case, the gloss control process shown in FIG. 14 is executed, whereby on the recording medium that is conveyed on the conveying path 20 and has passed the printer machine 70, the glosser 80, and the post-processing machine 90B, as shown in FIG. 13, the surface effect of the mirror surface gloss (PG) is imparted to an area where the mirror surface gloss (PG) is designated by the user and an area where the solid gloss (G) is designated by the user. The surface effect of the matt (PM) is imparted to an area where the halftone dot matt (M) and the matt (PM) are designated by the user. No surface effect is imparted to an area not designated as an area to which a surface effect is imparted.

As explained above, in the image forming system 10 according to the first embodiment, the clear processing 56 of the DFE 50 includes the surface-effect-type determining unit 56D, the replacing unit 56A, and the storing unit 56B that stores the surface effect selection table, the setting table, and the like. The setting table holds the setting contents for replacing types of surface effects difficult to be realized by an apparatus configuration among surface effects of the user designation with surface effects of realizable types. The DFE 50 includes the apparatus-configuration acquiring unit 58 that acquires apparatus configuration information indicating the apparatus configuration of post-processing machines 40. The storing unit 56B stores therein the surface effect selection table and the setting table in association with the apparatus configuration information indicating the apparatus configuration of the post-processing machines 40. The replacing unit 56A sets, according to the apparatus configuration of the post-processing machines 40 and using the setting table that stores the setting contents for replacing types of surface effects difficult to be realized by the apparatus configuration among surface effects of the user designation with surface effects of realizable types, ON/OF of the glosser 80 and generates clear toner plane data used in the printer machine 70, the post-processing machine 90A, the post-processing machine 90B, or the like. The printing apparatus 30 performs printing using the set ON/OFF setting and the generated clear toner plane data.

Therefore, even when a part of the post-processing machines are not mounted, it is possible to impart a surface effect by the clear toner to a recording medium, on which an image is formed, without causing the user trouble.

Second Embodiment

Nest, a second embodiment will be explained. In some case, components common to the first embodiment are explained using the same reference numerals and signs or explanation of the components is omitted.

In the first embodiment, the DFE 50 (the clear processing 56) performs creation of clear toner plane data of the post-processing machines and setting of ON/OFF of the glosser 80 according to the configuration of the post-processing machines 40 and according to the setting table corresponding to the apparatus configuration information.

On the other hand, in the second embodiment, separately from surface effects designated by a user indicated by the gloss control plane data, the user selects gloss preference or type preference. In the second embodiment, replacement process for surface effects of the gloss preference or the type preference is performed according to selected contents selected by the user.

The gloss preference indicates that a surface effect of user designation is replaced with a surface effect having higher glossiness. The type preference indicates that a surface effect of user designation is replaced with a surface effect not including the mirror gloss (PG) having the highest glossiness.

Figure 18:
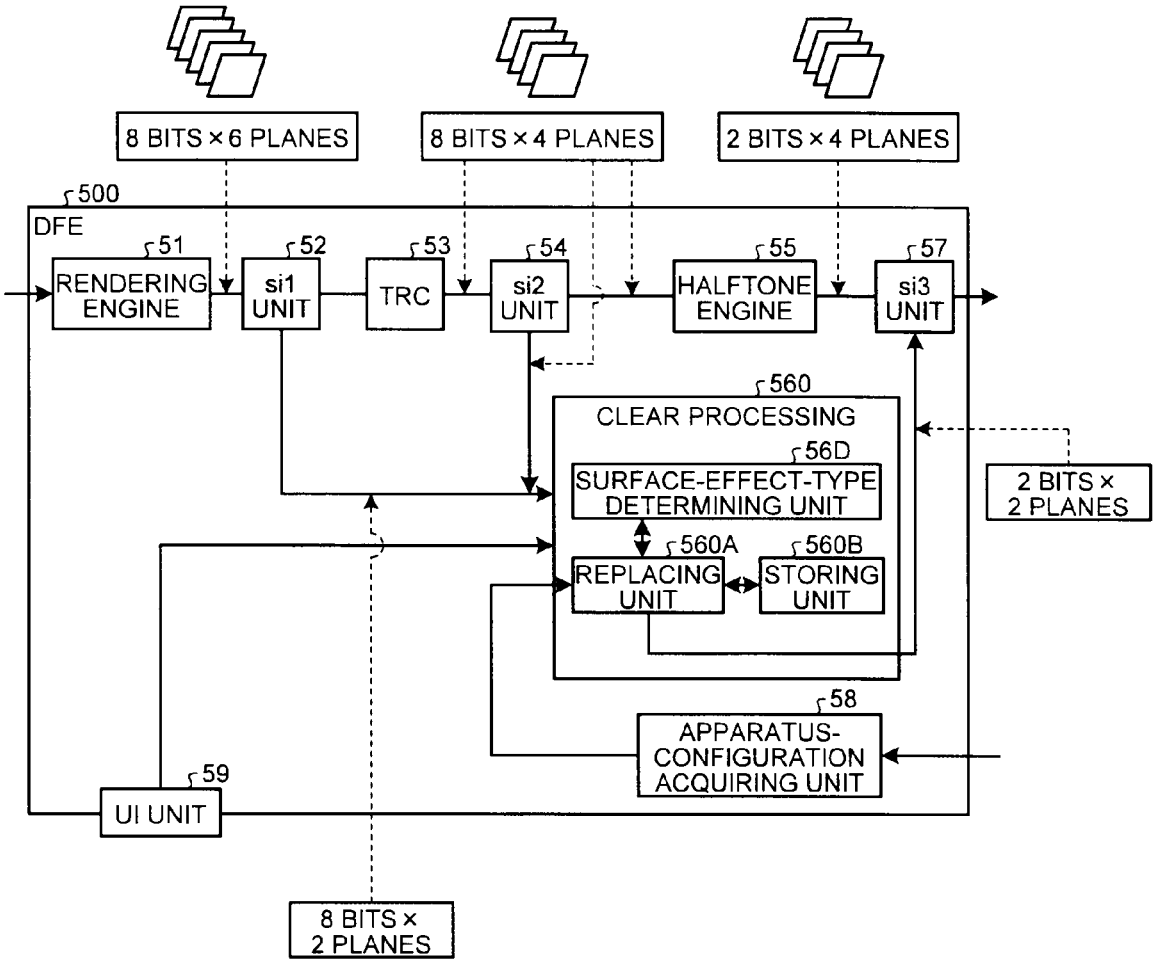
FIG. 18 is a diagram of an example of a functional configuration of a DFE according to a second embodiment.

In FIG. 18, the configuration of a DFE 500 in the image forming system according to the second embodiment is shown. The image forming system according to the second embodiment has the same configuration as the image forming system according to the first embodiment except that the DFE 500 shown in FIG. 18 is used instead of the DFE 50 shown in FIG. 1 explained in the first embodiment. Therefore, detailed explanation is omitted concerning the components other than the DFE 500 in the image forming system.

The DFE 500 includes, as hardware configuration, a control unit such as a central processing unit (CPU) that controls the entire apparatus, main storing units such as a read only memory (ROM) and a random access memory (RAM) that store various data and various computer programs, and an auxiliary storing unit such as a hard disk drive (HDD) that stores various data and various computer programs. The DFE 500 has a hardware configuration including a normal computer.

As a functional configuration, as shown in FIG. 18, the DFE 500 includes the rendering engine 51, the si1 unit 52, the TRC 53, the si2 unit 54, the halftone engine 55, the si3 unit 57, the apparatus-configuration acquiring unit 58, and a clear processing 560. The clear processing 560 includes the surface-effect-type determining unit 56D, a storing unit 560B, and a replacing unit 560A.

The DFE 500 has the same configuration as the DFE 50 in the first embodiment except that the DFE 500 includes the clear processing 560 instead of the clear processing 56 shown in FIG. 7. The clear processing 560 has the same configuration as the clear processing 56 except that the clear processing 560 includes the replacing unit 560A instead of the replacing unit 56A shown in FIG. 7 and includes the storing unit 560B instead of the storing unit 56B shown in FIG. 7. Therefore, components having the same configurations and the same functions as the components explained in the first embodiment are denoted by the same reference numerals and signs and explanation of the components is omitted.

Figure 19:
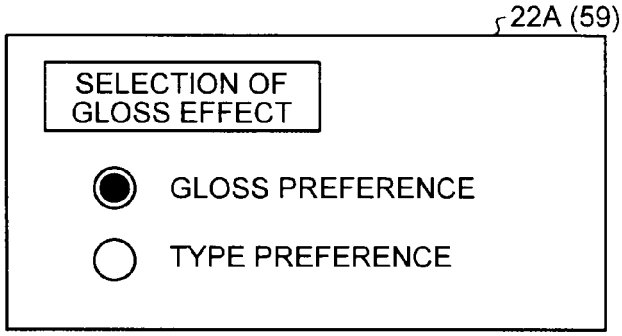
FIG. 19 is a schematic diagram of an input screen.

The DFE 500 further includes a user interface (UI) unit 59. The UI unit 59 displays various kinds of information and receives various instructions. In the second embodiment, as shown in FIG. 19, a selection screen 22A for prompting the user to select a gloss effect is displayed on the UI unit 59. In the second embodiment, the selection screen 22A for prompting the user to select "gloss preference" or "type preference" is displayed on the UI unit 59.

The user points a display place of a selection button (not shown) in the UI unit 59, whereby the "gloss preference" or the "type preference" is selected. Thereafter, the user points a display place of a determination button (not shown) displayed on the UI unit 59. Consequently, a signal indicating the "gloss preference" or the "type preference" pointed by the user is output from the UI unit 59 to the replacing unit 560A of the clear processing 560.

In the second embodiment, the UI unit 59 is provided in the DFE 500. However, the UI unit 59 may be provided in a personal computer that inputs image data to the DFE 50. In other words, the DFE 500 may receive the signal indicating the "gloss preference" or the "type preference" from the personal computer.

Like the storing unit 56B, the storing unit 560B stores therein surface effect selection tables corresponding to apparatus configuration information. The storing unit 560B stores therein, as setting tables, setting tables corresponding to apparatus configuration information and types of gloss effects.

In the second embodiment, the storing unit 560B stores therein, as a setting table corresponding to apparatus configuration information, a setting table corresponding to apparatus configuration information indicating an apparatus configuration in which all the post-processing machines 40 (the glosser 80, the post-processing machine 90A, and the post-processing machine 90B) are mounted and types of gloss effects. The storing unit 560B stores therein, as a setting table corresponding to apparatus configuration information, a setting table corresponding to apparatus configuration information indicating an apparatus configuration in which the glosser 80 and the post-processing machine 90B are mounted and types of gloss effects. The storing unit 560B stores therein, as a setting table corresponding to apparatus configuration information, a setting table corresponding to apparatus configuration information indicating an apparatus configuration in which the glosser 80 is mounted and types of gloss effects.

Specifically, the storing unit 560B stores therein the setting table shown in FIG. 12 as a setting table corresponding to the apparatus configuration information indicating the apparatus configuration in which all the post-processing machines 40 (the glosser 80, the post-processing machine 90A, and the post-processing machine 90B) are mounted and corresponding to the gloss effect "gloss preference".

The storing unit 560B stores therein the setting table shown in FIG. 12 as a setting table corresponding to the apparatus configuration information indicating the apparatus configuration in which all the post-processing machines 40 (the glosser 80, the post-processing machine 90A, and the post-processing machine 90B) are mounted and corresponding to the gloss effect "type preference". This is because, when all the post-processing machines 40 (the glosser 80, the post-processing machine 90A, and the post-processing machine 90B) are mounted, there is no surface effect that cannot be realized by the configurations of the post-processing machines 40.

The storing unit 560B stores therein the setting table shown in FIG. 13 as a setting table corresponding to the apparatus configuration information indicating the apparatus configuration in which the glosser 80 and the post-processing machine 90B are mounted as the post-processing machines 40 and corresponding to the gloss effect "gloss preference".

Figure 20:
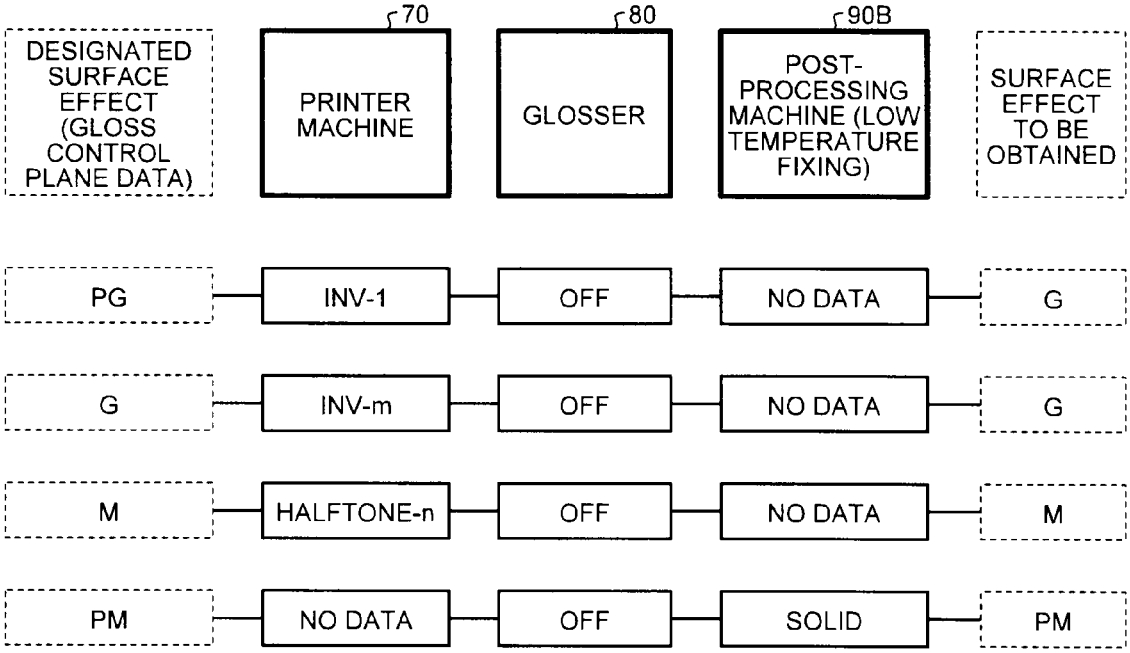
FIG. 20 is a diagram of an example of a data structure of a setting table.

The storing unit 560B stores therein the setting table shown in FIG. 20 as a setting table corresponding to the apparatus configuration information indicating the apparatus configuration in which the glosser 80 and the post-processing machine 90B are mounted as the post-processing machines 40 and corresponding to the gloss effect "type preference".

The setting table shown in FIG. 20 indicates the information indicating that the glosser 80 is turned off and the clear toner plane data respectively used in the printer machine 70 and the post-processing machine 90B.

Specifically, the setting table shown in FIG. 20 indicates that, concerning an area where the surface effect of the user designation is the PG (mirror surface gloss), the clear toner plane data used in the printer machine 70 is set to "INV-1", the glosser 80 is turned off, and the clear toner plane data used in the post-processing machine 90B is set to "no data". The setting table indicates that, by adopting this setting, concerning the PG (mirror surface gloss), which is the surface effect of the user designation, the G (solid gloss) is obtained in the printing apparatus 30.

The setting table shown in FIG. 20 indicates that, concerning an area where the surface effect of the user designation is the G (solid gloss), the clear toner plane data used in the printer machine 70 is set to "INV-m", the glosser 80 is turned off, and the clear toner plane data used in the post-processing machine 90B is set to "no data". The setting table indicates that, by adopting this setting, concerning the G (solid gloss), which is the surface effect of the user designation, the surface effect G is obtained.

Similarly, the setting table shown in FIG. 20 indicates that, concerning an area where the surface effect of the user designation is the M (halftone dot matt), the clear toner plane data used in the printer machine 70 is set to "halftone-n", the glosser 80 is turned off, and the clear toner plane data used in the post-processing machine 90B is set to "no data". The setting table indicates that, by adopting this setting, concerning the M (halftone dot matt), which is the surface effect of the user designation, the surface effect M is obtained.

Further, the setting table shown in FIG. 20 indicates that, concerning an area where the surface effect of the user designation is the PM (matt), the clear toner plane data used in the printer machine 70 is set to "no data", the glosser 80 is turned off, and the clear toner plane data used in the post-processing machine 90B is set to "solid" (corresponding to any one of the solids A, B, and C shown in FIG. 10). The setting table indicates that, by adopting this setting, concerning the PM (matt), which is the surface effect of the user designation, the surface effect PM is obtained.

Figure 21:
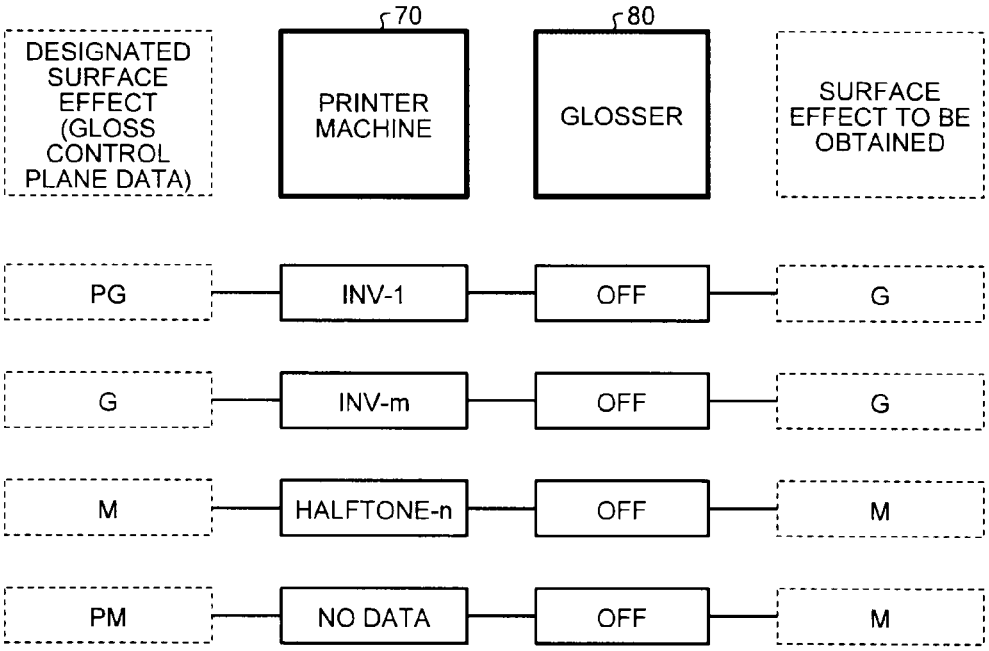
FIG. 21 is a diagram of an example of a data structure of a setting table.

The storing unit 560B stores therein the setting table shown in FIG. 21 as a setting table corresponding to the apparatus configuration information indicating the apparatus configuration in which only the glosser 80 is mounted as the post-processing machine 40 and corresponding to the gloss effect "gloss preference".

The storing unit 560B stores therein the setting table shown in FIG. 21 as a setting table corresponding to the apparatus configuration information indicating the apparatus configuration in which only the glosser 80 is mounted as the post-processing machine 40 and corresponding to the gloss effect "type preference".

The setting table shown in FIG. 21 indicates that, concerning an area where the surface effect of the user designation determined by the gloss control plane data is determined as the PG (mirror surface gloss), the PG (mirror surface gloss) is replaced with the G (solid gloss) and, concerning an area where the surface effect of the user designation is determined as the PM (matt), the PM (mat) is replaced with the M (halftone dot matt).

In the setting table shown in FIG. 21, as setting contents for realizing the surface effect, the information indicating that the glosser 80 is turned off and the clear toner plane data used in the printer machine 70 are shown.

Specifically, the setting table shown in FIG. 21 indicates that, concerning an area where the surface effect of the user designation is the PG (mirror surface gloss), the clear toner plane data used in the printer machine 70 is set to "INV-1" and the glosser 80 is turned off. The setting table indicates that, by adopting this setting, concerning the surface effect PG (mirror surface gloss), which is the surface effect of the user designation, the surface effect G (solid gloss) is obtained in the printing apparatus 30.

The setting table shown in FIG. 21 indicates that, concerning an area where the surface effect of the user designation is the G (solid gloss), the clear toner plane data used in the printer machine 70 is set to "INV-m" and the glosser 80 is turned off. The setting table indicates that, by adopting this setting, concerning the surface effect G (solid gloss), which is the surface effect of the user designation, the surface effect G is obtained.

Similarly, the setting table shown in FIG. 21 indicates that, concerning an area where the surface effect of the user designation is the M (halftone dot matt), the clear toner plane data used in the printer machine 70 is set to "halftone-n" (corresponding to any one of the halftones 1 to 4 shown in FIG. 10) and the glosser 80 is turned off. The setting table indicates that, by adopting this setting, concerning the surface effect M (halftone dot matt), which is the surface effect of the user designation, the surface effect M is obtained.

Further, the setting table shown in FIG. 21 indicates that, concerning an area where the surface effect of the user designation is the PM (matt), the clear toner plane data used in the printer machine 70 is set to "no data" and the glosser 80 is turned off. The setting table indicates that, by adopting this setting, concerning the PM (matt), which is the surface effect of the user designation, the surface effect PM is replaced with the surface effect M (halftone dot matt).

The replacing unit 560A reads, from the storing unit 560B, a setting table corresponding to the type of the surface effect of the user designation received from the surface-effect-type determining unit 56D and a signal indicating "gloss preference" or "type preference" received from the UI unit 59. The replacing unit 560A generates clear toner plane data according to setting contents indicated by the read setting table. Consequently, like the replacing unit 56A in the first embodiment, the replacing unit 560A replaces, based on the read setting table, the type of the surface effect of the user designation received from the surface-effect-type determining unit 56D with a type of a surface effect realizable by the printing apparatus 30. In other words, the replacing unit 560A generates, according to the apparatus configuration and the gloss preference or the type preference, clear toner plane data such that the surface effect of the type realizable by the printing apparatus 30 is obtained.

When the replacing unit 560A receives the signal indicating the gloss preference from the UI unit 59, the replacing unit 560A sets the glosser 80 to ON. When the replacing unit 560A receives the signal indicating the type preference from the UI unit 59, the replacing unit 560A sets the glosser 80 to OFF.

When the glosser 80 is set to ON, the mirror surface gloss (PG) having the highest glossiness can be realized. Therefore, in the second embodiment, characters "gloss preference" are displayed on the UI unit 59, and when the "gloss preference" is pointed (selected) by the user, the glosser 80 is turned on.

As in the first embodiment, the replacing unit 560A outputs clear toner plane data generated for each one page and ON/OFF information concerning the glosser 80 to the printing apparatus 30.

A procedure of gloss control process performed by the image forming system according to the second embodiment is explained with reference to FIG. 22.

Figure 22:
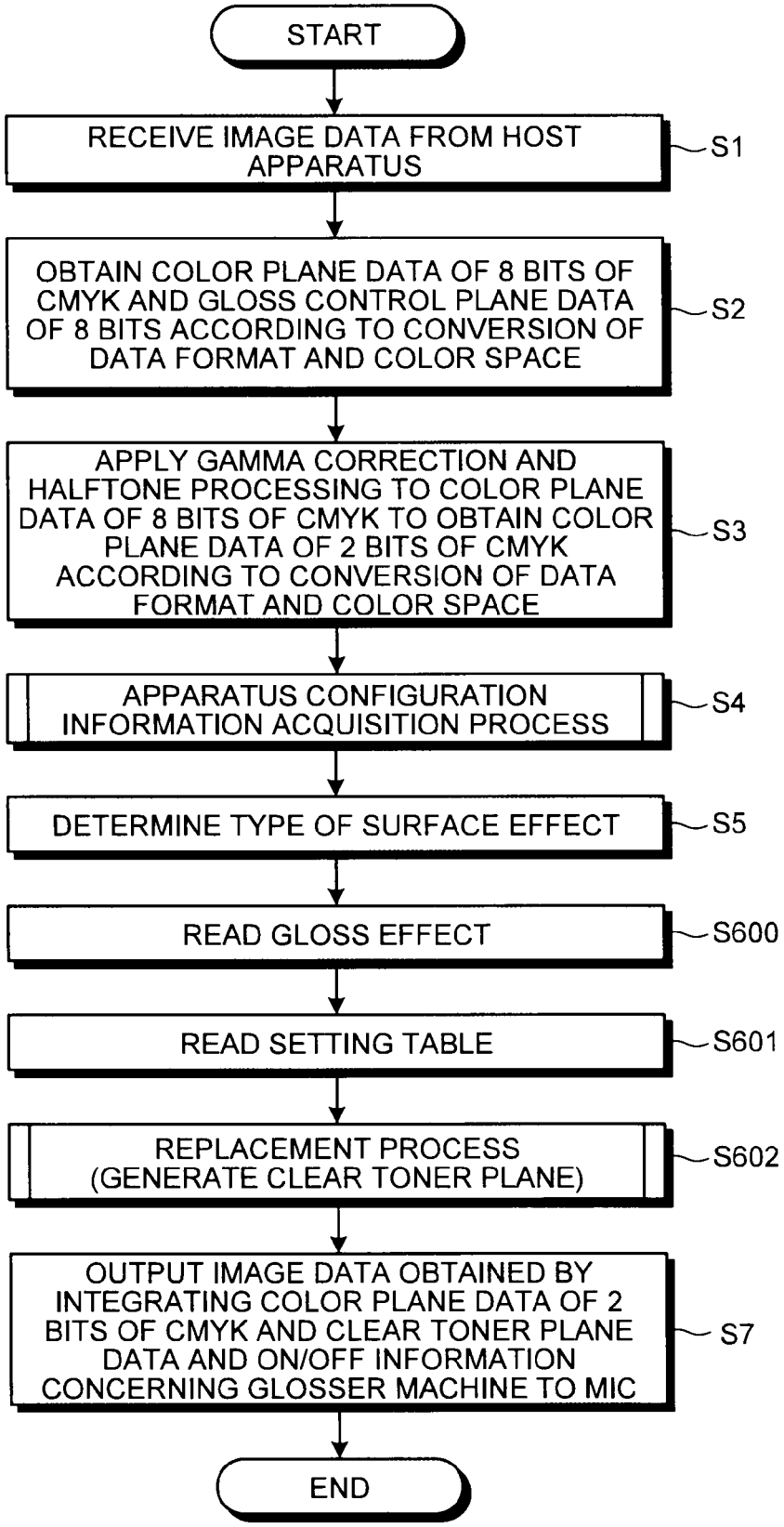
FIG. 22 is a flowchart for explaining a procedure of gloss control process according to the second embodiment.

In the second embodiment, the DFE 500 executes step S1, step S2, step S3, step S4, step S5, step S600, step S601, step S602, and step S7 shown in FIG. 22 in the written order. In FIG. 22, the process at steps S1 to S5 and step S7 has contents same as the contents explained with reference to FIG. 14 in the first embodiment. Therefore, details of the process at steps S600 and S602, which is different from the process in the first embodiment, are explained below.

After performing the process at step S5, the replacing unit 560A of the DFE 500 performs gloss effect reading process (step S600). According to the process at step S600, the replacing unit 560A reads the type preference or the gloss preference.

As explained above, the UI unit 59 is operated by the user and receives user's instruction, and the signal indicating the gloss preference or the type preference is output to the replacing unit 560A of the clear processing 560 via the selection screen 22A. When the replacing unit 560A receives the signal indicating the gloss preference or the type preference, the replacing unit 560A stores the signal in the storing unit 56B. Every time the replacing unit 560A receives the signal from the UI unit 59 anew, the replacing unit 560A overwrites and stores the signal in the storing unit 560B.

In the process at step S600, the replacing unit 560A reads the signal from the storing unit 560B to thereby read the signal indicating the gloss preference or the type preference serving as the gloss effect.

Subsequently, the replacing unit 560A reads, from the storing unit 560B, a setting table corresponding to the apparatus configuration information acquired at step S5 and the gloss effect (the type preference or the gloss preference) read at step S600 (step S601).

The replacing unit 560A then performs, based on the setting table read at step S601, replacement process, i.e., generation of clear toner plane data in which a surface effect of a type difficult to be realized by the apparatus configuration is replaced with a surface effect of a realizable type and setting of ON/OFF of the glosser 80 (step S602).

At step S602, as explained above, when the gloss effect read at step S600 is the signal indicating the gloss preference, the replacing unit 560A performs the replacement process using the setting table corresponding to both of the information indicating ON of the glosser 80 and the apparatus configuration information acquired at step S5. On the other hand, at step S602, when the gloss effect read at step S600 is the signal indicating the type preference, the replacing unit 560A performs the replacement process using the setting table corresponding to both of the information indicating OFF of the glosser 80 and the apparatus configuration information acquired at step S5.

Thereafter, after performing the process at step S7, the replacing unit 560A ends this routine.

Figure 23:
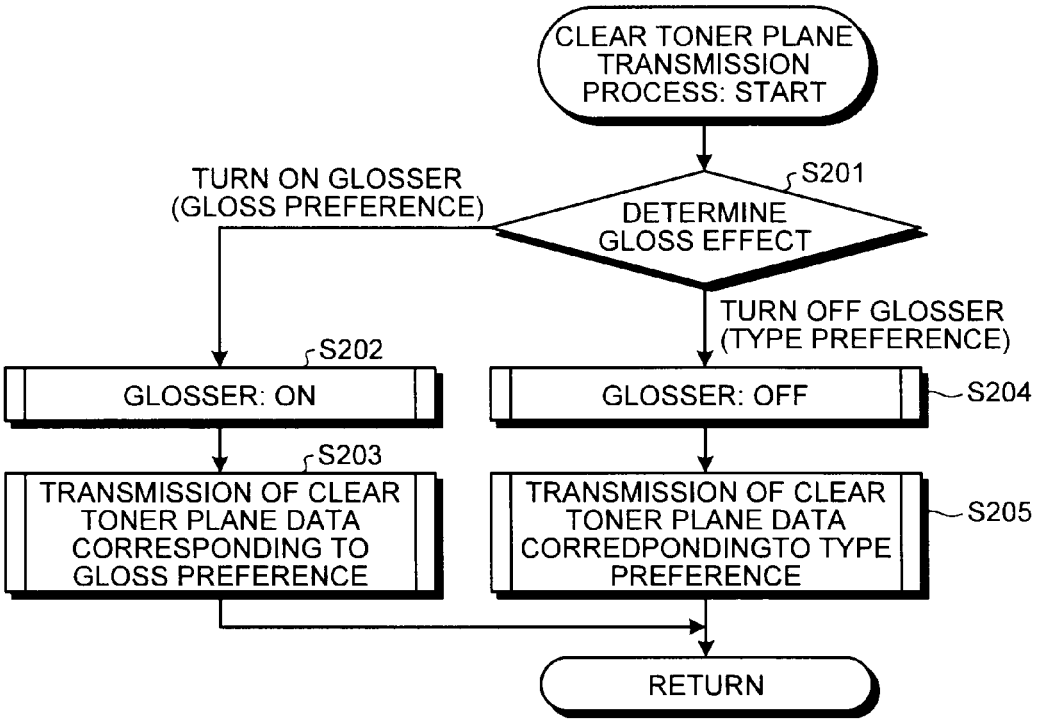
FIG. 23 is a flowchart for explaining a procedure of transmission process performed by an MIC.

Process performed in the MIC 60 is shown in FIG. 23. In FIG. 23, data including the information indicating ON/OFF of the glosser 80 and clear toner plane data are transmitted from the DFE 500 to the printing apparatus 30 mounted with the glosser 80 and at least one of the post-processing machine 90A and the post-processing machine 90B as the post-processing machines 40.

When the data output to the MIC 60 by the process at step S7 (see FIG. 22) is input from the DFE 500, the MIC 60 determines whether the information indicating ON/OFF of the glosser 80 included in the input data is information indicating ON or information indicating OFF (step S201). When the MIC 60 determines that the information is the information indicating ON of the glosser 80 (glosser On (gloss preference) at step S201), the MIC 60 sets the glosser 80 to ON (step S202).

The MIC 60 transmits the clear toner plane data included in the input data to the mounted post-processing machine 40 (at least one of the post-processing machine 90A and the post-processing machine 90B) corresponding to the clear toner plane data (step S203). Then, the MIC 60 ends this routine. According to the process at step S602 (see FIG. 22) by the DFE 500, the clear toner plane data is generated based on the setting table indicating the setting contents for replacing a surface effect of a type difficult to be realized by the apparatus configuration among surface effects of the user designation with a surface effect of a realizable type in a state in which the glosser 80 is turned on. Therefore, the MIC 60 transmits, as the clear toner plane data, clear toner plane data corresponding to the gloss preference to the post-processing machine 40 corresponding to the clear image data.

On the other hand, when the MIC 60 determines at step S201 that the information is the information indicating OFF of the glosser 80 (glosser Off (type preference) at step S201), the MIC 60 turns off the glosser 80 (step S204).

The MIC 60 transmits the clear toner plane data included in the input data to the mounted post-processing machine 40 (at least one of the post-processing machine 90A and the post-processing machine 90B) corresponding to the clear plane toner data (step S205). Then, the MIC 60 ends this routine. According to the process at step S602 (see FIG. 22) by the DFE 500, the clear toner plane data is generated based on the setting table indicating the setting contents for replacing a surface effect of a type difficult to be realized by the apparatus configuration among surface effects of the user designation with a surface effect of a realizable type in a state in which the glosser 80 is turned off. Therefore, the MIC 60 transmits, as the clear toner plane data, clear toner plane data corresponding to the gloss preference to the post-processing machine 40 corresponding to the clear toner plane data.

Details of the gloss control process in this embodiment are explained below with reference to a specific example.

As explained above, when the information indicating only the glosser 80 is input as the apparatus configuration information and the gloss effect set by the user via the UI unit 59 is the "type preference", the replacing unit 560A reads the setting table shown in FIG. 20 as a setting table corresponding to the apparatus configuration information and the gloss effect "type preference". The replacing unit 560A performs the replacement process using the read setting table shown in FIG. 22.

Therefore, the replacing unit 560A performs the replacement process corresponding to the setting table shown in FIG. 22. Consequently, the printing apparatus 30 mounted with only the glosser 80 as the post-processing machine 40 can perform printing in which a surface effect is replaced with a surface effect not including the mirror surface gloss (PG) having higher glossiness based on the apparatus configuration of the post-processing machine 40 and the instruction of the "type preference" (the glosser 80 is turned off) designated by the user.

When information indicating only the glosser 80 is input as the apparatus configuration information and a gloss effect designated by the user via the UI unit 59 is the "gloss preference", the replacing unit 560A reads the setting table shown in FIG. 14 as a setting table corresponding to the apparatus configuration information and the gloss effect "gloss preference". The replacing unit 560A performs the replacement process using the read setting table shown in FIG. 14.

Therefore, the replacing unit 560A performs the replacement process corresponding to the setting table shown in FIG. 14. Consequently, the printing apparatus 30 mounted with only the glosser 80 as the post-processing machine 40 can perform printing in which a surface effect is replaced with a surface effect not including the mirror surface gloss (PG) having higher glossiness based on the apparatus configuration of the post-processing machine 40 and the instruction of the "gloss preference" (the glosser 80 is turned on) designated by the user.

When the information indicating the glosser 80 and the post-processing machine 90B is input as the apparatus configuration information and the gloss effect set by the user via the UI unit 59 is the "type preference", the replacing unit 560A reads the setting table shown in FIG. 21 as a setting table corresponding to the apparatus configuration information and the gloss effect "type preference". The replacing unit 560A performs the replacement process using the read setting table shown in FIG. 21.

The setting table shown in FIG. 21 indicates that, concerning an area where the surface effect of the user designation determined by the gloss control plane data is determined as the PG (mirror surface gloss), the PG is replaced with the G (solid gloss).

Therefore, in the apparatus configuration, when the "type preference" is selected by the user, by using the setting table shown in FIG. 21, it is possible to perform printing in which the surface effect of the user designation is replaced with a surface effect not including the mirror surface gloss (PG) having the highest glossiness.

Therefore, the replacing unit 560A performs the replacement process corresponding to the setting table shown in FIG. 21. Consequently, the printing apparatus 30 mounted with the glosser 80 and the post-processing machine 90B as the post-processing machines 40 can perform printing in which a surface effect is replaced with a surface effect not including the mirror surface gloss (PG) having higher glossiness based on the apparatus configuration of the post-processing machines 40 and the instruction of the "type preference" (the glosser 80 is turned off) designated by the user.

When the information indicating that the glosser 80 and the post-processing machine 90B are mounted is input as the apparatus configuration information and the gloss effect set by the user via the UI unit 59 is the "gloss preference", the replacing unit 560A reads the setting table shown in FIG. 13 as a setting table corresponding to the apparatus configuration information and the gloss effect "gloss preference". The replacing unit 560A performs the replacement process using the read setting table shown in FIG. 13.

Therefore, the replacing unit 560A performs the replacement process corresponding to the setting table shown in FIG. 13. Consequently, the printing apparatus 30 mounted with the glosser 80 and the post-processing machine 90B as the post-processing machines 40 can form an image on a recording medium with, concerning an area where the surface effect of the user designation is determined as the G (gloss matt), the G (solid gloss) replaced with the PG (mirror surface gloss) and, concerning an area where the surface effect of the user designation is determined as the M (halftone dot matt), the type of the surface effect replaced with the PM (matt) based on the apparatus configuration of the post-processing machine 40 and the instruction of the "gloss preference" (the glosser 80 is turned on) designated by the user.

Therefore, in the second embodiment, it is possible to replace, based on the apparatus configuration information indicating the apparatus configuration of the printing apparatus 30 (the post-processing machines 40), a surface effect of a type difficult to be realized in the printing apparatus 30 with a surface effect of a type realizable by the printing apparatus 30 according to an instruction indicating the type preference or the gloss preference pointed by the user.

Third Embodiment

Next, a third embodiment will be explained. In some case, components common to the first embodiment are explained using the same reference numerals and signs or explanation of the components is omitted.

In the explanation in the first embodiment, the conveying path 20 provided in the printing apparatus 30 is provided to convey, in the written order, a recording medium to the position where the printer machine 70 is provided and the positions where the post-processing machines 40 are provided and then discharge the recording medium to the outside of the printing apparatus 30.

On the other hand, in the third embodiment, the conveying path 20 includes two conveying paths: a conveying path 20A and a conveying path 20B. The conveying path 20A is a conveying path for conveying, in written order, the recording medium to the position where the printer machine 70 is provided and the positions where the post-processing machines 40 are provided. The conveying path 20B is a conveying path for conveying the recording medium in the opposite direction of a conveying direction of the recording medium by the conveying path 20A and returning the recording medium, which has passed the post-processing machines 40, to a further upstream side (upstream side in the conveying direction by the conveying path 20A) than the printer machine 70 again.

In the third embodiment, when it is difficult to realize a surface effect of a type designated by the user only by conveying the recording medium from the printer machine 70 to the post-processing machines 40 once depending on the apparatus configuration of the post-processing machines 40, the recording medium is repeatedly conveyed from the printer machine 70 to the post-processing machines 40 a plurality of times. Printing is performed based on the information indicating ON/OFF of the glosser 80 set for each number of times of conveyance and clear toner plane data.

Figure 24:
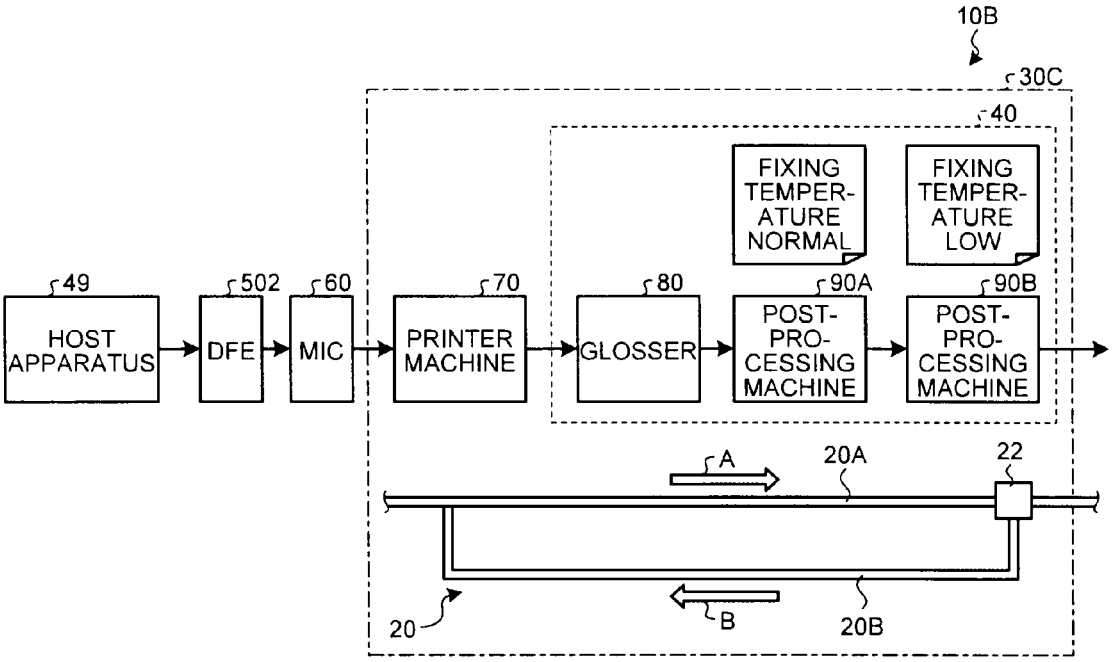
FIG. 24 is a diagram of an example of the configuration of an image forming system according to a third embodiment.
Figure 25:
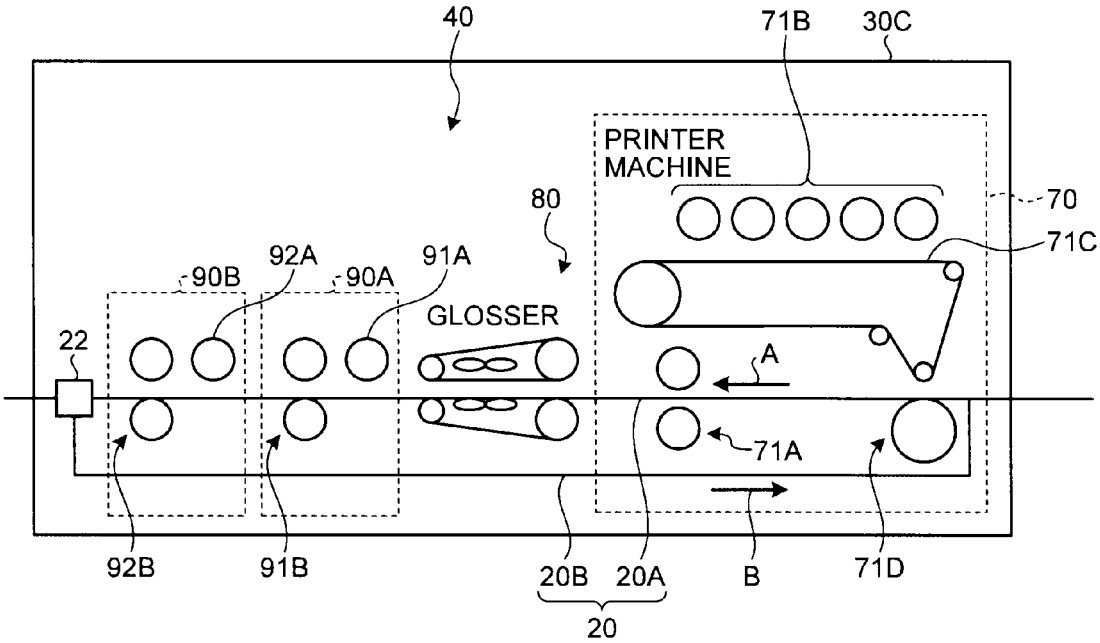
FIG. 25 is a schematic diagram of the configuration of a printing apparatus.

In FIG. 24, an image forming system 10B according to the third embodiment is schematically shown. In FIG. 25, the configuration of a printing apparatus 30C in the third embodiment is schematically shown.

The image forming system 10B according to the third embodiment includes a DFE 502 and the printing apparatus 30C. The printing apparatus 30C is configured by connecting the MIC 60, the printer machine 70, and the post-processing machines 40. Further, the conveying path 20 is provided in the printing apparatus 30C.

The conveying path 20 includes the conveying path 20A, the conveying path 20B, and a switching unit 22. The conveying path 20A conveys the a printing medium from the printer machine 70 side to the post-processing machine 40 side in a direction of this order (see an arrow A direction in FIGS. 24 and 25). The conveying path 20B conveys the recording medium in the opposite direction of the arrow A direction (an arrow B direction in FIGS. 24 and 25). Specifically, the conveying path 20B diverts the recording medium, which has passed the post-processing machines 40 by being conveyed on the conveying path 20A, from the conveying path 20A, conveys the recording medium in the opposite direction (the arrow B direction), and supplies the recording medium to a further upstream side in the arrow A direction than the printer machine 70 in the conveying path 20A.

The conveying path 20A of the conveying path 20A and the conveying path 20B is provided to sequentially convey the recording medium to areas where various kinds of processes (printing, fixing, etc.) are performed by the processing apparatuses including the printer machine 70 and the post-processing machines 40 provided in the printing apparatus 30C. On the other hand, the conveying path 20B is provided to convey the recording medium to areas where the kinds of processes by the processing apparatuses including the printer machine 70 and the post-processing machine 40 are not performed.

Therefore, when the recording medium is conveyed on the conveying path 20A, the recording medium is in a state in which the various kinds of processes can be performed by the printer machine 70 and the post-processing machines 40. When the recording medium is conveyed on the conveying path 20B, the various kinds of processes are not performed.

In the conveying path 20A, a not-shown conveying member is provided to convey the recording medium on the conveying path 20A in the arrow A direction. Similarly, in the conveying path 20B, a not-shown conveying member is provided to convey the recording medium on the conveying path 20B in the arrow B direction.

The switching unit 22 is provided in the conveying path 20. The switching unit 22 switches the conveying path 20 to a state in which the recording medium, which is conveyed on the conveying path 20, to a state in which the recording medium is conveyed on the conveying path 20A and then discharged to the outside of the printing apparatus 30C or a state in which the recording medium, which is conveyed on the conveying path 20A and has passed the post-processing machines 40, is conveyed on the conveying path 20B and returned to the conveying path 20A again. The switching unit 22 is electrically connected to the MIC 60 and performs the switching according to a signal input from the MIC 60.

Figure 26:
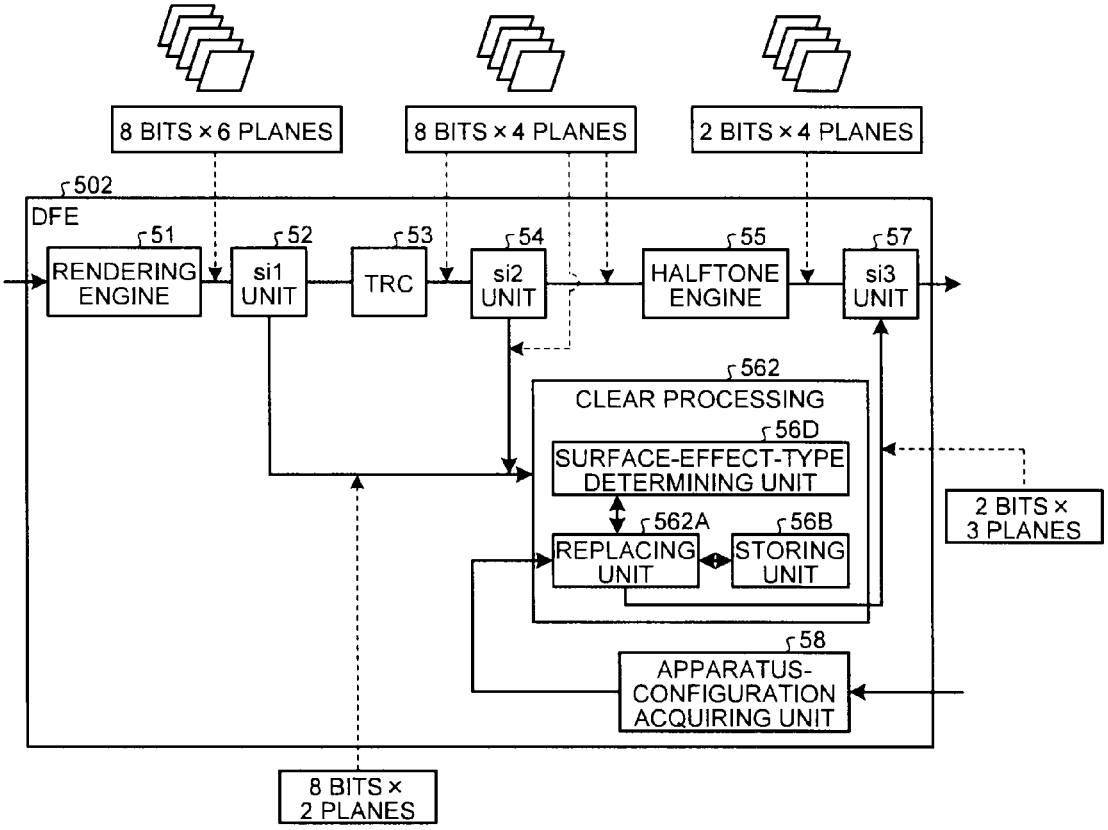
FIG. 26 is a diagram of an example of a functional configuration of a DFE according to the third embodiment.

In FIG. 26, the configuration of the DFE 502 in the image forming system 10B according to the third embodiment is shown.

The image forming system according to the third embodiment has the same configuration as the first embodiment except that the DFE 502 shown in FIG. 26 is used instead of the DFE 50 shown in FIG. 1 explained in the first embodiment and the conveying path 20A, the conveying path 20B, and the switching unit 22 are provided as the conveying path 20. Therefore, members having the same functions as the members explained in the first embodiment are denoted by the same reference numerals and signs and detailed explanation of the members is omitted.

The DFE 502 includes, as a hardware configuration, a control unit such as a CPU that controls the entire apparatus, main storing units such as a ROM and a RAM that store various data and various computer programs, and an auxiliary storing unit such as a HDD that stores various data and various computer programs. The DFE 502 has a hardware configuration including a normal computer.

As a functional configuration, as shown in FIG. 26, the DFE 502 includes the rendering engine 51, the si1 unit 52, the TRC 53, the si2 unit 54, the halftone engine 55, the si3 unit 57, the apparatus-configuration acquiring unit 58, and a clear processing 562. The clear processing 562 includes the surface-effect-type determining unit 56D, the storing unit 560B, and a replacing unit 562A.

The DFE 502 has the same configuration as the DFE 50 in the first embodiment except that the DFE 502 includes the clear processing 562 instead of the clear processing 56 shown in FIG. 7. The clear processing 562 has the same configuration as the clear processing 56 except that the clear processing 562 includes the replacing unit 562A instead of the replacing unit 56A shown in FIG. 7. Therefore, components having the same configurations and the same functions as the components explained in the first embodiment are denoted by the same reference numerals and signs and explanation of the components is omitted.

As in the first embodiment, the storing unit 56B stores therein surface effect selection tables and setting tables.

In the first embodiment, the setting table holds, according to the apparatus configuration of the post-processing machines 40, setting contents for replacing a surface effect of a type difficult to be realized by the apparatus configuration among surface effects of the user designation with a surface effect of a realizable type. As the setting contents, the setting table holds the clear toner plane data used in the printer machine 70, the clear toner plane data used in the post-processing machine 90A, the clear toner plane data used in the post-processing machine 90B, and the ON/OFF information indicating ON/OFF of the glosser 80.

In the third embodiment, as the setting contents, the setting table further holds number-of-times information indicating how many times a recording medium is reciprocatingly moved on the conveying path 20 and setting contents corresponding to the numbers of times (the clear toner plane data used in the printer machine 70, the clear toner plane data used in the post-processing machine 90A, the clear toner plane data used in the post-processing machine 90B, and the ON/OFF information indicating ON/OFF of the glosser 80).

Specifically, the setting table in the third embodiment is stored in the storing unit 56B to correspond to the apparatus configuration information indicating the apparatus configuration of the post-processing machines 40. In the setting table, setting contents (ON/OFF of the glosser 80 and clear toner plane data) for each number of times of conveyance of the recording medium on the conveying path 20 are stored.

Figure 27:
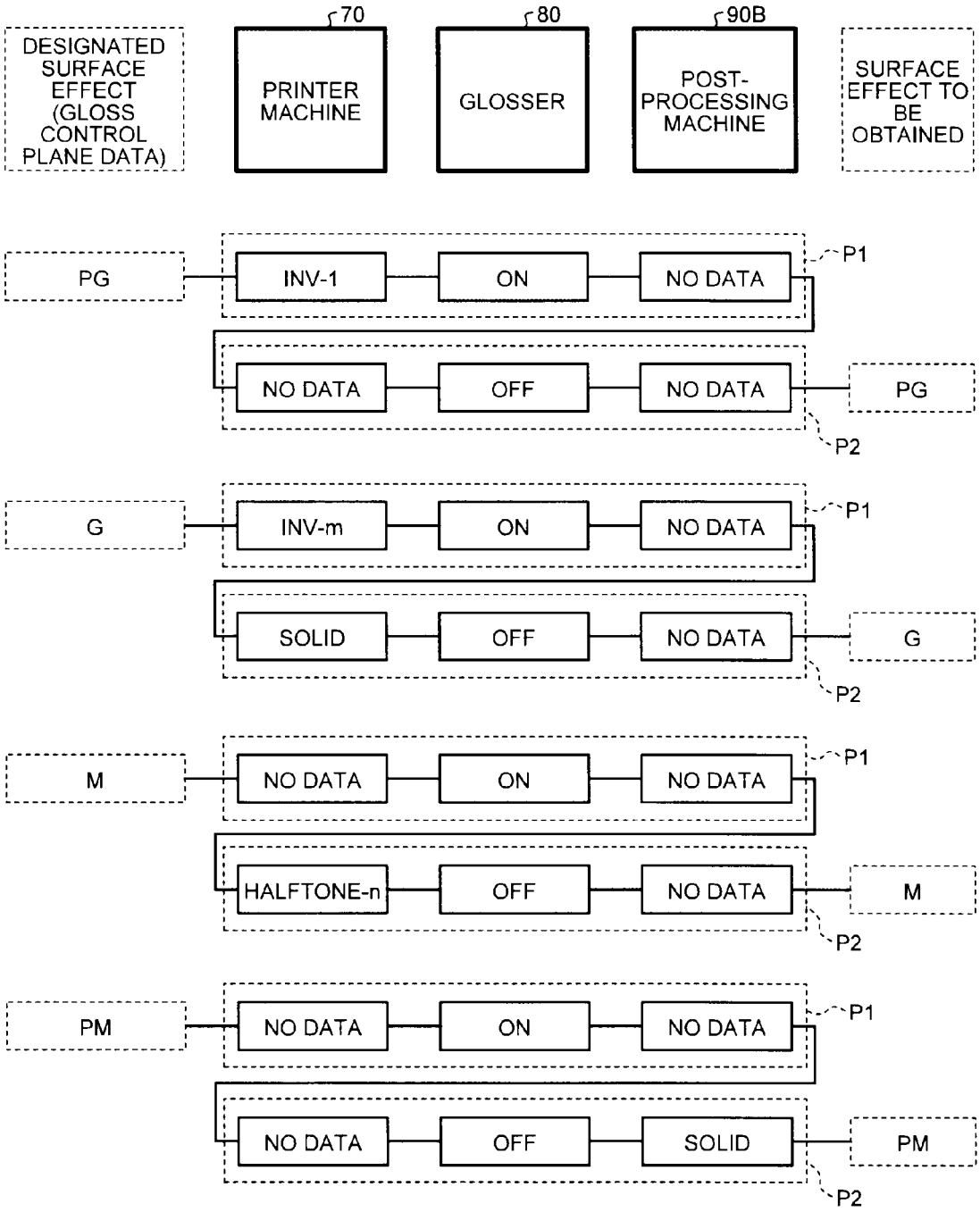
FIG. 27 is a diagram of an example of a data structure of a setting table.

In FIG. 27, as an example, a setting table corresponding to apparatus configuration information indicating an apparatus configuration in which the post-processing machine 90A among the post-processing machines 40 (the glosser 80, the post-processing machine 90A, and the post-processing machine 90B) is not mounted is shown as an example.

In the setting table shown in FIG. 27, information indicating two times as the number of times of conveyance is stored as the number of times of conveyance for realizing surface effects (see P1 and P2 in FIG. 27). Setting contents corresponding to numbers of times are shown to realize surface effects of the user designation.

Specifically, the setting table shown in FIG. 27 indicates that, concerning an area where the surface effect of the user designation is the PG (mirror surface gloss), for first conveyance of a recording medium (see P1), the clear toner plane data used in the printer machine 70 is set to "INV-1", the glosser 80 is turned on, and the clear toner plane data used in the post-processing machine 90B is set to "no data". The setting table indicates that, concerning the area, for second conveyance of the recording medium (see P2), the clear toner plane data used in the printer machine 70 is set to "no data", the glosser 80 is turned off, and the clear toner plane data used in the post-processing machine 90B is set to "no data". The setting table indicates that, by setting the ON/OFF setting of the glosser 80 and the clear toner plane data to the contents explained above for the first conveyance and for the second conveyance of the recording medium in this way, concerning the PG (mirror gloss), which is the surface effect of the user designation, the PG (mirror surface gloss) is obtained.

Similarly, the setting table shown in FIG. 27 indicates that, concerning an area where the surface effect of the user designation is the G (solid gloss), for the first conveyance of the recording medium (see P1), the clear toner plane data used in the printer machine 70 is set to "INV-m", the glosser 80 is turned on, and the clear toner plane data used in the post-processing machine 90B is set to "no data". The setting table indicates that, concerning the area, for the second conveyance of the recording medium (see P2), the clear toner plane data used in the printer machine 70 is set to "solid", the glosser 80 is turned off, and the clear toner plane data used in the post-processing machine 90B is set to "no data". The setting table indicates that, by setting the ON/OFF setting of the glosser 80 and the clear toner plane data to the contents explained above for the first conveyance and for the second conveyance of the recording medium in this way, concerning the G (solid gloss), which is the surface effect of the user designation, the G (solid gloss) is obtained.

Similarly, the setting table shown in FIG. 27 indicates that, concerning an area where the surface effect of the user designation is the M (halftone dot matt), for the first conveyance of the recording medium (see P1), the clear toner plane data used in the printer machine 70 is set to "no data", the glosser 80 is turned on, and the clear toner plane data used in the post-processing machine 90B is set to "no data". The setting table indicates that, concerning the area, for the second conveyance of the recording medium (see P2), the clear toner plane data used in the printer machine 70 is set to "halftone-n", the glosser 80 is turned off, and the clear toner plane data used in the post-processing machine 90B is set to "no data". The setting table indicates that, by setting the ON/OFF setting of the glosser 80 and the clear toner plane data to the contents explained above for the first conveyance and for the second conveyance of the recording medium in this way, concerning the M (halftone dot matt), which is the surface effect of the user designation, the M (halftone dot matt) is obtained.

Similarly, the setting table shown in FIG. 27 indicates that, concerning an area where the surface effect of the user designation is the PM (matt), for the first conveyance of the recording medium (see P1), the clear toner plane data used in the printer machine 70 is set to "no data", the glosser 80 is turned on, and the clear toner plane data used in the post-processing machine 90B is set to "no data". The setting table indicates that, concerning the area, for the second conveyance of the recording medium (see P2), the clear toner plane data used in the printer machine 70 is set to "no data", the glosser 80 is turned off, and the clear toner plane data used in the post-processing machine 90B is set to "solid". The setting table indicates that, by setting the ON/OFF setting of the glosser 80 and the clear toner plane data to the contents explained above for the first conveyance and for the second conveyance of the recording medium in this way, concerning the surface effect PM (matt), which is the surface effect of the user designation, the PM (matt) is obtained.

The setting table shown in FIG. 27 is an example. Alternatively, setting tables shown in FIGS. 28 and 29 may be used as the setting table corresponding to the apparatus configuration information indicating the apparatus configuration in which the post-processing machine 90A among the post-processing machines 40 (the glosser 80, the post-processing machine 90A, and the post-processing machine 90B) is not mounted. Any one of the setting tables (shown in FIGS. 27 to 29) only has to be stored in the storing unit 56B in association with the apparatus configuration information indicating the apparatus configuration in which the post-processing machine 90A is not mounted.

Figure 28:
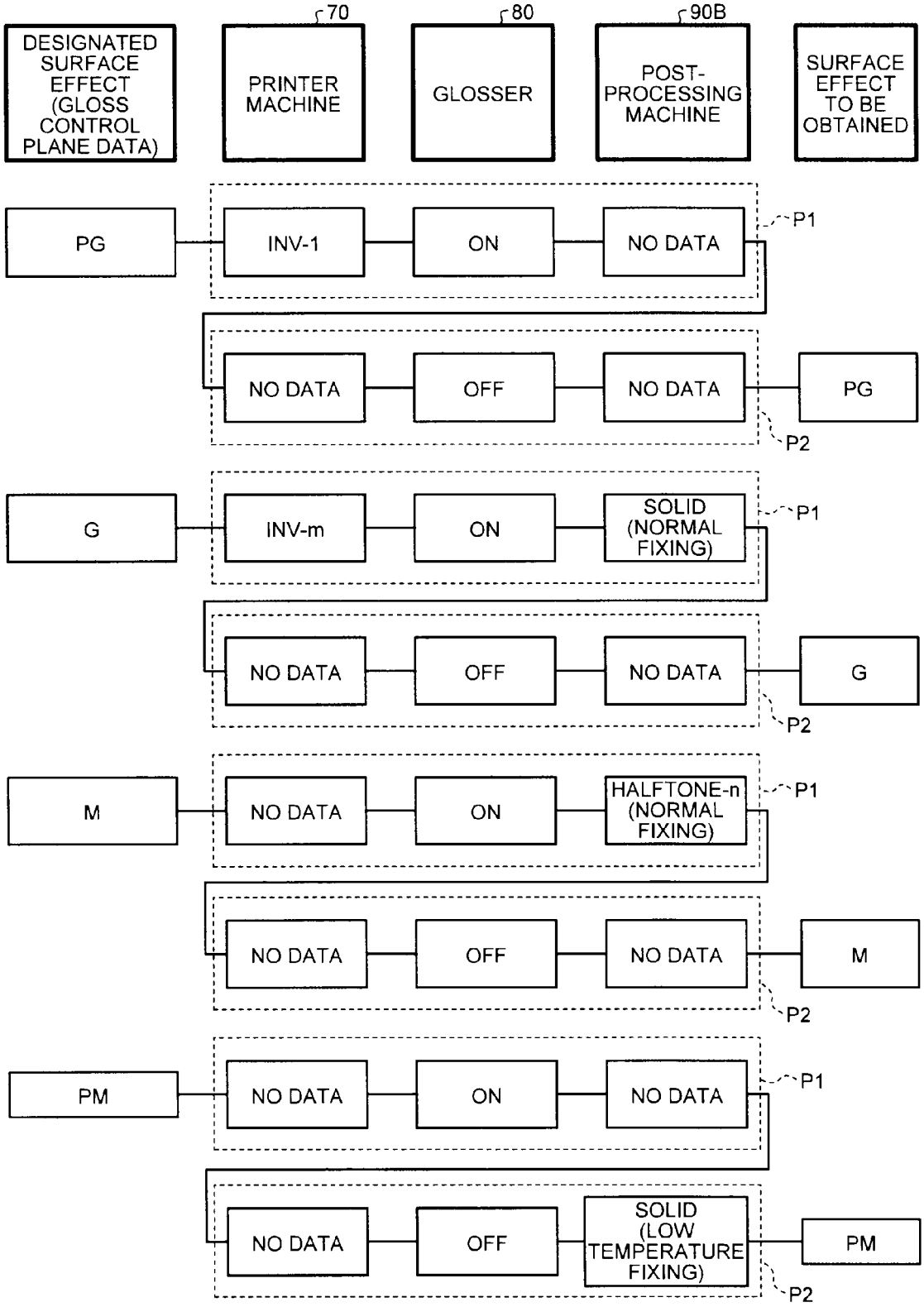
FIG. 28 is a diagram of an example of a data structure of a setting table.

Like the setting table shown in FIG. 27, the setting table shown in FIG. 28 is a setting table corresponding to the apparatus configuration information indicating the apparatus configuration in which the post-processing machine 90A is not mounted. However, the setting table shown in FIG. 28 is a setting table used when fixing temperature of the post-processing machine 90B mounted with a low-temperature fixing machine as a fixing machine provided as the post-processing machine 40 can be switched by a control signal input from the MIC 60. The setting table shown in FIG. 28 is explained later.

Figure 29:
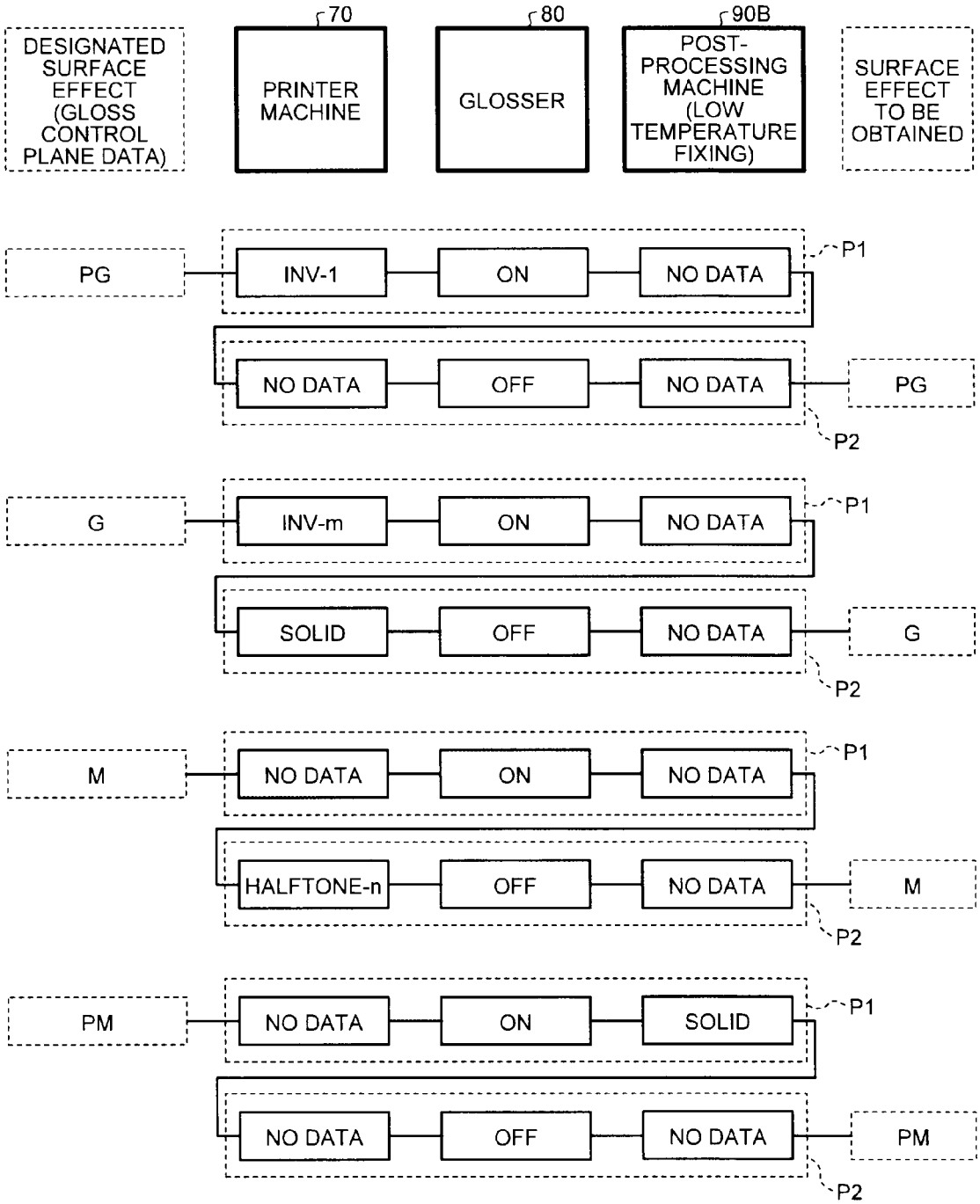
FIG. 29 is a diagram of an example of a data structure of a setting table.

Like the setting table shown in FIG. 27, the setting table shown in FIG. 29 is a setting table corresponding to the apparatus configuration information indicating the apparatus configuration in which the post-processing machine 90A is not mounted. In the setting table shown in FIG. 29, the clear toner plane data used in the post-processing machine 90B with respect to the surface effect PM (matt) designated by the user is set opposite to that shown in FIG. 27 in the first conveyance and the second conveyance.

Like the replacing unit 56A in the first embodiment, the replacing unit 562A replaces, based on a setting table corresponding to apparatus configuration information, a type of a surface effect of user designation received from the surface-effect-type determining unit 56D with a surface effect of a type realizable by the printing apparatus 30. However, the setting table in the third embodiment is used as the setting table used during this replacement process.

A procedure of gloss control process performed by the image forming system according to the third embodiment is explained with reference to FIG. 30.

Figure 30:
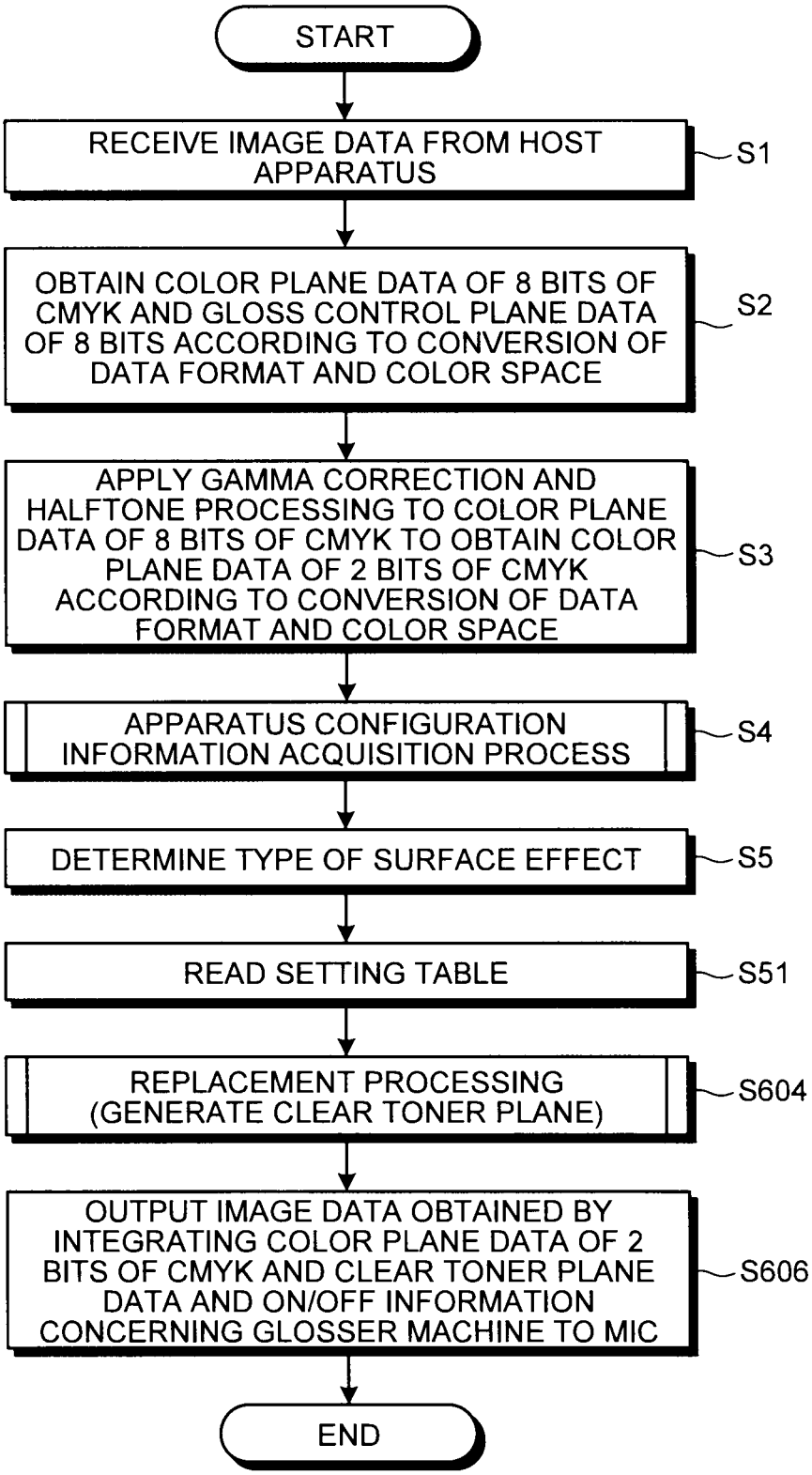
FIG. 30 is a flowchart for explaining a procedure of gloss control process according to the third embodiment.

In the third embodiment, the DFE 502 executes step S1, step S2, step S3, step S4, step S5, step S51, step S604, and step S606 shown in FIG. 30 in the written order. In FIG. 30, the process at steps S1 to S51 has contents same as the contents explained with reference to FIG. 15 in the first embodiment.

After performing the process at step S51, the replacing unit 562A of the DFE 502 performs replacement process (step S604). This replacement process is the same as the process at step S6 (see FIG. 15) explained in the first embodiment except that the setting table in the third embodiment is used.

Specifically, the replacing unit 562A reads, from the storing unit 56B, a setting table corresponding to the apparatus configuration information acquired at step S4. The replacing unit 562A reads, for each of the types of the surface effects of the user designation acquired at step S5 and for each number of times of conveyance, setting (ON/OFF of the glosser 80 and clear toner plane data) corresponding to each of the apparatuses (at least one of the printer machine 70, the glosser 80, the post-processing machine 90A, and the post-processing machine 90B) in the read setting table. The replacing unit 562A performs creation of clear toner plane data for each of the mounted post-processing machines 40 and setting of ON/OFF of the glosser 80.

For example, it is assumed that apparatus configuration information indicating mounting of the glosser 80 and the post-processing machine 90B is acquired as the apparatus configuration information at step S4. It is further assumed that the setting table shown in FIG. 27 is stored in the storing unit 56B as a setting table corresponding to the apparatus configuration information.

In this case, the information indicating ON/OFF of the glosser 80 set in the first conveyance (see P1 in FIG. 27) shown in the read setting table is ON, the replacing unit 562A sets the glosser 80 to ON as information corresponding to the first conveyance.

As the clear toner plane data used in the printer machine 70 corresponding to the first conveyance, the replacing unit 562A generates clear toner plane data of "INV-1" concerning an area where the surface effect of the user designation is the mirror surface gloss (PG) and generate clear image data of "INV-m" concerning an area where the surface effect of the user designation is the solid gloss (G). The replacing unit 562A sets "no data" concerning areas where the surface effect of the user designation is the halftone dot matt (M) and the matt (PM). In this way, the replacing unit 562A creates the clear toner plane data used in the printer machine 70 (clear toner plane data of 2 bits) corresponding to the first conveyance.

Similarly, the replacing unit 562A creates the clear toner plane data used in the post-processing machine 90B corresponding to the first conveyance. Specifically, as the clear toner plane data used in the post-processing machine 90B corresponding to the first conveyance, the replacing unit 562A sets "no data" concerning all areas where the surface effect of the user designation is the mirror surface gloss (PG), the solid gloss (G), the halftone dot matt (M), and the matt (PM). In other words, the replacing unit 562A does not create clear toner plane data.

The information indicating ON/OFF of the glosser 80 set for the second conveyance (see P2 in FIG. 27) shown in the read setting table is OFF, and therefore, the replacing unit 562A sets the glosser 80 to OFF as information corresponding to the second conveyance.

As the clear toner plane data used in the printer machine 70 corresponding to the second conveyance, the replacing unit 562A sets "no data" concerning an area where the surface effect of the user designation is the mirror surface gloss (PG). The replacing unit 562A generates clear toner plane data of "solid" concerning an area where the surface effect of the user designation is the solid gloss (G). Concerning an area where the surface effect of the user designation is the halftone dot matt (M), the replacing unit 562A generates clear toner plane data of "halftone-n". The replacing unit 562A sets "no data" concerning an area where the surface effect of the user designation is the matt (PM). In this way, the replacing unit 562A creates the clear toner plane data used in the printer machine 70 (clear toner plane data of 2 bits) corresponding to the second conveyance.

Similarly, the replacing unit 562A creates the clear toner plane data used in the post-processing machine 90B corresponding to the second conveyance. Specifically, as the clear toner plane data used in the post-processing machine 90B corresponding to the second conveyance, the replacing unit 562A sets "no data" concerning areas where the surface effect of the user designation is the mirror surface gloss (PG), the solid gloss (G), and the halftone dot matt (M). In other words, the replacing unit 562A does not create clear toner plane data. Concerning an area where the surface effect of the user designation is the matt (PM), the replacing unit 562A sets the clear toner plane data used in the post-processing machine 90B to "solid". In this way, the replacing unit 562A creates the clear toner plane data used in the post-processing machine 90B (clear toner plane data of 2 bits) corresponding to the second conveyance.

Referring back to FIG. 30, the DFE 50 then outputs information indicating a total number of times of conveyance set at step S604 to the MIC 60. Specifically, when the process at step S604 is performed using the setting table shown in FIG. 27, the DFE 50 outputs information indicating the number of times of conveyance "2" to the MIC 60. The DFE 502 integrates the color plane data of 2 bits each of CMYK after the halftone processing obtained at step S3 and the clear toner plane data of 2 bits corresponding to the first conveyance generated for the printer machine 70 at step S604. The DFE 502 outputs the integrated image data, information indicating the printer machine 70, and information indicating the first conveyance to the MIC 60 in association with one another. The DFE 502 outputs the clear toner plane data corresponding to the first conveyance generated for the post-processing machine 90B at step S604, information indicating the post-processing machine 90B, and the information indicating the first conveyance to the MIC 60 in association with one another. The DFE 50 outputs ON/OFF information indicating ON or OFF of the glosser 80 corresponding to the first conveyance set at step S604 to the MIC 60 in association with the information indicating the first conveyance. Further, the DFE 50 outputs the clear toner plane data of 2 bits corresponding to the second conveyance generated at step S604, information indicating the second conveyance, and information indicating the printer machine 70 or the post-processing machine 90B corresponding to the second conveyance to the MIC 60 in association with one another. The DFE 502 outputs ON/OFF information indicating ON or OFF of the glosser 80 corresponding to the second conveyance set at step S604 to the MIC 60 in association with the information indicating the second conveyance (step S606). Thereafter, the DFE 502 ends this routine.

When the replacing unit 562A creates data corresponding to third or subsequent conveyance at step S604, in the process at step S606, the DFE 502 outputs data corresponding to the numbers of times of conveyance to the MIC 60 in the same manner as explained above.

The MIC 60 performs process explained below based on data output from the DFE 502 according to the process at step S606.

Figure 31:
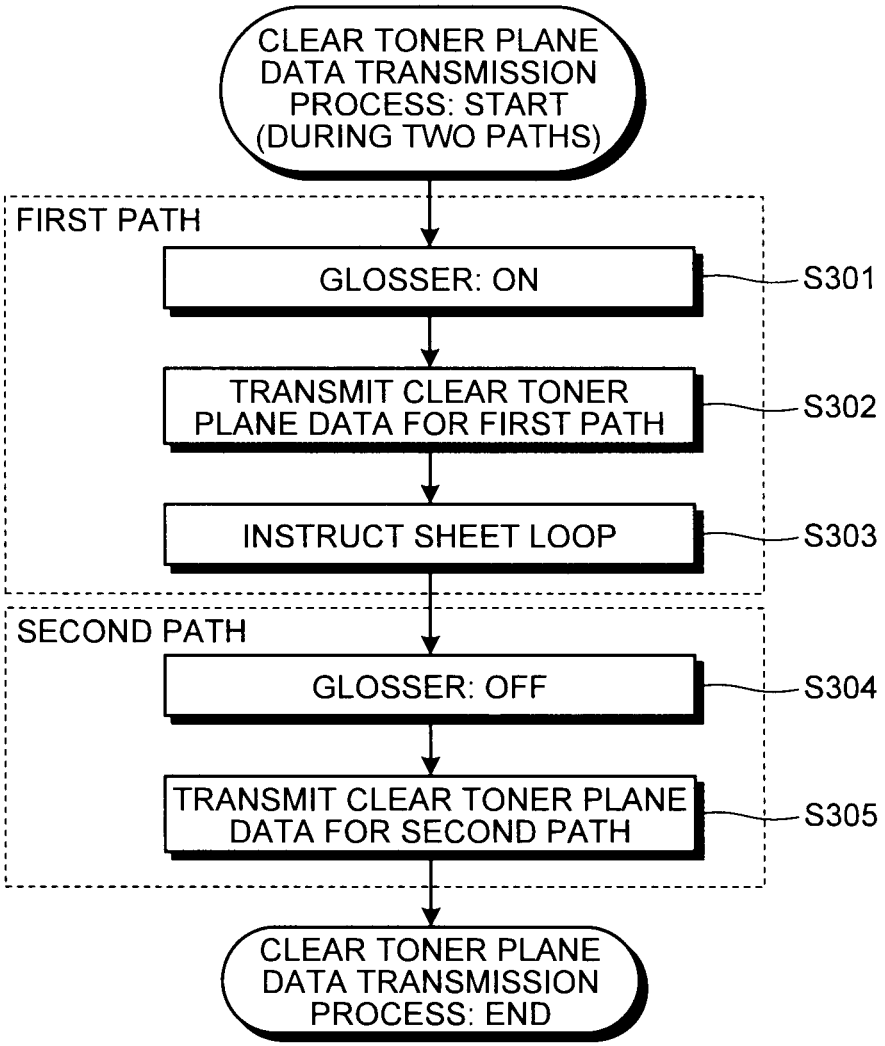
FIG. 31 is a flowchart for explaining a procedure of transmission process performed by an MIC.

Specific process performed in the MIC 60 in the third embodiment is shown in FIG. 31. In FIG. 31, an example of process by the MIC 60 performed when process based on the setting table shown in FIG. 24 (i.e., creation and setting of data for two times of conveyance) is performed at step S604 is shown.

As shown in FIG. 31, first, the MIC 60 reads information indicating the number of times of conveyance included in the data output from the DFE 502. The MIC 60 performs process in the first conveyance (see a first path in FIG. 31).

Specifically, the MIC 60 performs setting of the glosser 80 based on the information indicating ON/OFF of the glosser 80 corresponding to the first conveyance. As explained above, because the setting of the glosser 80 corresponding to the first conveyance is ON, the MIC 60 sets the glosser 80 to ON (step S301).

Subsequently, the MIC 60 transmits image data and clear toner plane data corresponding to the information indicating the first conveyance included in the data output from the DFE 502 to the printer machine 70 and the post-processing machine 40 corresponding to the data (step S302).

Specifically, the MIC 60 outputs, to the printer machine 70, the integrated image data (the image data obtained by integrating the color plane data of 2 bits each of CMYK after the halftone processing obtained at step S3 and the clear toner plane data of 2 bits corresponding to the first conveyance) associated with the information indicating the first conveyance and the printer machine 70 included in the data output from the DFE 502. The MIC 60 outputs, to the post-processing machine 90B, the clear toner plane data associated with the information indicating the first conveyance and the post-processing machine 90B.

The printer machine 70 emits light beam from the exposing device using color plane data of CMYK and clear toner plane data output from the MIC 60, forms, on the photosensitive members, toner images corresponding to the toners, and transfers the toner images to a recording medium. Consequently, the clear toner is deposited on the recording medium in addition to the toners of CMYK and an image is formed on the recording medium.

Thereafter, the recording medium is conveyed along the conveying path 20A (in the arrow A direction in FIGS. 24 and 25) and reaches the position of the glosser 80. When the glosser 80 is ON, the glosser 80 re-fixes the toner images on the recording medium.

Further, when the recording medium is conveyed along the conveying path 20A and reaches the position of the post-processing machine 90B, the post-processing machine 90B performs fixing process corresponding to the clear toner plane data received from the MIC 60.

Subsequently, the MIC 60 outputs a signal indicating a sheet loop instruction to the switching unit 22 (step S303). The sheet loop instruction indicates an instruction for conveying the recording medium to the conveying path 20A again. The MIC 60 performs this process when the information indicating the number of times of conveyance included in the data received from the DFE 502 is equal to or larger than two.

The switching unit 22 receives the signal indicating the sheet loop instruction. The switching unit 22 conveys the recording medium, which is conveyed on the conveying path 20A and has passed the positions where the post-processing machines 40 are provided (i.e., subjected to processing by all the apparatuses mounted as the post-processing machines 40), in the arrow B direction via the conveying path 20B. The switching unit 22 conveys the recording medium to a further upstream side than the printer machine 70 in the conveying direction (the arrow A direction) in the conveying path 20A. Specifically, the switching unit 22 controls the not-shown conveying members provided along the conveying path 20A and the conveying path 20B such that the conveyance is performed.

Consequently, the recording medium is returned such that the recording medium subjected to the process by the printer machine 70 and the post-processing machines 40 is processed by the printer machine 70 and the post-processing machines 40 again.

The MIC 60 then performs a process corresponding to the second conveyance (in FIG. 31, see the second path).

Specifically, the MIC 60 sets the glosser 80 to OFF based on information indicating ON/OFF of the glosser 80 corresponding to the second conveyance included in the data output from the DFE 502 (step S304).

The MIC 60 transmits clear toner plane data corresponding to information indicating the second conveyance included in the data output from the DFE 502 to the printer machine 70 and the post-processing machines 40 corresponding to the clear toner plane data (step S305).

Specifically, the MIC 60 outputs, to the printer machine 70, clear toner plane data associated with the information indicating the second conveyance and the printer machine 70 included in the data output from the DFE 502. The MIC 60 outputs, to the post-processing machine 90B, clear toner plane information associated with the information indicating the second conveyance and the post-processing machine 90B included in the data output from the DFE 502.

The printer machine 70 emits, using the clear toner plane data output from the MIC 60, light beam from the exposing device to form a toner image corresponding to the clear toner and transfers the toner image on to the recording medium. Consequently, the clear toner is transferred onto the recording medium subjected to the various kinds of image formation and the glossing process corresponding to the first conveyance according to the first conveyance.

Thereafter, the recording medium is conveyed along the conveying path 20A (in FIGS. 24 and 25, in the arrow A direction) and reaches the position of the glosser 80. When the glosser 80 is off, heating and pressing processes by the glosser 80 is not performed. The recording medium is further conveyed to the post-processing machine 90B.

When the recording medium is conveyed along the conveying path 20A and reaches the position of the post-processing machine 90B, the post-processing machine 90B performs fixing process corresponding to the clear toner plane data received from the MIC 60.

In this way, in the image forming system according to the third embodiment, depending on the apparatus configuration of the post-processing machines 40, when it is difficult to realize a surface effect of a type designated by the user only by conveying the recording medium from the printer machine 70 to the post-processing machines 40 once, the recording medium is repeatedly conveyed from the printer machine 70 to the post-processing machines 40 a plurality of times. Formation of an image on which the CMYK toners and the clear toner are deposited, formation of a toner image by the clear toner, and re-fixing by the glosser 80 are performed based on the information indicating ON/OFF of the glosser 80 and clear toner plane data set for each number of times of conveyance.

Therefore, even when a part of the post-processing machines are not mounted, it is possible to impart, without causing the user trouble, the surface effect by the clear toner to a recording medium on which an image is formed.

In the third embodiment, a change of fixing temperature in the fixing machine provided in the post-processing machine 90B is not performed. However, the printing apparatus 30C may include the post-processing machine 90B including a fixing machine that can switch the fixing temperature. In this case, the DFE 502 may perform the gloss control process using a setting table including information indicating the fixing temperature by the fixing machine provided in the post-processing machine 90B.

Referring back to FIG. 28, an overview of the setting table shown in FIG. 28 is explained. Like the setting table shown in FIG. 27, the setting table shown in FIG. 28 is a setting table corresponding to the apparatus configuration information indicating the apparatus configuration in which the post-processing machine 90A is not mounted. The setting table shown in FIG. 28 is a setting table used when the fixing temperature of the post-processing machine 90B mounted with a low-temperature fixing machine as the fixing machine may be changed in accordance with a control signal input from the MIC 60.

Specifically, in the setting table shown in FIG. 28, concerning an area where the surface effect of the user designation is the PG (mirror surface gloss) and an area where the surface effect of the user designation is the PM (matt), setting is the same as the setting shown in FIG. 24. However, the setting table shown in FIG. 28 indicates that, when the surface effect of the user designation is the G (solid gloss), clear toner plane data used in the post-processing machine 90B for the first conveyance of the recording medium (see P1) is set to "solid" and the fixing temperature in the fixing machine mounted on the post-processing machine 90B is set to the normal temperature. The setting table shown in FIG. 28 indicates that, when the surface effect of the user designation is the M (halftone dot matt), the clear toner plane data used in the post-processing machine 90B for the first conveyance in the transfer (see P1) is set to "halftone-n" and the fixing temperature in the fixing machine in the post-processing machine 90B is set to the normal temperature.

Therefore, in a configuration in which the fixing temperature of the fixing machine mounted on the post-processing machine 90B can be changed, the replacing unit 562A of the DFE 502 only has to perform generation of clear toner plane data and setting of ON/OFF of the glosser 80 based on, as a setting table corresponding to apparatus configuration information, a setting table including information indicating temperature setting of the fixing machine mounted on the post-processing machine 90B. As information indicating the configuration in which the fixing temperature of the post-processing machine 90B can be changed, apparatus configuration information including the information only has to be input to the clear processing 562 via the MIC 60 and the apparatus-configuration acquiring unit 58. In this case, in data outputting process at step S606 (see FIG. 30), data including the information indicating the temperature setting of the post-processing machine 90B only has to be transmitted from the DFE 502 to the MIC 60. When information indicating temperature setting is further included in clear toner plane data associated with information indicating the post-processing machine 90B included in the data received from the DFE 502, the MIC 60 only has to transmit the information indicating the temperature setting to the post-processing machine 90B. When the information indicating the temperature setting is included in the information received from the MIC 60, the post-processing machine 90B only has to perform fixing by the fixing machine at temperature indicated by the information indicating the temperature setting.

In the explanation in the third embodiment, the conveying path 20B is provided to return the recording medium conveyed further to the downstream side in the conveying direction (in FIGS. 24 and 25, see the arrow A direction) than the post-processing machines 40 in the conveying path 20A further to the upstream side in the conveying direction than the printer machine 70. However, the conveying path 20A may be provided further on the upstream side in the conveying direction than the printer machine 70 in the conveying path 20A from a position between the glosser 80 and the post-processing machines 40 in the conveying path 20A.

In the case of a configuration in which the fixing machine mounted on the post-processing machine 90B can change the fixing temperature as explained above, the conveying path 20B may be configured to return the recording medium conveyed further to the downstream side in the conveying direction than the post-processing machine 40 in the conveying path 20A to an area between the glosser 80 and the post-processing machines 40 in the conveying path 20A.

Further, fixing temperature by a fixing machine (not shown) for fixing a toner image provided in the main body of the printer machine 70 may be set. In this case, a setting table is prepared in which it is set that a recording medium conveyed to the downstream side of the glosser 80 along the conveying path 20A is returned to the upstream side of the printer machine 70, the fixing temperature of the fixing machine of the printer machine 70 is switched (to the low temperature or the normal temperature), and ON/OFF of the glosser 80 is switched. The DFE 502 only has to perform processing based on the setting table.

Fourth Embodiment

Next, a fourth embodiment will be explained. In some case, components common to the first embodiment are explained using the same reference numerals and signs or explanation of the components is omitted.

In the fourth embodiment, separately from the surface effect of the user designation indicated by the gloss control plane data, a user selects any one of imparting of all effects, gloss preference, and type preference. In the fourth embodiment, replacement process for a surface effect of user designation is performed according to the selected content selected by the user.

The imparting of all effects indicates imparting of surface effects of a plurality of types realizable by a printing apparatus including all the post-processing machines 40. The definitions of the gloss preference and the type preference are as explained in the embodiments explained above. Therefore, explanation of the definitions is omitted.

Figure 32:
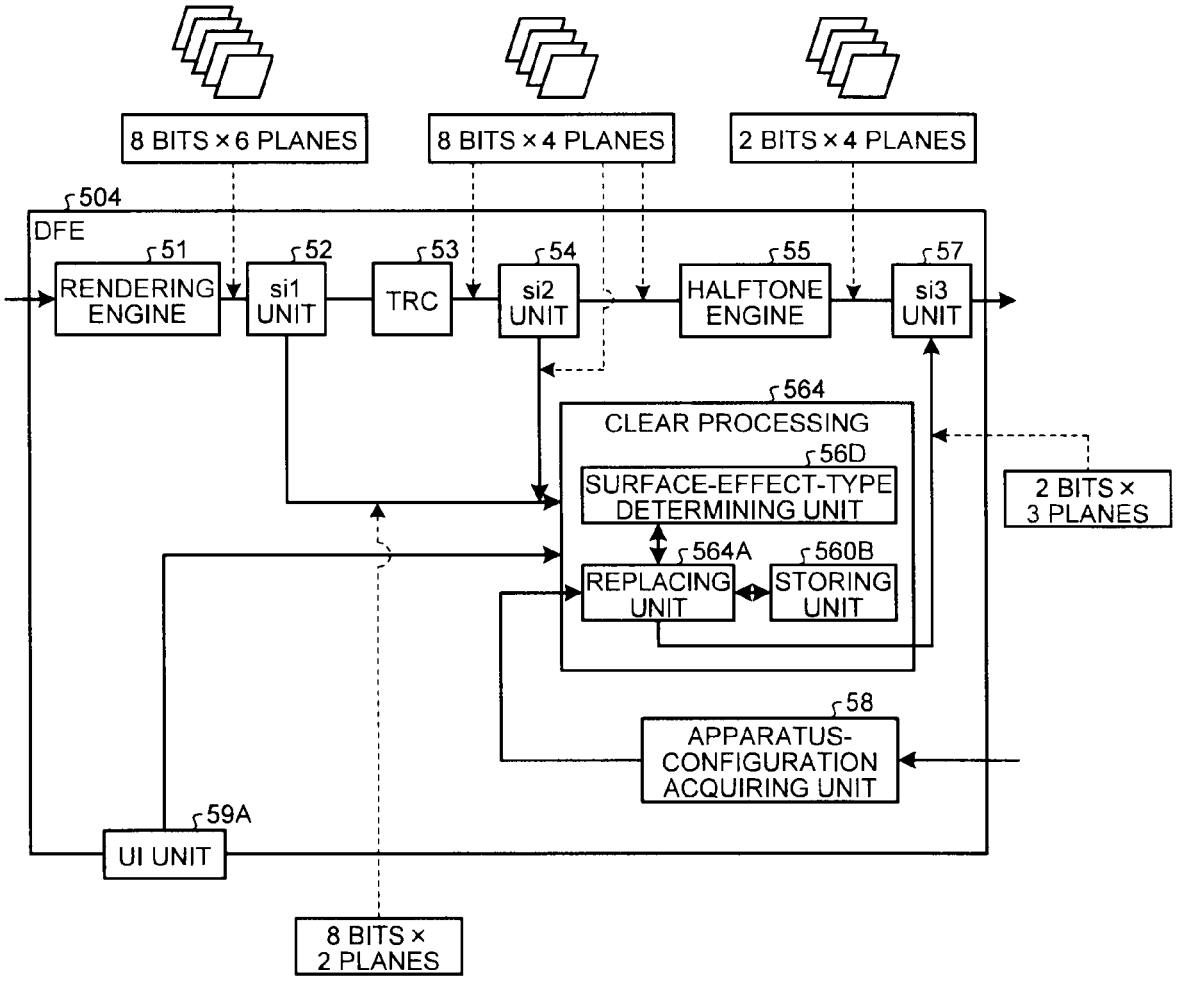
FIG. 32 is a diagram of an example of a functional configuration of a DFE according to a fourth embodiment.

In FIG. 32, the configuration of a DFE 504 in the image forming system according to the fourth embodiment is shown.

The image forming system according to the fourth embodiment has the configuration same as the image forming system according to the third embodiment except that the DFE 504 shown in FIG. 32 is used instead of the DFE 502 shown in FIG. 24 in the image forming system 10B (see FIG. 24) including the conveying path 20A, the conveying path 20B, and the switching unit 22 explained in the third embodiment. Therefore, detailed explanation is omitted concerning the components other than the DFE 504 in the image forming system.

The DFE 504 includes, as a hardware configuration, a control unit such as a CPU that controls the entire apparatus, main storing units such as a ROM and a RAM that store various data and various computer programs, and an auxiliary storing unit such as a HDD that stores various data and various computer programs. The DFE 504 has a hardware configuration including a normal computer.

As a functional configuration, as shown in FIG. 32, the DFE 504 includes the rendering engine 51, the si1 unit 52, the TRC 53, the si2 unit 54, the halftone engine 55, the si3 unit 57, the apparatus-configuration acquiring unit 58, and a clear processing 564. The clear processing 564 includes the surface-effect-type determining unit 56D, the storing unit 560B, and a replacing unit 564A.

The DFE 504 has the same configuration as the DFE 502 in the third embodiment except that the DFE 504 includes the clear processing 564 instead of the clear processing 562 (see FIG. 26). The clear processing 564 has the same configuration as the clear processing 562 (see FIG. 26) except that the clear processing 564 includes the replacing unit 564A instead of the replacing unit 562A shown in FIG. 7. Therefore, components having the same configurations and the same functions as the components explained in the third embodiment are denoted by the same reference numerals and signs and explanation of the components is omitted.

Figure 33:
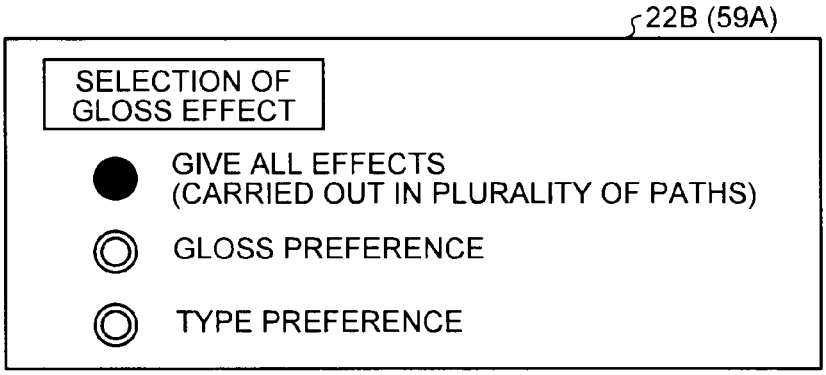
FIG. 33 is a schematic diagram of an input screen.

The DFE 504 further includes a user interface (UI) unit 59A. The UI unit 59A performs display of various kinds of information and reception of various instructions. In the fourth embodiment, a selection screen 22B for prompting the user to select gloss effects shown in FIG. 33 is displayed on the UI unit 59A. In the fourth embodiment, the selection screen 22B for the user to select any one of "imparting of all effects", "gloss preference", and "type preference" is displayed on the UI unit 59A.

The user points a display place of a selection button (not shown) in the UI unit 59A, whereby any one of the "imparting of all effects", the "gloss preference", and the "type preference" is selected. Thereafter, the user points a display place of a determination button (not shown) displayed on the UI unit 59A. Consequently, a signal indicating the "imparting of all effects", the "gloss preference", or the "type preference" pointed by the user is output from the UI unit 59A to the replacing unit 564A of the clear processing 564.

When the replacing unit 564A receives the signal indicating the gloss preference from the UI unit 59A, the replacing unit 564A sets the glosser 80 to ON. When the replacing unit 564A receives the signal indicating the type preference from the UI unit 59A, the replacing unit 564A sets the glosser 80 to OFF. When the replacing unit 564A receives the signal indicating the imparting of all effects from the UI unit 59A, the replacing unit 564A performs replacement process to repeatedly convey a recording medium from the printer machine 70 to the post-processing machines 40 a plurality of times as explained in the third embodiment.

The printing apparatus 30 performs printing based on information indicating ON/OFF of the glosser 80 and clear toner plane data set for each number of times of conveyance.

The storing unit 560B stores therein surface effect selection tables and setting tables as in the third embodiment.

The storing unit 560B stores therein, as the setting table, setting tables corresponding to apparatus configuration information and types of gloss effects.

In the fourth embodiment, the storing unit 560B stores therein, as the setting table corresponding to the apparatus configuration information, a setting table corresponding to apparatus configuration information indicating an apparatus configuration in which all the post-processing machines 40 (the glosser 80, the post-processing machine 90A, and the post-processing machine 90B) are mounted and types of gloss effects. The storing unit 560B stores therein, as the setting table corresponding to the apparatus configuration information, a setting table corresponding to apparatus configuration information indicating an apparatus configuration in which the glosser 80 and the post-processing machine 90B are mounted and types of gloss effects. The storing unit 560B stores therein, as the setting table corresponding to the apparatus configuration information, a setting table corresponding to apparatus configuration information indicating an apparatus configuration in which the glosser 80 is mounted and types of gloss effects.

Further, in the fourth embodiment, the "imparting of all effects" is included as a type of a gloss effect in addition to the "gloss preference" and the "type preference".

Like the replacing unit 560A in the second embodiment, the replacing unit 564A replaces, based on the setting table, a type of a surface effect of user designation received from the surface-effect-type determining unit 56D with a type of a surface effect realizable by the printing apparatus 30. However, in the fourth embodiment, the replacing unit 564A performs the replacement process using a setting table corresponding to both of a gloss effect (the gloss preference or the type preference) instructed from the user via the UI unit 59A and apparatus configuration information.

A procedure of gloss control process performed by the image forming system according to the fourth embodiment is explained with reference to FIG. 34.

Figure 34:
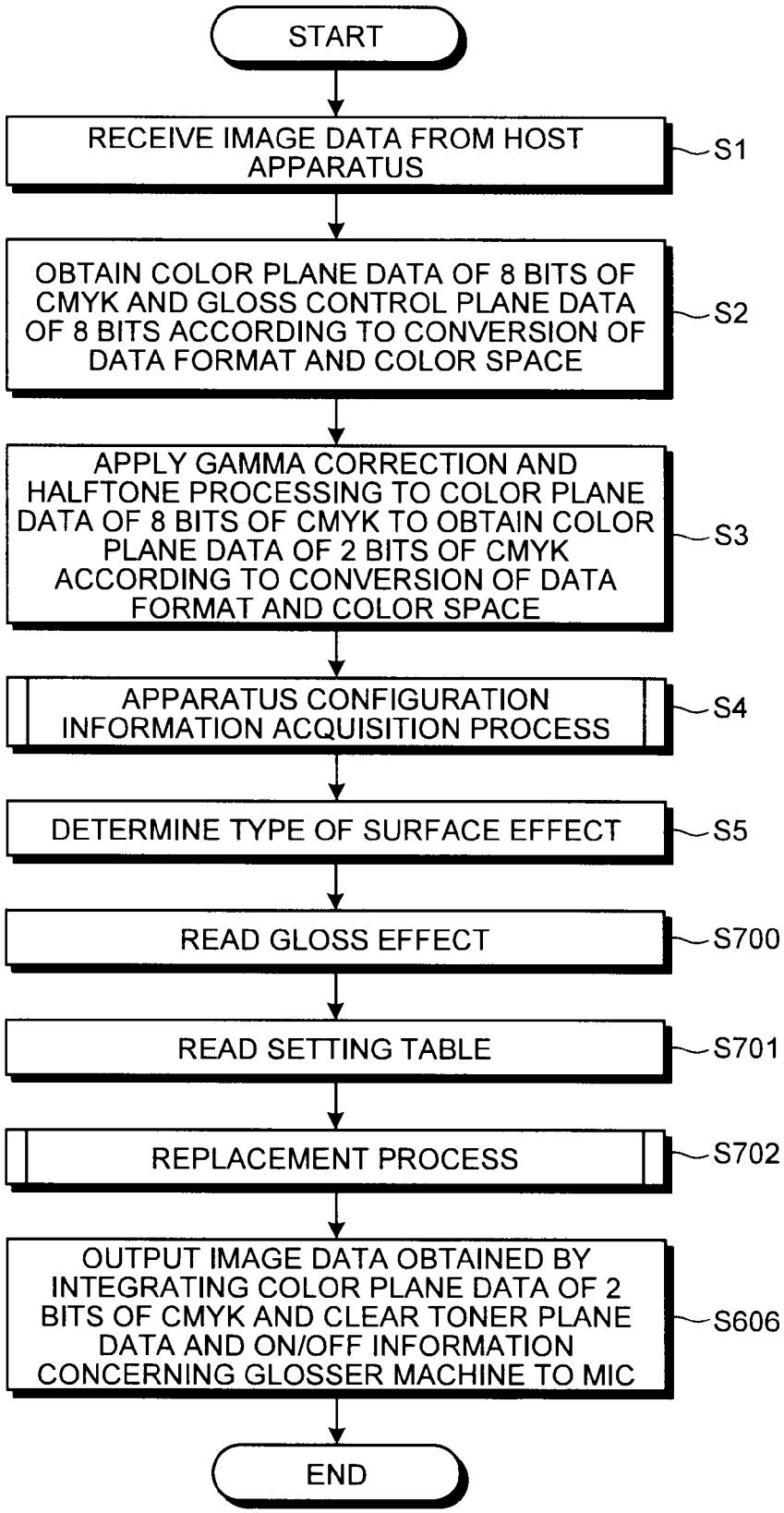
FIG. 34 is a flowchart for explaining a procedure of gloss control process according to the fourth embodiment.

In the fourth embodiment, the DFE 504 executes process at step S1, step S2, step S3, step S4, step S5, step S700, step S701, step S702, and step S606 shown in FIG. 34 in the written order. In FIG. 34, the process at steps S1 to S5 is the same as the contents explained with reference to FIG. 15 in the first embodiment. Therefore, details of the process at steps S700 to S606 different from the contents are explained.

After performing the process at step S5, the replacing unit 564A of the DFE 504 performs gloss effect reading process (step S700).

As explained above, the UI unit 59 is operated by the user and receives user's instruction, and the signal indicating, the imparting of all effects, the gloss preference, or the type preference is output to the replacing unit 564A of the clear processing 564 via the selection screen 22B. When the replacing unit 564A receives the signal indicating, the imparting of all effects, the gloss preference, or the type preference, the replacing unit 564A stores the signal in the storing unit 560B. Every time the replacing unit 564A receives the signal from the UI unit 59A anew, the replacing unit 564A overwrites and stores the signal in the storing unit 560B.

In the process at step S700, the replacing unit 564A reads the signal from the storing unit 560B to thereby read the signal indicating, the imparting of all effects, the gloss preference, or the type preference serving as the gloss effect.

Subsequently, the replacing unit 564A reads, from the storing unit 560B, a setting table corresponding to the apparatus configuration information acquired at step S5 and the gloss effect read at step S700 (step S701).

The replacing unit 564A then performs, using the setting table read at step S701, replacement process, i.e., generation of clear toner plane data in which a surface effect of a type difficult to be realized by the apparatus configuration is replaced with a surface effect of a realizable type and setting of ON/OFF of the glosser 80 (step S702).

At step S702, when the gloss effect read at step S700 is the signal indicating the gloss preference, the replacing unit 564A performs the replacement process using the setting table corresponding to both of the information indicating ON of the glosser 80 and the apparatus configuration information acquired at step S5. On the other hand, at step S702, when the gloss effect read at step S700 is the signal indicating the type preference, the replacing unit 560A performs the replacement process using the setting table corresponding to both of the information indicating OFF of the glosser 80 and the apparatus configuration information acquired at step S5. When the gloss effect read at step S700 is the signal indicating the imparting of all effects, the replacing unit 564A performs the replacement process using the setting table corresponding to both of the information indicating the imparting of all effects and the apparatus configuration information acquired at step S5.

Thereafter, when the gloss effect read at step S700 is the signal indicating the gloss preference or the type preference, after performing process same as the process at step S7 explained in the second embodiment (see FIG. 22), the replacing unit 564A ends this routine. On the other hand, when the gloss effect read at step S700 is the signal indicating the imparting of all effects, the after performing process same as the process at step S606 explained in the third embodiment (see FIG. 30), the replacing unit 564A ends this routine.

Figure 35:
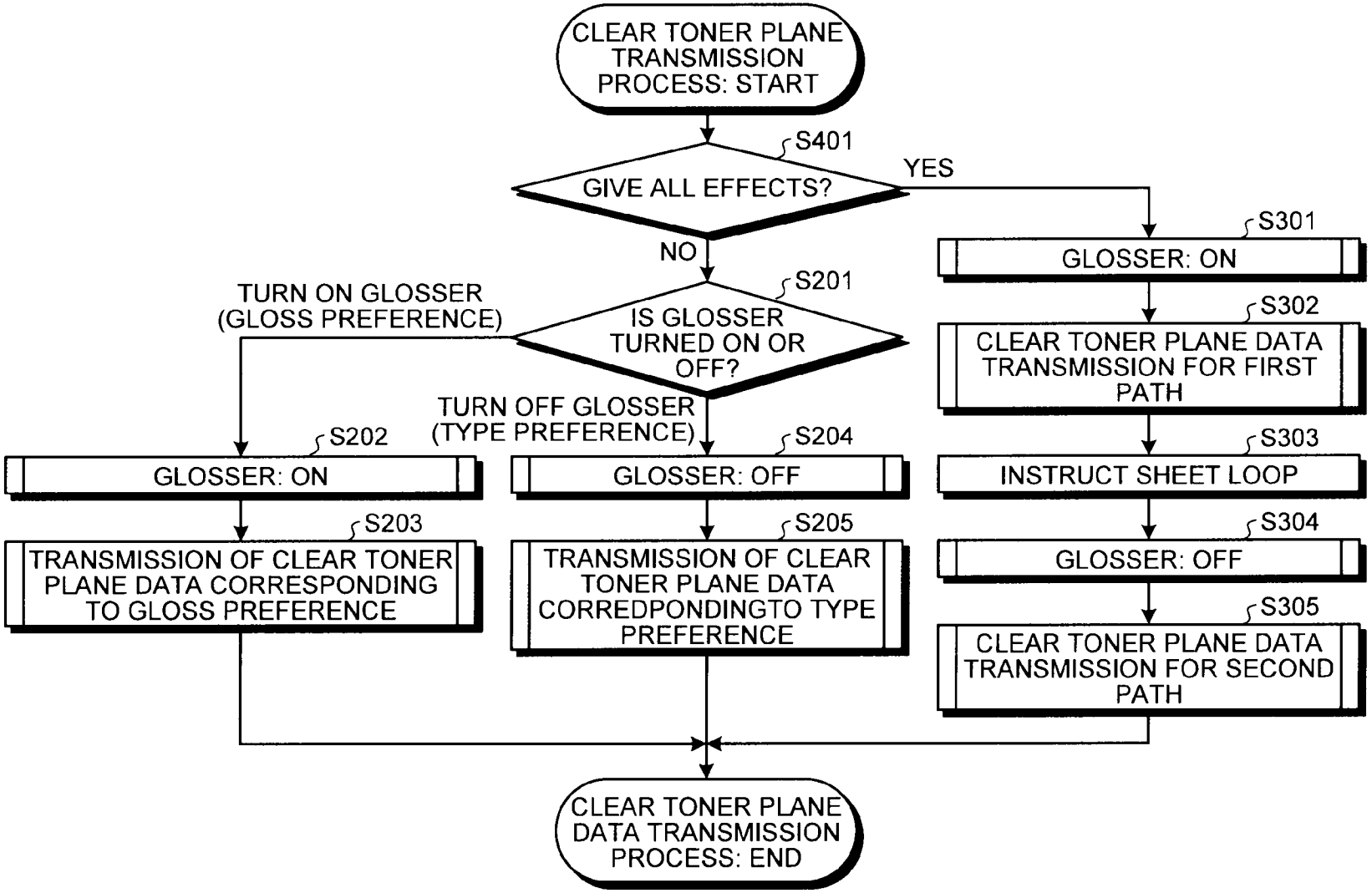
FIG. 35 is a flowchart for explaining a procedure of transmission process performed by an MIC.

Process performed in the MIC 60 is shown in FIG. 35. In FIG. 35, data is transmitted to the MIC 60 of a printing apparatus mounted with at least one of the glosser 80, the post-processing machine 90A, and the post-processing machine 90B as the post-processing machine 40.

When the data is input to the MIC 60 from the DFE 504 by the process described above, the MIC 60 determines whether information indicating a type of a gloss effect included in the input data is information indicating the imparting of all effects (step S401).

When the information indicating a type of a gloss effect is the information indicating the imparting of all effects (Yes at step S401), after executing the process at steps S301 to S5305 explained in the third embodiment (see FIG. 31), the MIC 60 ends this routine.

On the other hand, when the information indicating a type of a gloss effect is not the information indicating the imparting of all effects (No at step S401), after performing the process at steps S201 to S205 explained in the second embodiment (see FIG. 23), the MIC 60 ends this routine.

Therefore, in the fourth embodiment, even when a part of the post-processing machines are not mounted, it is possible to impart, without causing the user trouble, a surface effect by the clear toner to a recording medium on which an image is formed.

Fifth Embodiment

In the first to fourth embodiments, the host apparatus 10 generates printing data, the clear processing 56 is provided in the DFE 50, and the DFE 50 performs processing for generating clear toner plane data. However, configuration is not limited to the first to fourth embodiments.

For example, any one of a plurality of kinds of processes performed in one apparatus in the above-described embodiments can be performed in one or more other apparatuses connected to the one apparatus via a network.

As an example, in an image forming system according to a fifth embodiment, a part of functions of a DFE are mounted on a server apparatus on a network.

Figure 36:
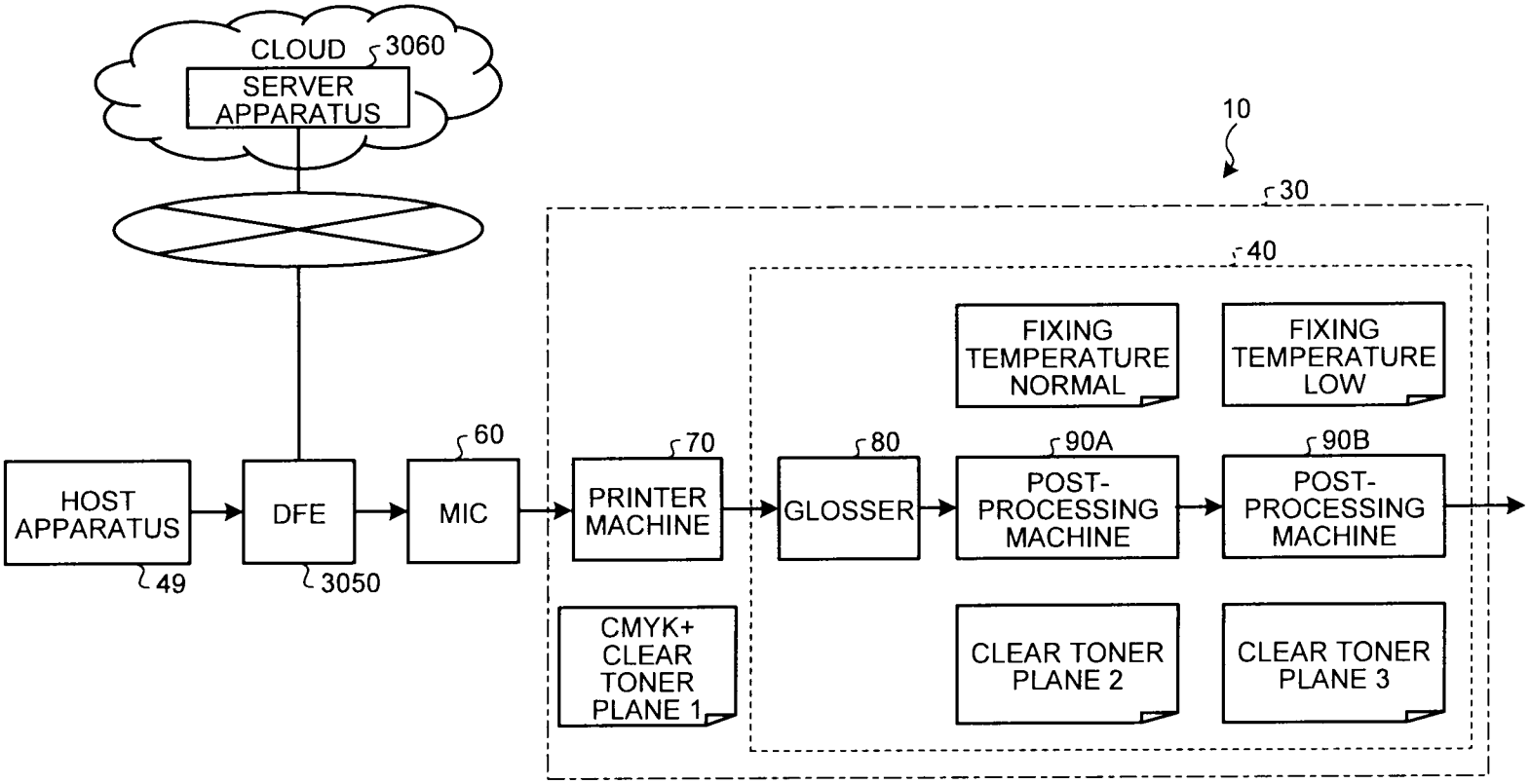
FIG. 36 is a diagram of an example of the configuration of an image forming system according to a fifth embodiment.

FIG. 36 is a diagram of an example of the configuration of the image forming system according to the fifth embodiment. As shown in FIG. 36, the image forming system according to the fifth embodiment includes the host apparatus 49, a DFE 3050, the MIC 60, and the printing apparatus 30.

In the fifth embodiment, the DFE 3050 is connected to a server apparatus 3060 via a network such as the Internet. In the fifth embodiment, the functions of the clear processing 56 of the DFE 50 in the first embodiment are provided in the server apparatus 3060.

A connection configuration of the host apparatus 49, the DFE 3050, the MIC 60, and the printing apparatus 30 is the same as the connection configuration in the first embodiment.

Specifically, in the fifth embodiment, the DFE 3050 is connected to the single server apparatus 3060 via the network (cloud) such as the Internet. The server apparatus 3060 has the functions of the clear processing 56 of the DFE 50 in the first embodiment. The server apparatus 3060 performs process for generating clear toner plane data.

Figure 37:
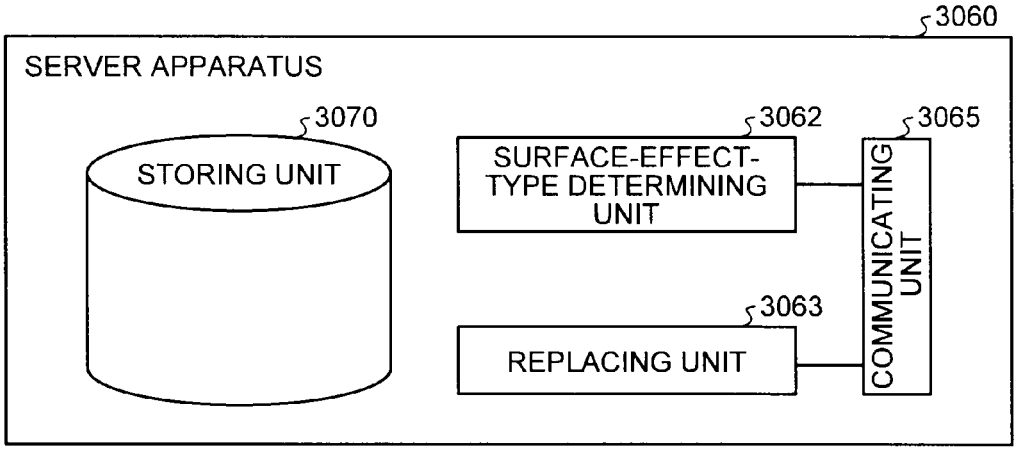
FIG. 37 is a block diagram of a functional configuration of a server apparatus according to the fifth embodiment.

First, the server apparatus 3060 is explained. FIG. 37 is a block diagram of a functional configuration of the server apparatus 3060 according to the fifth embodiment. The server apparatus 3060 mainly includes a storing unit 3070, a surface-effect-type determining unit 3062, a replacing unit 3063, a storing unit 3070, and a communicating unit 3065.

The storing unit 3070 is a storage medium such as a HDD or a memory and stores therein surface effect selection tables and setting tables. Information stored in the storing unit 3070 is the same as the information stored in the storing unit 56B (see FIGS. 7 and 26) and the storing unit 560B (see FIG. 18) explained in the above-described embodiments. Specifically, setting tables corresponding to apparatus configuration information are stored in the storing unit 3070.

The communicating unit 3065 performs transmission and reception of various data and requests to and from the DFE 3050. More specifically, the communicating unit 3065 receives gloss control plane data, clear plane data, apparatus configuration information, and the like from the DFE 3050. The gloss control plane data, the clear plane data, and the apparatus configuration information are the same as those in the embodiments described above. The communicating unit 3065 transmits generated clear toner plane data and ON/OFF information to the DFE 3050.

The surface-effect-type determining unit 56D has functions same as the function of the surface-effect-type determining unit in the first embodiment. The surface-effect-type determining unit 56D determines, using the gloss control plane data received from the DFE 3050 via the communicating unit 3065 and referring to the surface effect selection tables, a surface effect corresponding to a density value (a pixel value) of pixels included in the gloss control plane data. The surface-effect-type determining unit 56D outputs a determination result to the replacing unit 3063.

The replacing unit 3063 has functions same as the functions of the replacing unit in the first embodiment. The replacing unit 3063 replaces, based on a setting table corresponding to the apparatus configuration information acquired from the DFE 3050 via the communicating unit 3065, a type of a surface effect of user designation received from the surface-effect-type determining unit 3062 with a type of a surface effect realizable by the printing apparatus 30. Consequently, the replacing unit 3063 sets ON/OFF of the glosser 80 and generates clear toner plane data.

Figure 38:
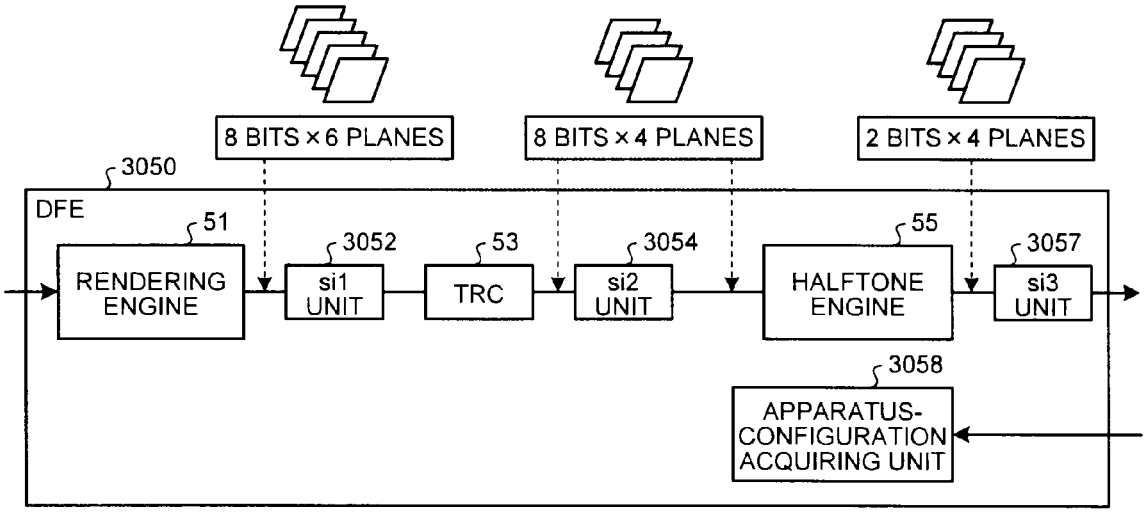
FIG. 38 is a block diagram of a functional configuration of a DFE according to the fifth embodiment.

The DFE 3050 is explained. FIG. 38 is a block diagram of a functional configuration of the DFE 3050 in the fifth embodiment. The DFE 3050 in the fifth embodiment mainly includes the rendering engine 51, an si1 unit 3052, the TRC 53, an si2 unit 3054, the halftone engine 55, an si3 unit 3057, and an apparatus-configuration acquiring unit 3058. The functions and the configurations of the rendering engine 51, the TRC 53, and the halftone engine 55 are the same as those of the DFE 50 in the first embodiment.

The si1 unit 3052 outputs color plane data of 8 bits each of CMYK to the TRC 53 and outputs gloss control plane data of 8 bits and clear plane data to the server apparatus 3060 via an interface (not shown).

The si2 unit 3054 outputs the color plane data of 8 bits each of CMYK subjected to gamma correction in the TRC 53 to the server apparatus 3060 as data for generating an inverse mask. The si2 unit 3054 outputs the color plane data of 8 bits each of CMYK after the gamma correction to the halftone engine 55.

The si3 unit 3057 integrates the color plane data of 2 bits each of CMYK after halftone processing and clear toner plane data of 2 bits received from the server apparatus 3060 via the interface (not shown) and outputs the integrated image data to the MIC 60. The si3 unit 3057 also outputs ON/OFF information concerning the glosser 80 output by the clear processing 56 to the MIC 60.

The apparatus-configuration acquiring unit 3058 has functions same as the functions of the apparatus-configuration acquiring unit in the first embodiment. The apparatus-configuration acquiring unit 3058 transmits acquired apparatus configuration information to the server apparatus 3060.

Figure 39:
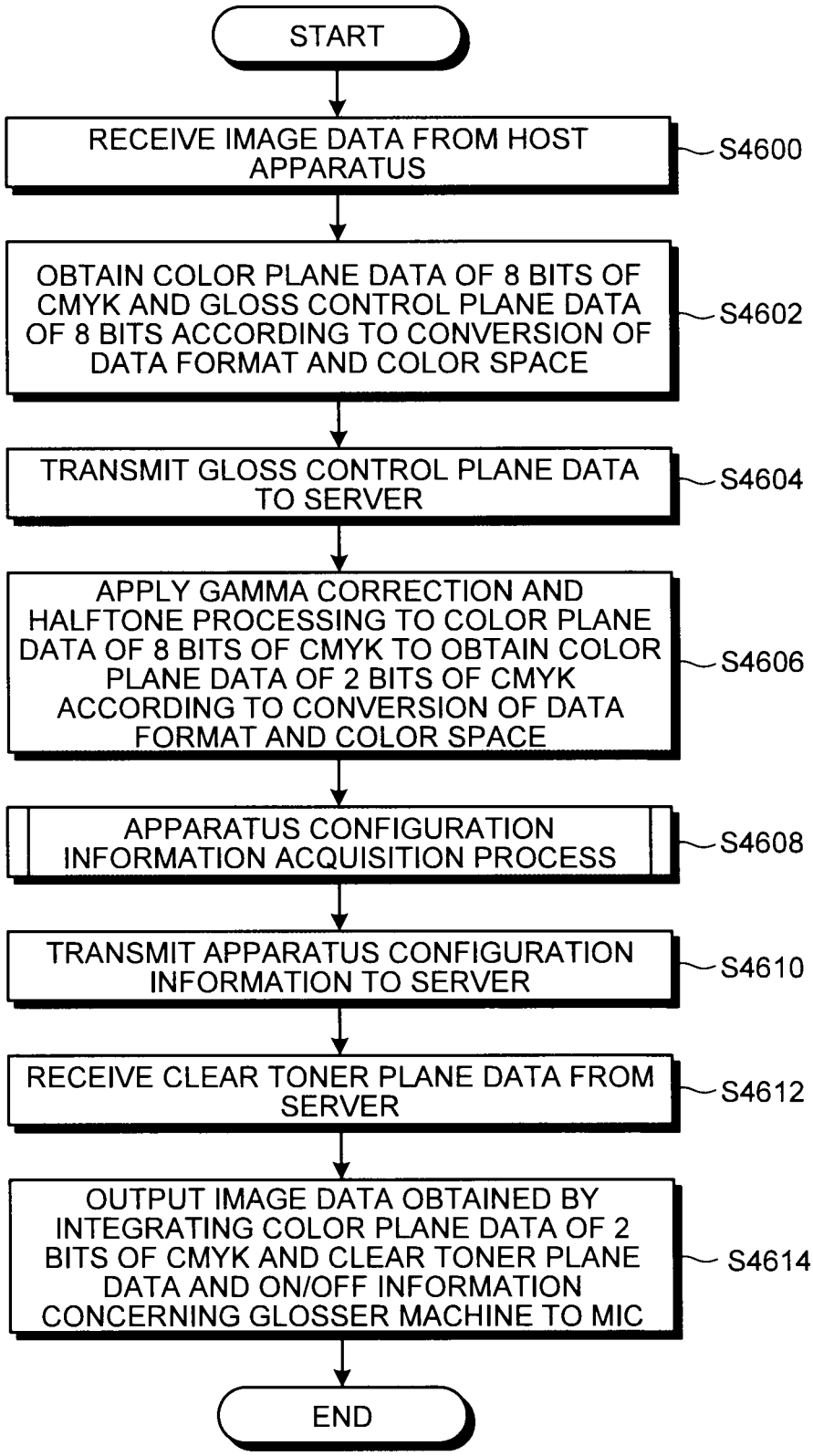
FIG. 39 is a flowchart for explaining a procedure of gloss control process by the DFE according to the fifth embodiment.

A procedure of gloss control process performed by the image forming system according to the fifth embodiment is explained with reference to FIG. 39.

The DFE 3050 receives image data from the host apparatus 49 (step S4600). The DFE 3050 subjects the image data to language interpretation, converts the image data represented in the vector format into the raster format, and converts a color space represented in the RGB format into a color space of the CMYK format or the like to obtain color plane data of 8 bits each of color planes of CMYK and gloss control plane data of 8 bits (step S4602).

Subsequently, the DFE 3050 transmits the gloss control plane data generated at step S4602 to the server apparatus 3060 (step S4604).

The DFE 3050 applies gamma correction to the color plane data of 8 bits each of CMYK using a gamma curve of a 1D_LUT generated by calibration. The DFE 50 applies, to the image data after the gamma correction, halftone processing for converting the color plane data into, for example, a data format of color plane data of 2 bits each of CMYK for output to the printer machine 70 to obtain color plane data of 2 bits each of CMYK after the halftone processing (step S4606).

Subsequently, the apparatus-configuration acquiring unit 3058 executes apparatus configuration information acquisition process for acquiring apparatus configuration information (step S4608). The apparatus configuration acquisition process at step S4608 is the same as the apparatus configuration acquisition process explained in the first embodiment. Therefore, explanation of the apparatus configuration acquisition process is omitted.

The apparatus-configuration acquiring unit 3058 then transmits the acquired apparatus configuration information to the server apparatus 3060 (step S4610).

Subsequently, the DFE 3050 receives clear toner plane data and ON/OFF information indicating ON or OFF of the glosser 80 from the server apparatus 3060 (step S4612).

The DFE 3050 then outputs, to the MIC 60, the color plane data of 2 bits each of CMYK after the halftone processing obtained at step S4606 and the clear toner plane data and the ON/OFF information received from the server apparatus 3060 at step S4612 (step S4614).

Consequently, the image forming system ends this routine.

Next, clear toner plane data generation process executed in the server apparatus 3060 is explained.

Figure 40:
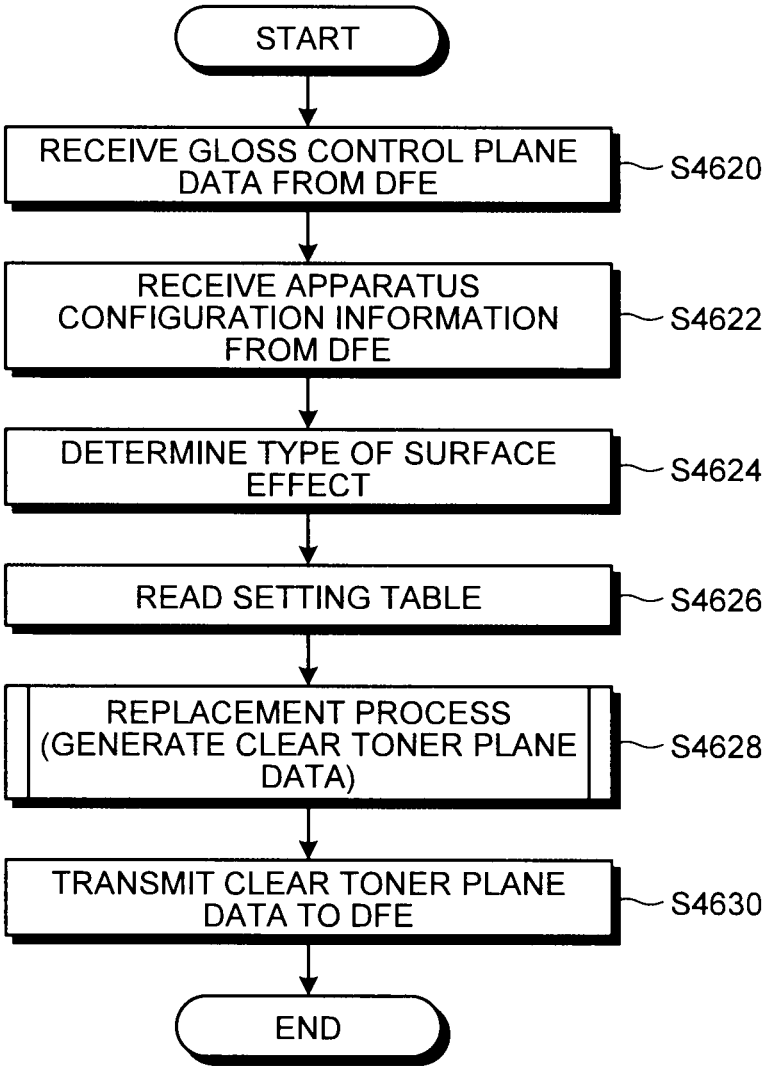
FIG. 40 is a flowchart for explaining a procedure of clear toner plane data generation process by a server according to the fifth embodiment.

FIG. 40 is a flowchart for explaining the clear toner plane data generation process executed in the server apparatus 3060.

First, the communicating unit 3065 of the server apparatus 3060 receives gloss control plane data from the DFE 3050 (step S4620). Subsequently, the communicating unit 3065 receives apparatus configuration information from the DFE 3050 (step S4622).

Subsequently, the surface-effect-type determining unit 3062 determines, using gloss control plane data of 8 bits received at step S4620, a type of a surface effect designated for pixel values indicated by the gloss control plane data (step S4624).

Subsequently, the replacing unit 3063 reads, from the storing unit 3070, a setting table corresponding to the apparatus configuration information acquired at step S4622 (step S4626).

The replacing unit 3063 then performs, based on the type of the surface effect read at step S4624 and the setting table read at step S4626, replacement process, i.e., generation of clear toner plane data in which a surface effect of a type difficult to be realized by the apparatus configuration is replaced with a surface effect of a realizable type and setting of ON/OFF of the glosser 80 (step S4628). The replacement process at step S4628 is the same as the replacement process in the first embodiment.

Subsequently, the communicating unit 3065 transmits the generated clear toner plane data and ON/OFF information to the DFE 3050 (step S4630) and ends this routine.

As explained above, in the fifth embodiment, the functions of the clear processing are provided in the server apparatus 3060. The generation of clear toner plane data is performed in the server apparatus 3060 on the cloud. Therefore, besides the effects in the first embodiment, even when a plurality of DFEs 3050 are present, it is possible to collectively perform the generation of clear toner plane data. This is convenient for an administrator.

In the fifth embodiment, the function of the clear processing are provided in the single server apparatus 3060 on the cloud and the generation of clear toner plane data is performed in the server apparatus 3060. However, configuration is not limited thereto.

Figure 41:
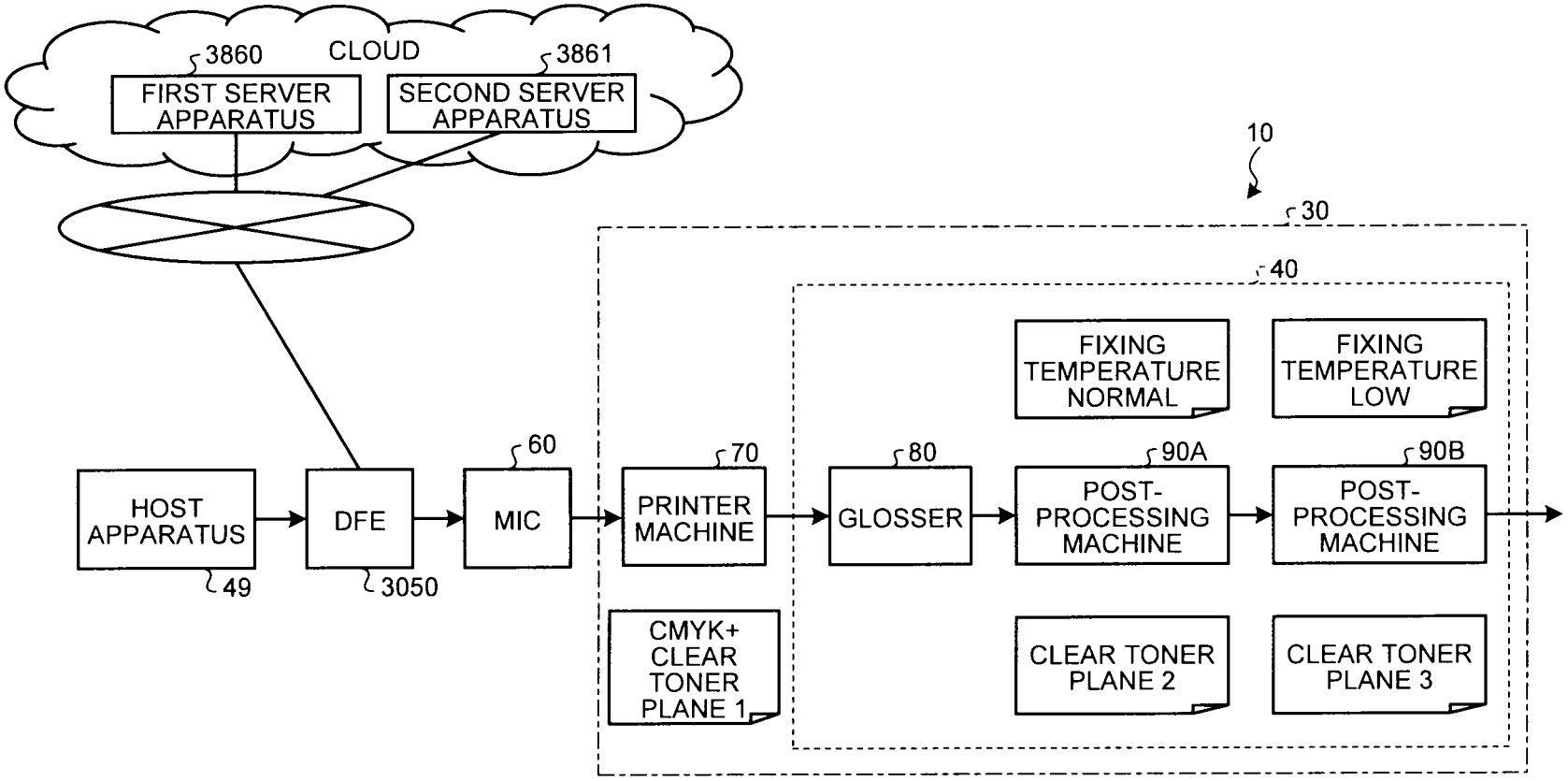
FIG. 41 is a configuration diagram of a network in which two servers are provided on a cloud.

For example, two or more server apparatuses may be provided on the cloud to execute the above described processes in the two or more server apparatuses in a distributed manner. FIG. 41 is a configuration diagram of a network in which two servers (a first server apparatus 3860 and a second server apparatus 3861) are provided on the cloud. In an example shown in FIG. 41, the first server apparatus 3860 and the second server apparatus 3861 perform the surface effect type determination process and the replacement process in a distributed manner.

A form of the distribution of the processes to the servers is not limited to this. The distribution of the processes can be arbitrarily performed.

Printing data generation process performed in the host apparatus 49 and a part or all of the other process performed in the DFE 3050 may be arbitrarily performed centrally in one server apparatus on the cloud or in a plurality of server apparatuses in a distributed manner.

In other words, as in the example explained above, any one of a plurality of kinds of processes performed in one apparatus can be performed in one or more other apparatuses connected to the one apparatus via a network.

In the case of the configuration in which the processes are performed in the one or more other apparatuses connected to the one apparatus via the network, the configuration includes input and output processes for data performed between the one apparatus and the other apparatuses and among the other apparatuses such as a process for outputting data (information) generated in a process performed in the one apparatus from the one apparatus to the other apparatuses and a process for inputting the data from the other apparatuses.

In the case of the one apparatus, the configuration includes the input and output processes for data performed between the one apparatus and the other apparatuses. In the case of the two or more other apparatuses, the configuration includes the input and output processes for data between the one apparatus and the other apparatuses and among the other apparatuses such as such as between a first other apparatus and a second other apparatus.

In the fifth embodiment, the server apparatus 3060 or a plurality of server apparatuses such as the first server apparatus 3860 and the second server apparatus 3861 are provided on the cloud. However, configuration is not limited thereto. For example, the server apparatus 3060 or the server apparatuses such as the first server apparatus 3860 and the second server apparatus 3861 may be provided on any kind of network such as an Intranet.

The present invention is not limited to the embodiments per se. In an implementation stage, the elements can be modified and embodied without departing from the spirit of the present invention. Various inventions can be devised by appropriately combining a plurality of elements disclosed in the embodiments. For example, several elements can be deleted from all the elements disclosed in the embodiments. The elements disclosed in the different embodiments can be appropriately combined. As explained below as examples, various modifications are possible.

Figure 42:
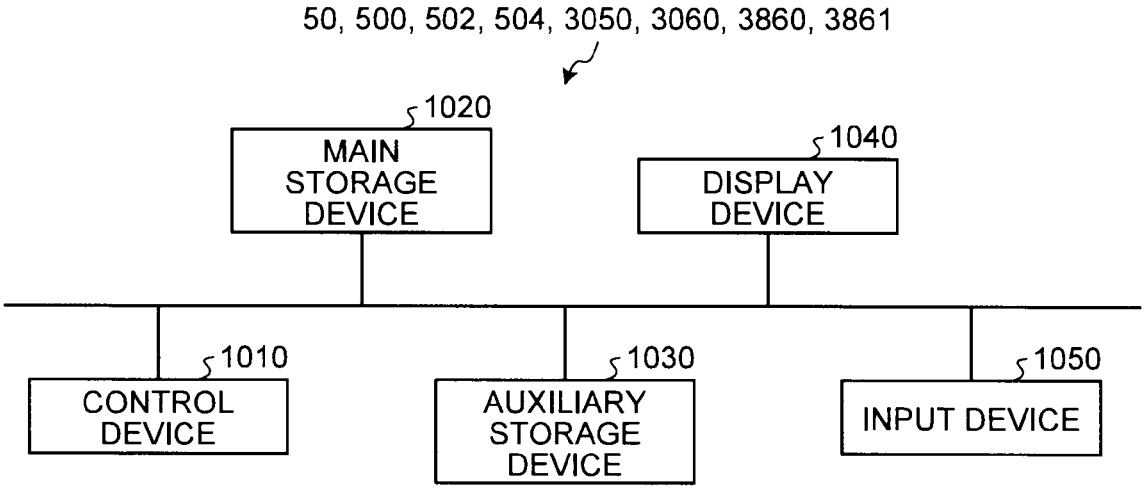
FIG. 42 is a configuration diagram of hardware of a host apparatus, a DFE, and a server apparatus.

FIG. 42 is a block diagram of an example of a hardware configuration of the DFEs 50, 500, 502, 504, and 3050, the server apparatus 3060, the first server apparatus 3860, and the second server apparatus 3861 in the embodiments. The DFEs 50, 500, 502, 504, and 3050, the server apparatus 3060, the first server apparatus 3860, and the second server apparatus 3861 in the embodiments include a control device 1010 such as a CPU, a main storage device 1020 such as a Read Only Memory (ROM) or a random access memory (RAM), an auxiliary storage device 1030 such as a hard disk drive (HDD) or a compact disk (CD) drive device, a display device 1040 such as a display, and an input device 1050 such as a keyboard or a mouse. The DFEs 50, 500, 502, 504, and 3050, the server apparatus 3060, the first server apparatus 3860, and the second server apparatus 3861 have a hardware configuration including a normal computer.

A computer program executed in the DFEs 50, 500, 502, 504, and 3050, the server apparatus 3060, the first server apparatus 3860, and the second server apparatus 3861 in the embodiments is provided while being recorded in a computer-readable recording medium such as a compact disc read-only memory (CD-ROM), a flexible disk (FD), a compact disc-recordable (CD-R), or a digital versatile disk (DVD) as a file of an installable format or an executable format.

The computer program executed in the DFEs 50, 500, 502, 504, and 3050, the server apparatus 3060, the first server apparatus 3860, and the second server apparatus 3861 in the embodiments can be stored on a computer connected to a network such as the Internet and provided by being downloaded through the network. The computer program executed in the DFEs 50, 500, 502, 504, and 3050, the server apparatus 3060, the first server apparatus 3860, and the second server apparatus 3861 in the embodiments can be provided or distributed through the network such as the Internet. A control program executed in the DFEs 50, 500, 502, 504, and 3050, the server apparatus 3060, the first server apparatus 3860, and the second server apparatus 3861 in the embodiments can be provided while being incorporated in a ROM or the like in advance.

The computer program executed in the DFEs 50, 500, 502, 504, and 3050, the server apparatus 3060, the first server apparatus 3860, and the second server apparatus 3861 in the embodiments has a module configuration including the units explained above (the rendering engine 51, the si1 unit 52, the TRC 53, the si2 unit 54, the halftone engine 55, the si3 unit 57, the clear processing 56, the apparatus-configuration acquiring unit 58, the surface-effect-type determining unit 3062, the replacing unit 3063, and the apparatus-configuration acquiring unit 3058). As actual hardware, a CPU (a processor) reads out the control program from the storage medium and executes the control program, whereby the units are loaded onto a main storage device and the units are generated on the main storage device. In the embodiments, the DFEs 50, 500, 502, 504, and 3050, the server apparatus 3060, the first server apparatus 3860, and the second server apparatus 3861 execute the processing according to the present invention. However, this is not a limitation. A type of an apparatus that executes the processing according to the present invention is arbitrary. For example, a PC can also execute the processing.

In the embodiments, the image forming system includes the DFE 50 (50, 500, 502, or 504), the MIC 60, the printer machine 70, and the post-processing machines 40. However, this is not a limitation. For example, the DFE 50, the MIC, and the printer machine 70 can be integrally formed as one image forming apparatus or can be formed as an image forming apparatus further including the glosser 80 or the post-processing machine 90A or 90B.

In the image forming system according to the embodiments, an image is formed using the toners of a plurality of colors of CMYK. However, an image can be formed using a toner of one color.

According to the embodiments described above, even when a part of the post-processing machines are not mounted, it is possible to impart the surface effects by the clear toner to the recording medium, on which an image is formed, without causing a user trouble.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printing control apparatus comprising:

an acquiring unit configured to acquire machine type information that indicates which of one or more post-processing machines are connected to a printing apparatus that forms an image based on image data;

a storing unit configured to store therein gloss control plane data that specifies a type of a surface effect imparted to a recording medium for each of a plurality of areas of the recording medium;

a replacing unit configured to replace a respective type of a surface effect imparted to an area of the recording medium with a predetermined type of a surface effect in the gloss control plane data based on the machine type information of the one or more post-processing machines that are connected to the printing apparatus; and a generating unit configured to generate the image data based on the gloss control plane data subjected to replacement by the replacing unit.

2. The printing control apparatus according to claim 1, wherein a plurality of surface effects of user designation indicated by the gloss control plane data in a same page cannot be realized in the same page by an apparatus configuration indicated by the acquired apparatus configuration information, and the replacing unit replaces a surface effect of the user designation of an unrealizable type with a surface effect of a realizable type and generates the image data to realize the replaced surface effect of the realizable type.

3. The printing control apparatus according to claim 2, further comprising a selection unit configured to prompt a user to select gloss preference or type preference, the gloss preference indicating that a surface effect is replaced with a surface effect of a type having highest glossiness, the type preference indicating that a surface effect is replaced with a surface effect other than the surface effect of the type having the highest glossiness, wherein a first user selection is the gloss preference and the replacing unit replaces the surface effect of the unrealizable type with a surface effect realizable by the gloss preference, and wherein a second user selection is the type preference and the replacing unit replaces the surface effect of the unrealizable type with a surface effect realizable by the type preference.

4. The printing control apparatus according to claim 3, wherein the printing apparatus includes:

a printer machine configured to form a toner image of a color toner and a colorless clear toner on a recording medium, the one or more post-processing machines including at least one of a first machine and a plurality of second machines, the first machine being configured to re-fix the toner image on the recording medium formed by the printer machine on the recording medium and improving smoothness of a surface of the toner image on the recording medium to increase glossiness of the toner image, the plurality of second machines each being configured to form, on the recording medium, a toner image of the clear toner using clear toner plane data for depositing the clear toner and fixing the toner image at a predetermined temperature, a first conveying path for discharging the recording medium after conveying the recording medium from the printer machine to the one or more post-processing machines, a second conveying path for returning the recording medium, which is conveyed on the first conveying path, to an upstream side in a conveying direction in the first conveying path again, and a switching unit configured to switch the conveying paths such that the recording medium is repeatedly conveyed on the first conveying path, and wherein the plurality of surface effects of the user designation indicated by the gloss control plane data in the same page cannot be realized in the same page in first conveyance on the first conveying path by an apparatus configuration of the one or more post-processing machines indicated by the machine type information and the replacing unit controls the printing apparatus to repeatedly convey the recording medium on the first conveying path.

5. The printing control apparatus according to claim 4, wherein the selection unit further prompts the user to select imparting of all effects indicating realization of all types of surface effects of the user designation, and wherein a user selection is the imparting of all effects and the generating unit controls, the printing control unit to repeatedly convey the recording medium along the first conveying path and performs, in every number of times of conveyance on the first conveying path, at least one of the setting of the first device and the generation of the clear toner plane data.

6. The printing control apparatus according to claim 1, wherein the replacing unit is configured to selectively control the printing apparatus to repeatedly convey the recording medium to the one or more post-processing machines based on the gloss control plane data subjected to replacement by the replacing unit and the machine type information.

7. An image forming system that generates image data, comprising:

a printing apparatus that includes a printer machine and one or more post-processing machine; and a printing control apparatus that generates image data and transmits the image data to the printing apparatus, wherein the printing control apparatus includes:

an acquiring unit configured to acquire machine type information that indicates which of one or more of the post-processing machines are connected to the printing apparatus that forms an image based on the image data, a storing unit configured to store therein gloss control plane data that specifies a type of a surface effect imparted to a recording medium for each of a plurality of areas of the recording medium, a replacing unit configured to replace a respective type of a surface effect imparted to an area of the recording medium in the gloss control plane data with a predetermined type of a surface effect based on the machine type of the one or more post-processing machines that are connected to the printing apparatus, and a generating unit configured to generate the image data based on the gloss control plane data subjected to the replacement by the replacing unit.

8. The image forming system according to claim 7, wherein the replacing unit is configured to selectively control the printing apparatus to repeatedly convey the recording medium to the one or more post-processing machines based on the gloss control plane data subjected to replacement by the replacing unit and the machine type information.

9. A printing control method performed by a printing control apparatus that generates image data and includes a storing unit configured to store therein gloss control plane data that specifies a type of a surface effect imparted to a recording medium for each of a plurality of areas of the recording medium, the printing control method comprising:

acquiring machine type information that indicates which of one or more post-processing machines are connected to a printing apparatus that forms an image based on the image data;

replacing a respective type of a surface effect imparted to an area of the recording medium in the gloss control plane data with a predetermined type of a surface effect based on the machine type information of the one or more post-processing machines that are connected to the printing apparatus; and generating the image data based on the gloss control plane data subjected to the replacement by the replacing step.

10. The printing control method according to claim 9, further comprising selectively conveying the recording medium repeatedly to the one or more post-processing machines based on the gloss control plane data subjected to replacement and the machine type information.

* * * * *